US007343119B2

(12) United States Patent
Matsuda et al.

(10) Patent No.: US 7,343,119 B2
(45) Date of Patent: Mar. 11, 2008

(54) BELT DRIVE CONTROL METHOD, BELT-DRIVE CONTROL DEVICE, AND IMAGE FORMING APPARATUS

(75) Inventors: Hiromichi Matsuda, Tokyo (JP); Hiroshi Koide, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 135 days.

(21) Appl. No.: 11/246,379

(22) Filed: Oct. 11, 2005

(65) Prior Publication Data

US 2006/0088338 A1 Apr. 27, 2006

(30) Foreign Application Priority Data

Oct. 27, 2004 (JP) ..... 2004-313058
Jul. 14, 2005 (JP) ..... 2005-205379

(51) Int. Cl.
*G03G 15/00* (2006.01)
*G03G 15/01* (2006.01)
*G03G 15/20* (2006.01)

(52) U.S. Cl. ..... 399/167; 399/302; 399/303; 399/308

(58) Field of Classification Search ..... 399/162, 399/167, 302, 303, 308, 312; 271/69; 318/560
See application file for complete search history.

(56) References Cited

U.S. PATENT DOCUMENTS 6,493,533 B1 * 12/2002 Munakata ..... 399/302 X
6,538,409 B2 * 3/2003 Takemoto ..... 318/560
6,669,189 B2 12/2003 Seto et al.
6,941,096 B2 9/2005 Matsuda et al.
6,949,896 B2 9/2005 Andoh et al.
6,990,304 B2 * 1/2006 Mitamura et al. ..... 399/167
7,079,797 B2 * 7/2006 Shinohara et al. ..... 399/167 X
7,110,700 B2 * 9/2006 Andoh et al. ..... 399/167
2003/0002887 A1 * 1/2003 Imaizumi et al. ..... 399/167
2004/0086299 A1 * 5/2004 Matsuda et al. ..... 399/167
2005/0053388 A1 3/2005 Yokoyama et al.

FOREIGN PATENT DOCUMENTS

JP 63-300248 12/1988
JP 9-267946 10/1997
JP 11-202576 7/1999
JP 2000-47547 2/2000
JP 3186090 5/2001
JP 2004-123383 4/2004

OTHER PUBLICATIONS

U.S. Appl. No. 11/495,639, filed Jul. 31, 2006, Komatsu et al.
U.S. Appl. No. 11/558,645, filed Nov. 10, 2006, Takahashi et al.

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A rotational speed of a first roller and a time required for a second roller to make one rotation are measured. A controller calculates an amplitude and a phase of fluctuation in a rotational speed in one rotation period of the first roller while the first roller is rotated by a predefined angle based on the speed and the time. The controller corrects measured speed of the first roller based on the amplitude and the phase, and controls a driving roller based on corrected speed.

97 Claims, 18 Drawing Sheets

BELT DRIVE CONTROL METHOD, BELT-DRIVE CONTROL DEVICE, AND IMAGE FORMING APPARATUS

CROSS-REFERENCE TO RELATED APPLICATIONS

The present document incorporates by reference the entire contents of Japanese priority document, 2004-313058 filed in Japan on Oct. 27, 2004 and 2005-205379 filed in Japan on Jul. 14, 2005.

BACKGROUND OF THE INVENTION

1. Field of the Invention

The present invention relates to a belt drive control method and a belt-drive control device that controls drive of an endless belt wound around rollers, and an image forming apparatus that includes the belt-drive control device.

2. Description of the Related Art

An image forming apparatus includes a belt such as a photosensitive belt, an intermediate transfer belt, and a paper conveyor belt. In such image forming apparatus, it is essential to control drive of the belt with high accuracy to obtain high-quality images. Particularly, for a tandem image forming apparatus of a direct transfer system that is excellent in an image forming speed and suitable for a reduction in a size, it is required to control driving of a conveyor belt for conveying a recording sheet with high accuracy. In this type of image forming apparatus, the recording sheet is conveyed by the conveyor belt and sequentially passed through a plurality of image forming units that are arranged along a direction of conveyance of the recording sheet. Single-color images of different colors are formed in each of the image forming units to be superimposed one another on the recording sheet. Thus, a color image is formed on the recording sheet.

An example of the tandem image forming apparatus according to an electrophotographic system is explained below with reference to FIG. 23. In the image forming apparatus, for example, image forming units 18Y, 18M, 18C, and 18K that form single-color images of yellow, magenta, cyan, and black respectively are sequentially arranged in the direction of conveyance of a recording sheet. Electrostatic latent images are formed on surfaces of photosensitive drums 40Y, 40M, 40C, and 40K by a laser exposure unit (not shown). The electrostatic latent images are developed by image forming units 18Y, 18M, 18C, and 18Y, respectively, to form toner images (visual images). The toner images are sequentially transferred onto a recording sheet (not shown). The recording sheet is caused to adhere to a conveyor belt 210 by an electrostatic force so that the recording sheet is conveyed on the conveyor belt. The toner images are superimposed one another on the recording sheet. Then, the toner is melted and compression-bonded by a fixing device 25 to form a color image on the recording sheet. The conveyor belt 210 is laid over a driving roller 215 and a driven roller 214 that are arranged in parallel to each other, with an appropriate tension. The driving roller 215 is driven to rotate at a predetermined rotational speed. The conveyor belt 210 moves endlessly at a predetermined speed following the rotation of the driving roller 215. The recording sheet is supplied to the conveyor belt 210 on a side on which the image forming units 18Y, 18M, 18C, and 18K are arranged by a sheet feeding mechanism at predetermined timing. The recording sheet moves at a speed identical to the moving speed of the conveyor belt 210 to sequentially pass the image forming units.

In such an image forming apparatus, unless the moving speed of the recording sheet, that is, the moving speed of the conveyor belt 210 is maintained at a fixed speed, color drift occurs. The color drift is caused when transfer positions of the single-color images to be superimposed one another on the recording sheet are relatively shifted from one another. When the color drift occurs, for example, a fine line image formed by superimposing plural images of different colors one another appears blurred, or a white void occurs around an outline of a black character image that is formed in a background image formed by superimposing plural images of different colors.

FIG. 24 illustrates a tandem image forming apparatus that adopts an intermediate transfer system. In the intermediate transfer system, single-color images formed on the surfaces of the photosensitive drums 40Y, 40M, 40C, and 40K of the image forming units 18K, 18M, 18C, and 18K are sequentially transferred onto an intermediate transfer belt 10. The single-color images are thus superimposed one another on the intermediate transfer belt 10, and then, collectively transferred onto the recording sheet. Also in this apparatus, unless a moving speed of the intermediate transfer belt 10 is maintained at a constant speed, color drift occurs.

In an image forming apparatus in which a belt is applied as a recording-medium transfer belt or an image carrier, if the belt does not rotate at a constant speed, banding occurs during image transfer. The banding is a phenomenon in which unevenness of image concentrations occurs. An image portion that is transferred onto the belt when the belt moving speed is relatively high appears stretched to be longer in a direction of a circumference of the belt than the original image. Conversely, an image portion that is transferred onto the belt when the belt moving speed is relatively low appears shrunk to be shorter in the direction of the circumference than the original image. Consequently, the image portion stretched has a low concentration and the image portion shrunk has a high concentration. As a result, unevenness of image concentrations occurs in the direction of the circumference. Such a problem is significant when a light-colored image of a single color is formed.

Thus, in image forming apparatuses, it is essential to accurately control driving of an endless belt, such as a photosensitive belt, an intermediate transfer belt, and a conveyor belt. One approach is to detect an angular displacement or a rotation angular speed of a driven roller, over which the endless belt is laid, and control rotation of a driving roller based on a result of detection. See, for example, Japanese Patent Application Laid-open No. S63-300248 and Japanese Patent No. 3186090. An encoder is attached to the driven roller and it detects an angular displacement or a rotational speed of the driven roller. The speed of the endless belt is subjected to feedback control based on a detection signal from the encoder. The speed of the endless belt is maintained to a constant value by maintaining a rotation angular speed of the driven roller constant. However, an angular displacement of rotational speed of rollers can fluctuate due to various factors such as eccentricity of the driven roller itself or eccentricity of attachment of the encoder to the driven roller.

A solution has been disclosed in Japanese Patent Application Laid-open Nos. H9-267946, H11-202576, and 2000-47547. An image forming apparatus disclosed in Japanese Patent Application Laid-open No. H9-267946 includes a filter unit to eliminate a rotation frequency component (a detection error) of the encoder roller from a detection signal of the detecting unit and controls moving speed of the endless belt based on the detection signal filtered by the filter unit.

An image forming apparatus disclosed in Japanese Patent Application Laid-open No. H11-202576 controls the driving of the endless belt as described below. The image forming apparatus subjects a detection signal of the detecting unit to frequency resolution, reads a rotation frequency of the encoder roller from the detection signal subjected to the frequency resolution, and extracts a magnitude (a level) and a phase of an eccentricity component of the encoder roller from the rotation frequency of the encoder roller read and the detection signal subjected to the frequency resolution. Then, the image forming apparatus eliminates extracted eccentricity component from the detection signal and controls a moving speed of the endless belt based on the signal from which the eccentricity component is eliminated.

In an image forming apparatus disclosed in Japanese Patent Application Laid-open No. 2000-47547, a driving roller and an encoder roller having diameters different from each other are provided. The driving roller is driven to rotate at a constant speed. Angular speed information of the encoder roller is obtained for at least one rotation period of the driving roller by a detecting unit. The angular speed information obtained is divided by a half rotation period of the driving roller. A former half and a latter half of the period are added to offset a speed fluctuation component due to eccentricity of the driving roller from the angular speed information. A detection error due to eccentricity of the encoder roller is obtained from the angular speed information from which the speed fluctuation component due to eccentricity of the driving roller is offset. At the time of image formation, the moving speed of the endless belt is controlled based on differential data of the angular speed information detected by the detecting unit and the detection error obtained.

However, in the image forming apparatus disclosed in Japanese Patent Application Laid-open No. H9-267946, when filter processing by the filter unit is performed digitally, since a large amount of calculation is required, processing time is long. In addition, to perform such arithmetic processing, expensive hardware is necessary. When the filter processing is performed analogically, it is necessary to perform digital-analog conversion. Since a conversion error occurs at the time of the conversion, accurate rotational speed fluctuation of the encoder roller is difficult to be obtained.

In the image forming apparatus disclosed in Japanese Patent Application Laid-open No. H11-202576, since a large amount of calculation is required for subjecting a frequency of a detection signal to frequency resolution, processing time is also long. It is also necessary to use expensive hardware to perform arithmetic processing described above.

In the image forming apparatus disclosed in Japanese Patent Application Laid-open No. 2000-47547, it is possible to control an amount of calculation for extracting a detection error from a detection signal. However, since it is necessary to store detection signals as a data string for one or more rotation periods of the driving roller, a storing unit with a large capacity is required. The fluctuation in a rotational speed of the encoder roller further includes, besides the fluctuation component caused by eccentricity of the driving roller and the fluctuation component caused by eccentricity of the encoder roller, a fluctuation component caused by a slip of the driving roller and the belt. Thus, detection error data to be extracted includes other fluctuation components such as the fluctuation component caused by a slip of the driving roller and the belt in addition to the rotational speed fluctuation due to eccentricity of the driving roller. Therefore, even if a moving speed of the endless belt is controlled based on the differential data of the angular speed information detected by the detecting unit and the extracted detection error, it is impossible to convey the belt at a constant speed.

Moreover, in the image forming apparatuses disclosed in Japanese Patent Application Laid-open Nos. H9-267946, H11-202576, and 2000-47547, to accurately calculate fluctuation in a rotational speed of the encoder roller, a rotary encoder with high resolution is required. Therefore, the image forming apparatus becomes expensive.

SUMMARY OF THE INVENTION

It is an object of the present invention to solve at least the above problems in the conventional technology.

A method according to one aspect of the present invention is of controlling drive of an endless belt that is wound around a plurality of rollers including a first roller, a second roller configured to make one rotation while the first roller is rotated by a predetermined angle, and a third roller to which rotation drive force is transmitted from a driving source. The method includes detecting a rotational speed of the first roller; measuring first rotation time required for the first roller to be rotated by the predetermined angle, in different phases within one rotation of the first roller; measuring a second rotation time required for the second roller to make one rotation; calculating an amplitude and a phase of fluctuation in a rotational speed in one rotation period of the first roller based on the first rotation time and the second rotation time; correcting detected rotational speed based on the amplitude and the phase; and controlling rotation of the third roller based on a corrected rotational speed.

A method according to another aspect of the present invention is of controlling drive of an endless belt that is wound around a plurality of rollers including a first roller, a second roller having a diameter different from that of the first roller, and a third roller to which rotation drive force is transmitted from a driving source. The method includes detecting a rotational speed of the first roller; rotating the second roller at a uniform speed; measuring rotation time required for the first roller to be rotated by a predetermined angle, in different phases within one rotation of the first roller; calculating an amplitude and a phase of fluctuation in a rotational speed in one rotation period of the first roller based on the rotation time; correcting detected rotational speed based on the amplitude and the phase; and controlling rotation of the third roller based on a corrected rotational speed.

A method according to still another aspect of the present invention is of controlling drive of an endless belt that is wound around a plurality of rollers including a first roller, a second roller having a diameter different from that of the first roller, and a third roller to which rotation drive force is transmitted from a driving source. The method includes detecting a rotational speed of the first roller; rotating the first roller at a uniform speed; measuring, for at least twice within one rotation of the first roller, rotation time required for the second roller to make one rotation, the second roller having a diameter different from that of the first roller; acquiring an amplitude and a phase of fluctuation in a rotational speed in one rotation period of the first roller based on the rotation time; correcting detected rotational speed based on the amplitude and the phase; and controlling rotation of the third roller based on a corrected rotational speed.

A device according to still another aspect of the present invention is for controlling drive of an endless belt that is wound around a plurality of rollers including a first roller being a target roller for speed detection, a second roller having a diameter different from that of the first roller, and a third roller to which rotation drive force is transmitted from a driving source. The device includes a first detecting unit with low resolution configured to detect first information on rotation of the first roller and to output a signal of at least two pulses when the first roller has made one rotation; a second detecting unit with low resolution configured to detect second information on rotation of the second roller and to output a signal of at least one pulse when the second roller has made one rotation, the second roller having a diameter different from that of the first roller; a calculating unit configured to calculate an amplitude and a phase of fluctuation in a rotational speed in one rotation period of the first roller based on the first information and the second information; and a control unit configured to control rotation of the third roller based on the amplitude and the phase.

A device according to still another aspect of the present invention is for controlling drive of an endless belt that is wound around a plurality of rollers including a first roller being a target roller for speed detection, a second roller having a diameter different from that of the first roller, and a third roller to which rotation drive force is transmitted from a driving source. The device includes a first detecting unit with low resolution configured to detect first information on rotation of the first roller and to output a signal of at least two pulses when the first roller has made one rotation; a second detecting unit with high resolution configured to detect second information on rotation of the second roller; a calculating unit configured to calculate an amplitude and a phase of fluctuation in a rotational speed in one rotation period of the first roller based on the first information; and a control unit configured to control rotation of the third roller based on the amplitude and the phase.

A device according to still another aspect of the present invention is for controlling drive of an endless belt that is wound around a plurality of rollers including a first roller being a target roller for speed detection, a second roller having a diameter different from that of the first roller, and a third roller to which rotation drive force is transmitted from a driving source. The device includes a first detecting unit with high resolution configured to detect first information on rotation of the first roller; a second detecting unit with low resolution configured to detect second information on rotation of the second roller and to output a signal of at least one pulse when the second roller has made one rotation; a calculating unit configured to calculate an amplitude and a phase of fluctuation in a rotational speed in one rotation period of the first roller based on the second information; and a control unit configured to control the third roller based on the amplitude and the phase.

An image forming apparatus according to still another aspect of the present invention includes a latent image carrier including an endless belt wound around a plurality of rollers; a latent-image forming unit configured to form a latent image on the latent image carrier; a developing unit configured to develop the latent image on the latent image carrier; a transfer unit configured to transfer a visual image formed on the latent image carrier onto a recording material; and an device for controlling driving of the endless belt according to the above aspects.

An image forming apparatus according to still another aspect of the present invention includes a latent image carrier; a latent-image forming unit configured to form a latent image on the latent image carrier; a developing unit configured to develop a latent image on the latent image carrier; an intermediate transfer member including an endless belt wound around a plurality of rollers; a first transfer unit configured transfer a visual image formed on the latent image carrier onto the intermediate transfer member; a second transfer unit configured to transfer transferred visual image on the intermediate transfer member onto a recording material; and a device for controlling drive of the endless belt according to the above aspects.

An image forming apparatus according to still another aspect of the present invention includes a latent image carrier; a latent-image forming unit configured to form a latent image on the latent image carrier; a developing unit configured to develop a latent image on the latent image carrier; a recording-material conveying member including an endless belt wound around a plurality of rollers and configured to convey a recording material; a transfer unit configured to transfer a visual image formed on the latent image carrier onto the recording material; and an device for controlling driving of the endless belt according to the above aspects.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Figure 1:
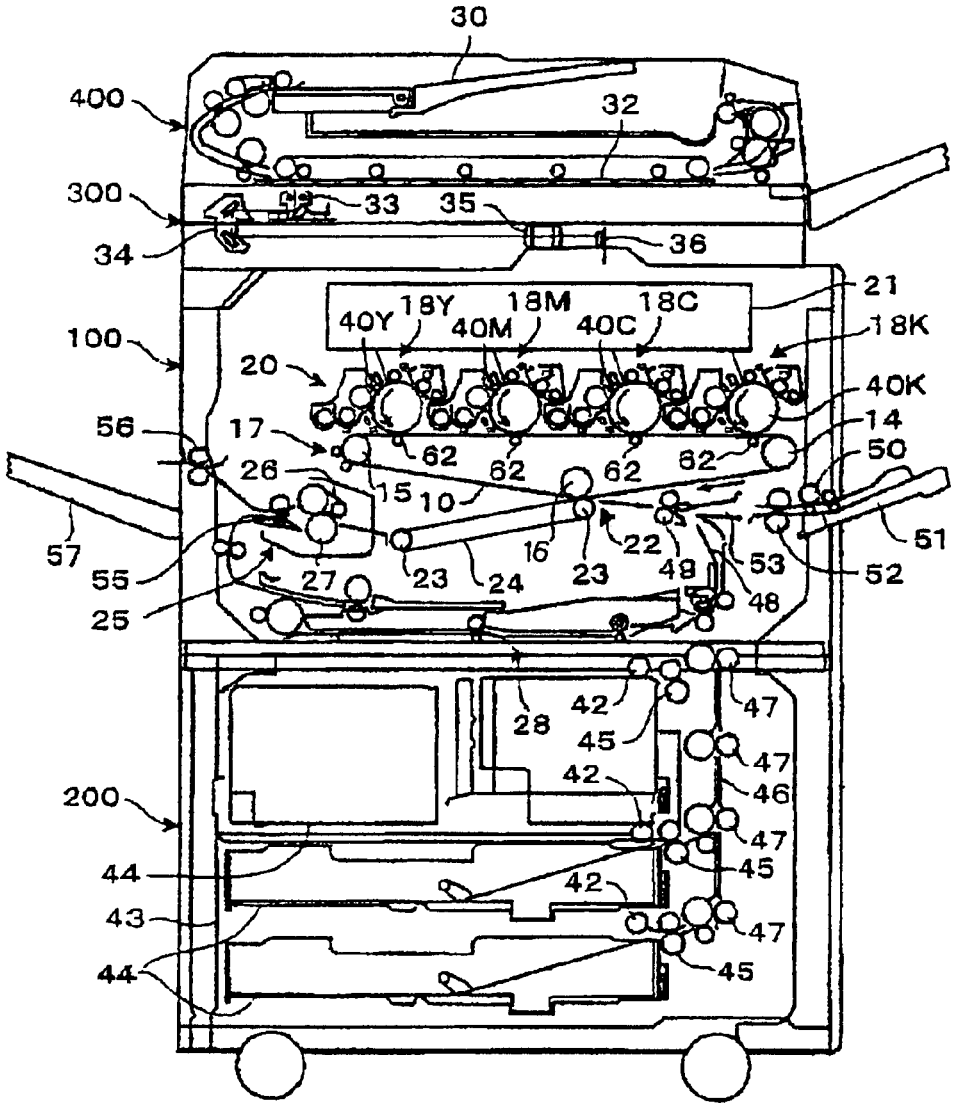
FIG. 1 is a schematic of a copying machine according to an embodiment of the present invention.

Exemplary embodiments of the present invention are explained below in detail with reference to the accompanying drawings.

When a cause of fluctuation in a rotational speed of a target roller for speed detection is eccentricity of a rotating member and is mainly fluctuation in a rotational speed in one rotation period, the fluctuation in a rotational speed of the rotating member is expressed in a relatively simple formula including an amplitude A and a phase $\alpha$ of a sine wave as unknown parameters. Note that $\omega_{02}$ is rotational speed of the rotating member rotated along with movement of a belt.

$$\omega_2=\omega_{02}+A\sin(\omega_{02}t+\alpha) \quad (1)$$

The inventors of the present invention found that it is possible to determine the amplitude A and the phase $\alpha$ from equation 1 by measuring rotation times of predetermined rotation angles of the rotating member in different phases within one rotation period of the rotating member.

$\omega_{02}$ is calculated from rotation time during which a first support rotating member makes one rotation. The first support rotating member rotates once when the target roller for speed detection among plural support rotating members, over which the belt is laid, rotates by the predefined rotation angle. Fluctuation in speed due to eccentricity or the like of the first support rotating member also occurs in a rotational speed of the first support rotating member. However, an influence of a rotational speed due to eccentricity of the first support rotating member is eliminated by measuring rotation time during which the first support rotating member makes one rotation. This is because, since it is possible to represent fluctuation due to eccentricity of the first support rotating member and the like as a trigonometric function of a sine wave and a cosine wave in one rotation period of the first support rotating member, the fluctuation component is offset in the one rotation period. Thus, it is possible to accurately calculate the rotational speed $\omega_{02}$ of the target roller rotated along with movement of the belt at the time when the rotating member rotates by the predefined rotation angle. This makes it possible to accurately derive the amplitude A and the phase $\alpha$ of fluctuation in a rotational speed of the target roller due to eccentricity of the rotating member and the like.

If the amplitude A and the phase $\alpha$ are determined, it is possible to specify fluctuation in a rotational speed in one rotation period due to eccentricity of the target roller and the like. In this way, even if the filter processing for detection data, frequency resolution for the detection data, and the like are not performed, it is possible to specify fluctuation in a rotational speed in one rotation period due to eccentricity of the target roller and the like and control a calculation amount. A result of detection of a rotational speed of the target roller is corrected based on the specified fluctuation in a rotational speed. A drive support rotating member is controlled based on corrected result of detection. Consequently, it is possible to drive the belt at a constant moving speed without being affected by fluctuation in a rotational speed due to eccentricity of the target roller and the like.

When the conventional rotary encoder is used, rotation time during which the target roller rotates by a very small rotation angle (e.g., several degrees or less) is continuously measured. Fluctuation in a rotational speed is calculated using each rotation time measured and data of the very small rotation angle. Therefore, it is necessary to use an expensive rotary encoder that can output a pulse in every rotation at the very small rotation angle to accurately calculate fluctuation in a rotational speed of the target roller. In addition, since it is necessary to store a pulse output in every rotation at the very small rotation angle, a storing unit with a large capacity is required. On the other hand, in the present invention, it is possible to calculate fluctuation in a rotational speed if rotation times are measured for predefined rotation angles (e.g., 180 degrees, or $\pi$ radian) with phases different from each other, respectively, while the target roller makes one rotation. Thus, it is unnecessary to use the expensive rotary encoder.

FIG. 1 is a schematic of a copying machine serving as an image forming apparatus according an embodiment of the present invention. In FIG. 1, reference numeral 100 denotes a copying machine body; 200, a sheet feeding table on which the copying machine body is mounted; 300, a scanner attached on the copying machine body 100; and 400, an automatic document feeder (ADF) attached on the scanner 300. The copying machine is an electrophotographic copying machine that is a tandem type and adopts an intermediate transfer (indirect transfer) system.

An intermediate transfer belt 10 includes a belt that is an intermediate transfer member serving as an image bearing member. The intermediate transfer belt 10 is provided in the center of the copying machine body 100. The intermediate transfer belt 10 is laid over support rollers 14, 15, and 16 serving as three support rotating members. The intermediate transfer belt 10 rotates to move in a clockwise direction in the figure. On the left side of the second support roller 15 among the three support rollers in the figure, an intermediate-transfer-belt cleaning device 17 that removes a residual toner remaining on the intermediate transfer belt 10 after image transfer is provided. In a belt portion stretched between the first support roller 14 and the second support roller 15 among the three support rollers, a tandem image forming unit 20, in which four image forming units 18 of yellow (Y), magenta (M), cyan (C), and black (K) are arranged side by side along a moving direction of the belt, is arranged to be opposed to the belt portion. In this embodiment, the second support roller 15 is a driving roller. An exposing device 21 serving as a latent image forming unit is provided above the tandem image forming unit 20.

A secondary transfer device 22 serving as a second transfer unit is provided on the opposite side of the tandem image forming unit 20 across the intermediate transfer belt 10. In the secondary transfer device 22, a secondary transfer belt 24 that is a recording material conveying member is laid between two support rollers. The secondary transfer belt 24 is provided to be pressed against the third support roller 16 via the intermediate transfer belt 10. The secondary transfer device 22 transfers an image on the intermediate transfer belt 10 onto a sheet serving as a recording material. A fixing device 25 that fixes the image transferred onto the sheet is provided on a left side of the secondary transfer device 22 in the figure. In the fixing device 25, a pressure roller 27 is pressed against a fixing belt 26. The secondary transfer device 22 also has a sheet conveying function for conveying the sheet after image transfer to the fixing device 25. It goes without saying that a transfer roller or a non-contact charger may be arranged as the secondary transfer device 22. In such a case, it is difficult to give the sheet conveying function to the secondary transfer device 22. In this embodiment, a sheet reversing device 28 that reverses a sheet to record images on both sides of the sheet is also provided in parallel with the tandem image forming unit 20 below the secondary transfer device 22 and the fixing device 25.

When a user makes a copy using the copying machine, the user sets an original on an original stand of the automatic document feeder 400. Alternatively, the user opens the automatic document feeder 400, sets an original on a contact glass 32 of the scanner 300, and closes the automatic document feeder 400 to hold the original. Thereafter, the user presses a not-shown start button. Then, when the original is set on the automatic document feeder 400, the original is conveyed to move onto the contact glass 32. On the other hand, when the original is set on the contact glass 32, the scanner 300 is driven immediately. Subsequently, a first traveling member 33 and a second traveling member 34 travel. The first traveling member 33 reflects light from a light source and further reflects reflected light from a surface of the original toward the second traveling member 34. A mirror of the second traveling member 34 reflects and inputs the light to a reading sensor 36 through an imaging lens 35 to read a content of the original.

In parallel with the original reading, the third support roller 16 is driven to rotate by a driving motor serving as a not-shown driving source. Consequently, the intermediate transfer belt 10 moves in the clockwise direction in the figure and the remaining support rollers (driven rollers) 14 and 15 rotate following the movement of the intermediate transfer belt 10. Simultaneously, photosensitive drums 40Y, 40M, 40C, and 40K serving as latent image bearing members are rotated in the respective image forming units 18. Latent images are exposed and developed using information of respective colors, yellow, magenta, cyan, and black, to form single color toner images (visual images) on the respective photosensitive drums. The toner images on the photosensitive drums 40Y, 40M, 40C, and 40K are sequentially transferred onto the intermediate transfer belt 10 so as to be superimposed one on top of another to form a composite color image on the intermediate transfer belt 10.

In parallel with the image formation, one of sheet feeding rollers 42 of the sheet feeding table 200 is selected and rotated to let out sheets from one of sheet feeding cassettes 44 provided in multiple stages in a paper bank 43. The sheets are separated one by one by a separating roller 45 to be sent into a sheet feeding path 46, conveyed by a conveying roller 47, guided to a sheet feeding path 48 in the copying machine body 100, and bumped against a registration roller 49 to be stopped. Alternatively, a sheet feeding roller 50 is rotated to let out sheets on a hand-supply tray 51. The sheets are separated one by one by a separating roller 52 to be sent into a sheet feeding path 53 and bumped against the registration roller 49 to be stopped. The registration roller 49 is rotated to be timed to coincide with the composite color image on the intermediate transfer belt 10 to send the sheet into a space between the intermediate belt 10 and the secondary transfer device 22. The secondary transfer device 22 transfers the color image onto the sheet. The sheet after the image transfer is conveyed by the secondary transfer belt 24 to be sent into the fixing device 25. After fixing the transferred image by applying heat and pressure to the transferred image with the fixing device 25, the sheet is switched by a switching pawl 55 to be discharged by a discharge roller 56 and stacked on a sheet discharge tray 57. Alternatively, the sheet is switched by the switching pawl 55 to be sent into the sheet reversing device 28, reversed by the sheet reversing device 28, and guided to the transfer position again. After an image is recorded on a rear side of the sheet, the sheet is discharged onto the sheet discharge tray 57 by the discharge roller 56.

Note that a residual toner remaining on the intermediate transfer belt 10 after the image transfer is removed by an intermediate-transfer-belt cleaning device 17. The intermediate transfer belt 10 is prepared for image formation. In general, the registration roller 49 is often grounded and used. However, it is also possible to apply a bias to remove paper powder on the sheet.

It is also possible to make a black monochrome copy using the copying machine. In that case, the intermediate transfer belt 10 is separated from the photosensitive drums 40Y, 40M, and 40C by a not-shown unit. Drive for the photosensitive drums 40Y, 40M, and 40C is temporarily stopped. Only the photosensitive drum 40K for black is brought into contact with the intermediate transfer belt 10 to perform formation and transfer of an image.

In the copying machine in this embodiment, it is necessary to move the intermediate transfer belt 10 at a constant speed. However, actually, fluctuation in speed occurs because of eccentricity of a driving roller and a transmission error of a deceleration mechanism including a gear and the like from a driving motor to the driving roller. The transmission error is mainly eccentricity of the gear and an accumulated pitch error of teeth. Besides, there is fluctuation in speed and the like caused by fluctuation in a load of a roller that is in contact with a belt.

When a belt moving speed of the intermediate transfer belt 10 fluctuates, an actual belt moving position is shifted from a target belt moving position. Then, leading positions of toner images on the photosensitive drums 40Y, 40M, and 40C are shifted from one another on the intermediate transfer belt 10 to cause color drift. Moreover, if the belt moving speed fluctuates the image to be formed appears to be stretched or shrunk and appears different from an original shape. In this case, a cyclic variation in an image concentration (banding) appears on an image finally formed on the sheet in a direction corresponding to the belt movement.

Thus, in some image forming apparatus, an encoder is attached to a support roller to recognize fluctuation in a belt speed and perform feedback control such that the belt speed becomes constant. However, regardless of the fact that a conveying speed of the belt is constant, a detecting unit detects fluctuation in a rotational speed due to eccentricity of the roller to which the encoder is attached and attachment eccentricity of the encoder. As a result, the fluctuation in a rotational speed is fed back and the belt speed cannot be maintained constant.

Figure 2:
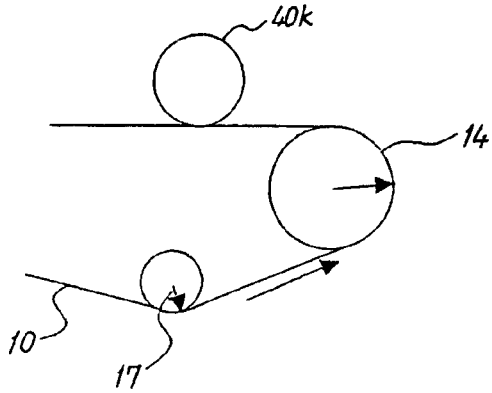
FIG. 2 is a schematic of a main part of an intermediate transfer belt.

FIG. 2 is a schematic of a main part of the intermediate transfer belt 10. The intermediate transfer belt 10 is wound around a first support roller 17 (hereinafter, "driven roller") and a second support roller 14 serving as a target roller having a radius larger than that of the first support roller 17. The intermediate transfer belt 10 moves endlessly in a direction of arrow A in the figure. Not shown detecting units are provided in the first support roller 17 and the second support roller 14, respectively.

A relation between a belt conveying speed V and a rotation angular speed ω at the time when a roller has eccentricity is explained below.

Figure 3A:
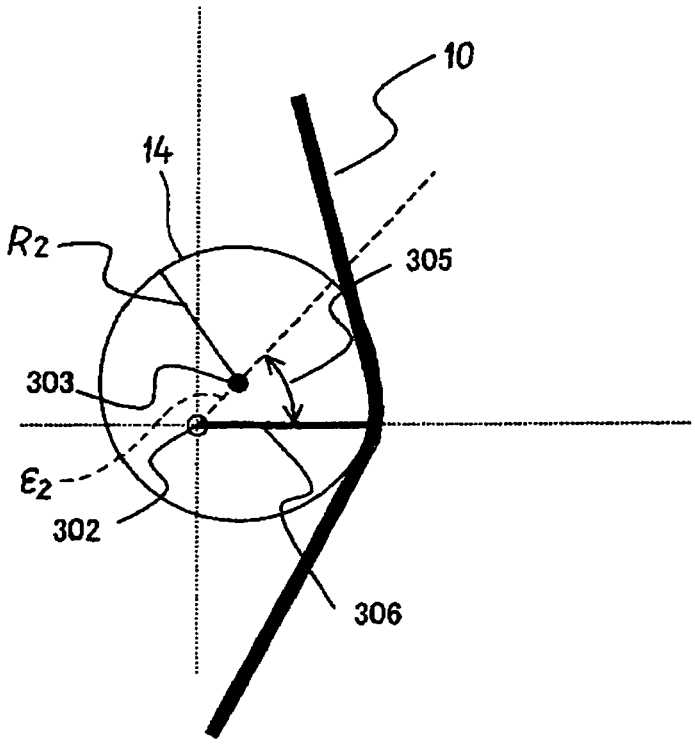
FIG. 3A is a schematic of a roller having eccentricity.

FIG. 3A is a schematic of the second support roller 14 having eccentricity around which a belt is wound. As shown in FIG. 3A, the belt 10 is wound around the second support roller 14 having a diameter $R_2$. A rotation center 302 and a circular sectional center 303 of the second support roller 14 are separated by an amount of eccentricity $\epsilon_2$ (a linear distance between the rotation center 302 and the circular sectional center 303). A straight line 306 in the figure is a line segment connecting the rotation center 302 of the second support roller 14 and a center of an area where the belt 10 is in contact with the second support roller 14. Assuming that belt speed is determined by a length of the straight line 306, when a length of the straight line 306 is set as a belt speed determining distance $R_\epsilon$, it is possible to represent the belt speed determining distance $R_\epsilon$ as follows.

$$R_\epsilon \cong R_2 + \epsilon_2 \cos\theta_2 \tag{2}$$

A relation between a rotation angular speed $\omega_2$ of the second support roller 14 having the radius $R_2$ and the belt speed V is represented as follows from equation 2 after excluding an influence of a belt thickness.

$$V = \{R_2 + \epsilon_2 \cos(\theta_2 + \alpha_2)\}\omega_2 \tag{3}$$

$\theta_2 + \alpha_2$ is a rotation angle of the second support roller 14 and $\alpha_2$ is an eccentricity direction phase (angle) at the time when $\theta_2 = 0$ (time t=0).

From equation 3, since the belt speed V is a constant belt speed V0, a reference rotation angular speed $\theta_{2ref}$ of the second support roller 14 is represented as follows.

$$\omega_{2ref} = \frac{V_0}{R_2 + \varepsilon_2 \cos(\theta_2 + \alpha_2)} \tag{4}$$

Equation 4 indicates a rotational speed fluctuation component due to eccentricity of the second support roller 14. In other words, it is seen that, even if the belt is rotated as the constant speed V0, the reference rotation angular speed $\omega_{2ref}$ of the second support roller 14 fluctuates.

It is assumed that the belt speed V fluctuates as described below. Note that ΔVn is an n-th order high-frequency component amplitude of fluctuation in a belt speed desired to be controlled, ωn is an n-th order high-frequency component angle frequency of fluctuation in a belt speed, and αn is an n-th order high-frequency component phase of fluctuation in a belt speed.

$$V = V_0 + \Delta V_n \cos(\omega_n t + \alpha_n) \tag{5}$$

In this case, the rotation angular speed $\omega_2$ of the second support roller 14 is represented as follows from equation 2.

$$\begin{aligned}\omega_2 &\cong \frac{V_0}{R_2} + \frac{\Delta V_n}{R_2}\cos(\omega_n t + \alpha_n) - \frac{\varepsilon_2 V_0}{R_2^2}\cos(\theta_2 + \alpha_2) \\ &= \omega_{2ref} + \frac{\Delta V_n}{R_2}\cos(\omega_n t + \alpha_n)\end{aligned} \tag{6}$$

When it is desired to control a fluctuation component in a belt speed (a coefficient $\Delta V_n$ in equation 6) to have a constant speed, the rotation angular speed $\omega_2$ of the second support roller 14 is controlled to be the reference rotation angular speed $\omega_{2ref}$ of the second support roller 14. Then, the fluctuation component in a belt speed is controlled. Consequently, the belt speed V becomes a constant speed $V_0$.

Thus, in equation 4, if it is possible to detect a fluctuation component in a rotational speed of the second support roller 14 in equation 7 below, it is possible to feed back a rotation angular speed of the second support roller 14 to control a belt speed to be constant.

$$Comp = \frac{\varepsilon_2 V_0}{R_2^2}\cos(\theta_2 + \alpha_2) \tag{7}$$

The fluctuation component in a rotational speed of the second support roller 14 in equation 7 is derived by detecting rotation angular velocities of the first support roller 17 and the second support roller 14. For simplicity of explanation, a rotation angular speed $\omega_1$ of the first support roller 17 having the radius $R_1$ is controlled to a constant rotation angular speed $\omega_{01}$. When a rotation angle of the first support roller 17 is set as $\theta_1 + \alpha_1$ (an eccentricity direction phase (angle) at the time of $\theta_1 = 0$ (time t=0) is $\alpha_1$) and eccentricity of the first support roller 17 is set as $\epsilon_1$, a rotation angular speed $\omega_{2V}$ of the second support roller 14 is represented as follows from $$\begin{aligned}\omega_{2V} &= \frac{R_1 + \varepsilon_1\cos(\theta_1 + \alpha_1)}{R_2 + \varepsilon_2\cos(\theta_2 + \alpha_2)}\omega_{01} \\ &\cong \frac{R_1}{R_2}\omega_{01}\left\{1 + \frac{\varepsilon_1}{R_1}\cos(\theta_1 + \alpha_1) - \frac{\varepsilon_2}{R_2}\cos(\theta_2 + \alpha_2)\right\}\end{aligned} \tag{8}$$

It is seen from equation 8 that, when the first support roller 14 is rotated at the constant rotation angular speed $\omega_{01}$, the rotation angular speed $\omega_{2V}$ of the second support roller 14 includes fluctuation in a rotational speed (in curly brackets in equation 8) due to eccentricity of the first support roller 17 and fluctuation in a rotational speed (in curly brackets in equation 8) due to eccentricity of the second support roller 14.

When it is desired to detect one of the fluctuation in a rotational speed due to eccentricity of the first support roller 17 and the fluctuation in a rotational speed due to eccentricity of the second support roller 14, if rotation periods of the first support roller 17 and the second support roller 14 are different, that is, roller diameters thereof are different, it is possible to distinguish and detect the fluctuation in a rotational speed due to eccentricity of the first support roller 17 and the fluctuation in a rotational speed due to eccentricity of the second support roller 14. In this way, it is seen from equation 4 and equation 8 that, if it is possible to detect the fluctuation in a rotational speed due to eccentricity of the second support roller 14, it is possible to perform feedback control for feeding back the rotation angular speed of the second support roller 14 to control the belt speed V to be the constant speed $V_0$.

A relation between the belt conveying speed V and a rotation angular speed $\omega_s$ detected by the detecting unit, which is attached to the second support roller 14, at the time when the detecting unit has eccentricity of attachment is explained below.

Figure 3B:
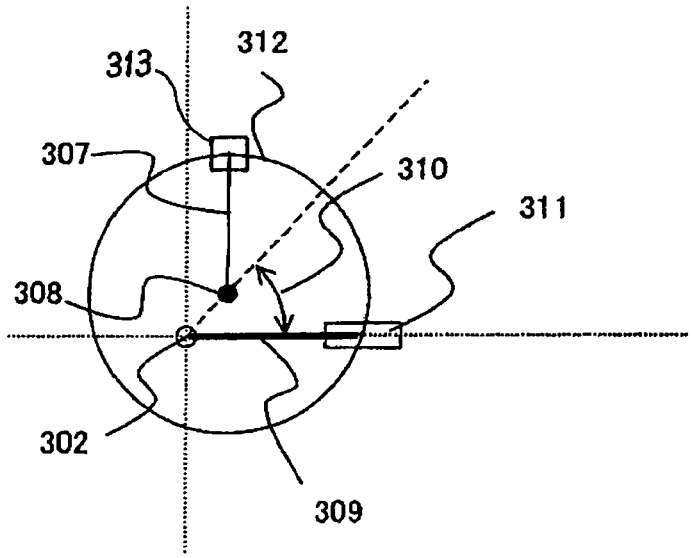
FIG. 3B is a schematic for illustrating eccentricity of a detecting unit.

In an example shown in FIG. 3B, an attachment error of the encoder board occurs with respect to a rotation axis and the encoder board rotates with eccentricity. In the figure, reference numeral 312 denotes a central line of a timing mark 313 formed of marks at fixed intervals on the encoder board. A rotation angular speed of the second support roller is detected at timing when the timing mark 313 on the central line 312 passes a sensor 311. A rotation center 308 of the encoder board and the center 302 of the roller are separated from each other by an amount of eccentricity $\epsilon_s$ (a linear distance between the rotation center 302 and the circular sectional center 303). Speed $V_s$ of the timing mark of the encoder board passing a sensor slit is approximated as described below. $\omega_2$ is a rotation angular speed of the rotation axis and, in this case, a rotation angular speed of the second support roller. $\epsilon_s$ is an amount of eccentricity of the encoder board and $\alpha_s$ is an eccentricity direction phase (angle) at the time of $\theta_s=0$ (time t=0).

$$V_s=\{R_s+\epsilon_s\cos(\theta_s+\alpha_s)\}\omega_2 \tag{9}$$

Taking into account the fact that the rotation angular speed $\omega_s$ of the second support roller detected by the encoder is $\omega_s=V_s/R_s$, equation 9 is substituted in equation 3. A relation between the belt speed V and the rotation angular speed $\omega_s$ detected by the encoder is represented as follows.

$$V \cong \left\{R_2+\varepsilon_2\cos(\theta_2+\alpha_2)-\frac{R_2}{R_S}\varepsilon_S\cos(\theta_S+\alpha_S)\right\}\omega_S \tag{10}$$

In this way, it is seen that, as a relation between a belt speed and a rotation angular speed of the second support roller detected by the detecting unit, when the encoder board has attachment eccentricity, a fluctuation component in a rotational speed, which has an amount of roller eccentricity as an amplitude, superimposed with a fluctuation component in a rotational speed, which has an amount of attachment eccentricity of the encoder board, is detected.

A fluctuation component in a rotational speed of roller eccentricity (in curly brackets in equation 10) and a fluctuation component in a rotational speed (in curly brackets in equation 10) of attachment eccentricity of the encoder board are fixed to the same rotation axis 302, periods thereof are identical. Thus, it is possible to combine the two fluctuation components in a rotational speed into one fluctuation component. Then, equation 10 is converted as represented by the following equation (a subtraction process of a cosine wave is omitted).

$$V\cong\{R_2+\epsilon_{2S}\cos(\theta_{2S}+\alpha_{2S})\}\omega_s \tag{11}$$

$\epsilon_{2S}$ and $\alpha_{2S}$ are calculated according to combination of two cosine functions of equation 10. $\theta_{2S}$ indicates a rotation angle from a reference axis set anew. However, when a belt winding section and a sensor slit are on an identical rotation axis, it is also possible that $\theta_2=\theta_s=\theta_{2S}$. When the belt winding section and the sensor slit are in different places, the calculation only has to be performed with $\theta_2=\theta_{s+\beta}=\theta_{2S}$.

It is seen that, even if there is encoder attachment eccentricity in addition to roller eccentricity, if fluctuation in a rotational speed due to eccentricity of the second support roller and attachment eccentricity of the detecting unit can be detected in the same manner as the explanations from equation 4 to equation 8 considering that the encoder attachment eccentricity is one fluctuation in a rotational speed combined with the roller eccentricity, it is possible to perform feedback control for feeding back rotation angular speed of the second support roller to control the belt speed V to the constant speed V0.

A belt-drive control device that performs feedback control to prevent fluctuation in a rotational speed due to eccentricity of the second support roller and the attachment eccentricity of the detecting unit from becoming fluctuation in belt conveying speed is explained below. Note that the explanation is not limited to the intermediate transfer belt 10 but is equally applied to a belt that is subjected to drive control. Thus, the explanation is applied to the belt.

Figure 4:
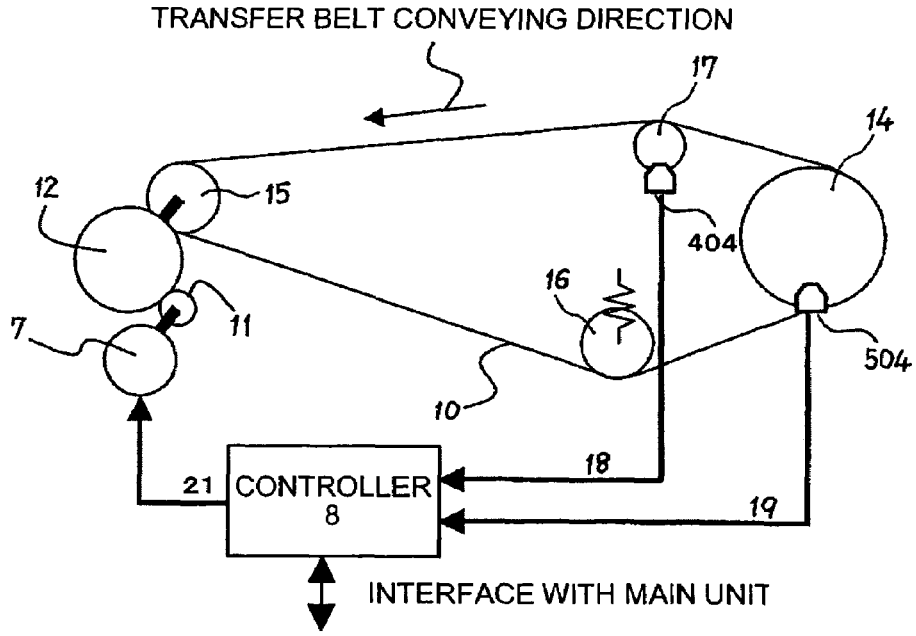
FIG. 4 is a schematic of a belt-drive control device.

FIG. 4 is a schematic of the belt drive control apparatus. As shown in FIG. 4, the belt 10 is stretched by a driving roller 15, a tension roller 16, and first and second support rollers 17 and 14. The first support roller 17 and the second support roller 14 include a first detecting unit 404 and a second detecting unit 504 for detecting rotation information, respectively. The second support roller 14 is used as a target roller. In other words, rotational speed of the second support roller 14 is detected, and a motor 7 serving as a driving source is controlled based on a result of the detection to drive the belt at a constant speed. A rotation drive force from the motor 7 serving as the driving source is transmitted to the driving roller 15 via a transmission mechanism including two gears 11 and 12. The driving roller 15 drives to convey the belt in a direction of arrow in the figure with a rotation drive force from the motor 7. The first support roller 17 and the second support roller 14 are driven to rotate following the conveyance of the belt. In this case, the first detecting unit 404 and the second detecting unit 504 transmit pulse signals 18 and 19 of the support rollers to a controller 8. The controller 8 detects fluctuation in a rotational speed due to eccentricity of the second support roller 14 detected by the second detecting unit 504 and attachment eccentricity of the second detecting unit 504 based on the pulse signals of the first support roller 17 and the second support roller 14. The controller 8 calculates target angular speed based on the fluctuation in a rotational speed detected of the second support roller 14. At the time of image formation, according to a drive instruction from the apparatus body, the controller 8 transmits a motor drive signal 21 to the motor 7 such that the rotation angular speed of the second support roller 14 detected by the second detecting unit 504 becomes the target angular speed.

As the motor 7, it is possible to use, for example, a DC motor used in an image forming apparatus. A rotary encoder may be set in a motor shaft. A DC servomotor that subjects the motor shaft to feedback control based on an output of the rotary encoder and a stepping motor that controls rotation angular speed of the motor shaft with a drive pulse frequency to be input may be used. It is possible to bring the driving roller to a desired rotation angular speed fast and stably by using the DC servomotor and the stepping motor. In the feedback control for the driving roller based on rotation information of the second support roller, since a minor loop for feeding back rotation information of the motor shaft is formed, it is possible to design a more stable control system.

Figure 5:
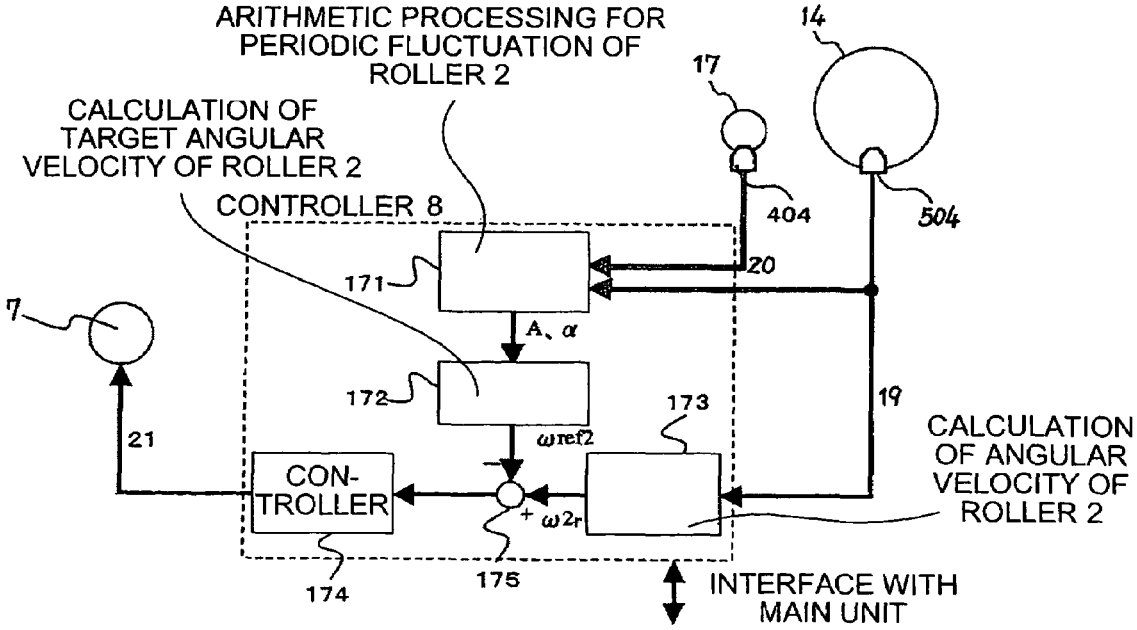
FIG. 5 is a schematic for illustrating a control performed by a controller shown in FIG. 4.

FIG. 5 is a schematic for illustrating a control performed by the controller 8. The controller 8 includes a second-support-roller rotation-speed-fluctuation calculation processing unit 171, a second-support-roller target-angular-speed calculation processing unit 172, a second-support-roller angular-speed calculating unit 173, a comparator 175, and a controller unit 174. The second-support-roller rotation-speed-fluctuation calculation processing unit 171 receives a pulse signal 20 of the first detecting unit 404, which is rotation information of the first support roller 17, and a pulse signal 19 of the second detecting unit 504, which is rotation information of the second support roller 14. The second-support-roller rotation-speed-fluctuation calculation processing unit 171 calculates an amplitude A and a phase $\alpha$ of fluctuation in a rotational speed of the second support roller 14 based on the rotation information of the first support roller 17 and the rotation information of the second support roller 14 received. The second-support-roller rotation-speed-fluctuation calculation processing unit 171 transmits the amplitude A and the phase $\alpha$ of fluctuation in a rotational speed of the second support roller 14 calculated to the second-support-roller target-angular-speed calculation processing unit 172.

The second-support-roller target-angular-speed calculation processing unit 172 stores the amplitude A and the phase $\alpha$ of fluctuation in a rotational speed of the second support roller 14 in a storing unit. When the second-support-roller target-angular-speed calculation processing unit 172 receives a target speed $V_0$ of the belt instructed from the apparatus body, the second-support-roller target-angular-speed calculation processing unit 172 derives a target rotation angular speed $\omega_{2ref}$ of the second support roller as reference rotation angular speed data from A, $\alpha$, and V0 and outputs the target rotation angular speed $\omega_{2ref}$.

The second-support-roller angular-speed calculating unit 173 calculates a rotation angular speed of the second support roller from fed-back output data of the second detecting unit 504 and outputs the rotation angular speed to the comparator 175.

The comparator 175 calculates a difference between the target rotation angular speed $\omega_{2ref}$ of the second support roller 14, which is calculated by the second-support-roller target-angular-speed calculation processing unit 172, and the fed-back rotation angular speed of the second support roller 14. Differential data calculated by the comparator 175 is sent to the controller unit 174. The controller unit 174 uses, for example, a PID controller and outputs a speed instruction signal for the motor 7. The motor 7 adjusts a drive torque in response to the speed instruction signal and conveys the belt at desired speed.

The first detecting unit 404 attached to the first support roller 17 detects rotation information of the first support roller 17 and transmits the information to the controller 8. The second detecting unit 504 attached to the second support roller 14 detects rotation information of the second support roller 14 and transmits the information to the controller 8. A constitution of the first detecting unit 404 used in the first support roller 17 and a constitution of the second detecting unit 504 used in the second support roller 14 are different depending on a detection method for detecting fluctuation in a rotational speed of the second support roller 14.

Figure 6A:
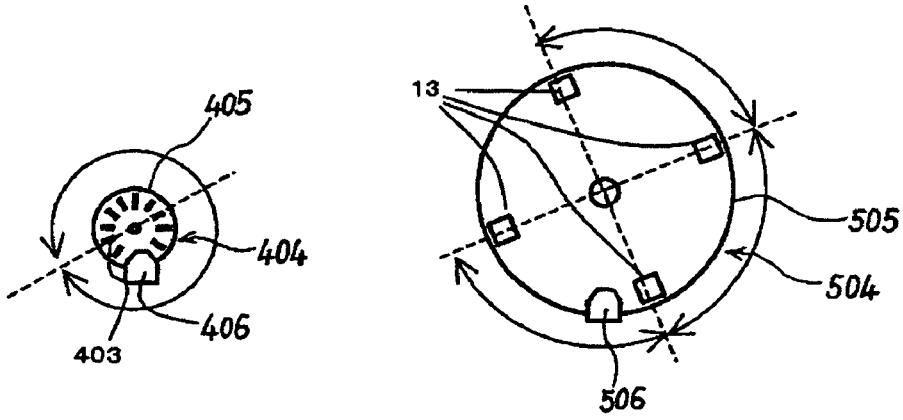
FIG. 6A is a schematic of a first detecting unit and a second detecting unit of a second example.
Figure 6B:
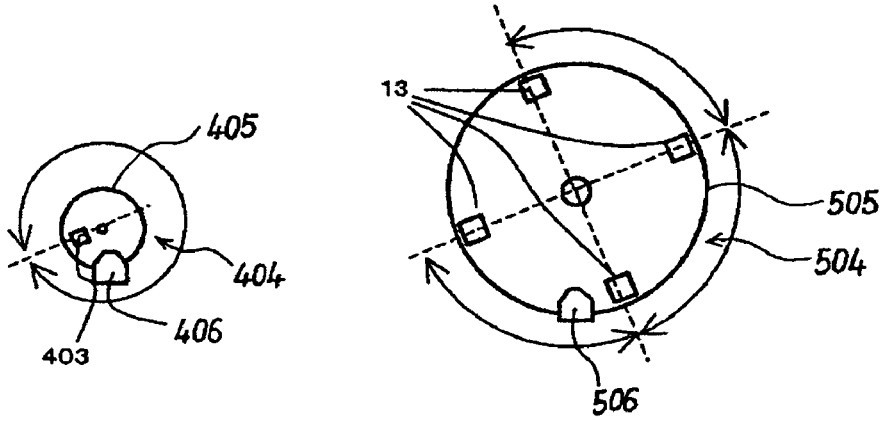
FIG. 6B is a schematic of a first detecting unit and a second detecting unit of a first example.
Figure 6C:
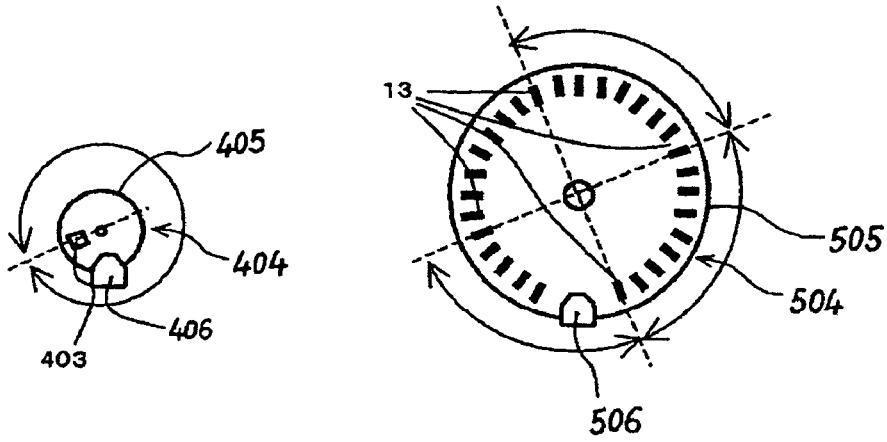
FIG. 6C is a schematic of a first detecting unit and a second detecting unit of a third example.

FIGS. 6A to 6C are diagrams of the first detecting unit 404 and the second detecting unit 504. In an example shown in FIG. 6A, the first detecting unit 404 is a rotary encoder including an encoder board 405 that has a plurality of slits 403 provided at equal intervals over an entire periphery thereof and a detector 406. The second detecting unit 504 includes an encoder board 505 that has slits 13 at equal intervals in four places on a circumference thereof, and a detector 506. In an example shown in FIG. 6B, the first detecting unit 404 includes the encoder board 405 that has the slit 403 provided in one place, and the detector 406. The second detecting unit 504 includes the encoder board 505 that has the slits 13 provided at equal intervals in four places on a circumference thereof and the detector 506. In an example shown in FIG. 6C, the first detecting unit 404 includes the encoder board 405 that has the slit 403 provided in one place and the detector 406. The second detecting unit 504 is a rotary encoder including the encoder board 505 that has the slits 13 provided at equal intervals over an entire circumference thereof and the detector 506.

It is possible to use the first detecting unit 404 and the second detecting unit 504 shown in FIG. 6A suitably in a method of detecting fluctuation in a rotational speed of the second support roller 14, which is detected by the second detecting unit 504, by controlling the first support roller 17 at a constant speed. It is possible to use the first detecting unit 404 and the second detecting unit 504 shown in FIG. 6B suitably in a method of detecting fluctuation in a rotational speed of the second support roller 14, which is detected by the second detecting unit 504, by controlling to rotate the driving motor 7 at a constant speed. It is possible to use the first detecting unit 404 and the second detecting unit 504 shown in FIG. 6C suitably in a method of detecting fluctuation in a rotational speed of the second support roller 14, which is detected by the second detecting unit 504, by rotating the second support roller 14 at a constant speed. These detection methods are described later.

A ratio of a diameter of the first support roller 17 and a diameter of the second support roller 14 shown in FIGS. 6A to 6C is set to 1:4. In FIGS. 6A and 6B, the slits 13 provided in the encoder board 505 of the second support roller 14 are provided in positions corresponding to rotation periods of the first support roller 17.

The detectors 406 and 506 include a light-emitting element and a light-receiving element. The light-emitting element and the light-receiving element are provided to be opposed to each other across the encoder boards 405 and 505. When the slits 403 and 13 pass over the detector, the light-receiving element detects light of the light-emitting element. When the light-receiving element detects the light of the light-emitting element, an electric current is generated. The electric current is sent to the controller 8 as a pulse signal.

In this embodiment, rotation information of the second support roller 14 is detected by measuring time from detection of the slits 13 by the detector 506 until detection of a specific slit. A detection section (an interval between a slit and a specific slit), which is set to detect rotation information, is preferably set to be integer times as long as a rotation period of the first support roller 17. By setting the detection section in this way, it is possible to neglect most of an influence due to fluctuation in a rotational speed of the first support roller 17. The fluctuation in a rotational speed of the first support roller 17 is caused by eccentricity of the first support roller 17. One period thereof is one rotation of the first support roller. Fluctuation in a rotational speed due to eccentricity of the first support roller 17 affects rotation angular speed of the second support roller 14. However, in the fluctuation in rotation due to eccentricity of the first support roller 17, a component fluctuating positively and a component fluctuating negatively in one period of the first support roller 17 are equal. Thus, there is no error of measurement time in one period of the first support roller 17.

As a result, it is possible to obtain rotation information of the second support roller 14 without being affected by the fluctuation in a rotational speed of the first support roller 17 by setting the detection section to be integer times as long as the rotation period of the first support roller 17.

Moreover, it is also possible to improve sensitivity for detecting fluctuation in a rotational speed of the second support roller 14 most by setting a phase difference between detection sections to ($\pi/2$). For example, when fluctuation in a rotational speed due to eccentricity of the second support roller 14 and attachment eccentricity of the second detecting unit 504 is a COS wave of a phase 0, a section from 0 to $\pi$ is an area in which an angular speed fluctuates positively with respect to an average angular speed. Measurement time is the shortest in this section. On the other hand, a section from $\pi$ to $2\pi$ is an area in which an angular speed fluctuates negatively with respect to an average angular speed. Measurement time is the longest in this section. In this way, if a detection section is set to $\pi$, it is possible to detect an area in which an angular speed fluctuates positively with respect to an average angular speed in all fluctuation components and an area in which an angular speed fluctuates negatively with respective to an average angular speed in all fluctuation components. It is possible to improve sensitivity for detecting fluctuation in a rotational speed of the second support roller 14 most.

However, even if a detection section is set to $\pi$, when fluctuation in a rotational speed of the second support roller 14 is a SIN wave of a phase 0 (a COS wave of a phase ($\pi/2$), an area in which angular speed fluctuates positively with respect to an average angular speed and an area in which angular speed fluctuates negatively appear symmetrically in the section from 0 to $\pi$ with ($\pi/2$) as a boundary. As a result, a component of fluctuation in a rotational speed of the second support roller is offset. In the section from 0 to $\pi$, measurement time is the same as the measurement time at the time when the second support roller moves at an average angular speed. In a section from $\pi$ to $2\pi$, a component of fluctuation in a rotational speed is offset in the same manner. Measurement time is the same as the measurement time at the time when the second support roller moves at an average angular speed. Thus, it is impossible to detect the fluctuation in a rotational speed of the second support roller at all. Therefore, one detection section is set to 0 to $\pi$, the other detection section is set to ($\pi/2$) to ($3\pi/2$), and a phase difference between the detection sections is set to ($\pi/2$). Consequently, even in the case of the SIN wave, the detection section ($\pi/2$) to ($3\pi/2$) is an area in which an angular speed fluctuates negatively with respect to an average angular speed and measurement time is the longest. In this way, by setting the phase difference between the detection sections to ($\pi/2$), it is possible to improve sensitivity for detecting fluctuation in a rotational speed of the second support roller 14 in one of the detection sections. When fluctuation in a rotational speed of the second support roller is close to the SIN wave, detection sensitivity in the detection section ($\pi/2$) to ($3\pi/2$) is higher than detection sensitivity in the detection section 0 to n. On the other hand, when fluctuation in a rotational speed of a detection error is close to the COS wave, detection sensitivity in the detection section 0 to $\pi$ is higher than detection sensitivity in the detection section ($\pi/2$) to ($3\pi/2$).

Fluctuation components of the second support roller 14 include, other than the fluctuation in a rotational speed of the first support roller 17, fluctuation in a rotational speed of a drive transmission system such as a gear that transmits a drive force from the driving roller 15 or the motor 7 to the driving roller 15. It is possible to further improve detection accuracy by setting a detection section to be integer times as long as the fluctuation in a rotational speed of such a drive transmission system or the like. In particular, if it is possible to set the detection section to a least common multiple of a rotation period of the first support roller and the fluctuation in a rotational speed of the drive transmission system or the like, it is possible to neglect most of influences of both the fluctuation in a rotational speed of the first support roller 17 and the fluctuation in a rotational speed of the drive transmission system or the like.

Figure 7:
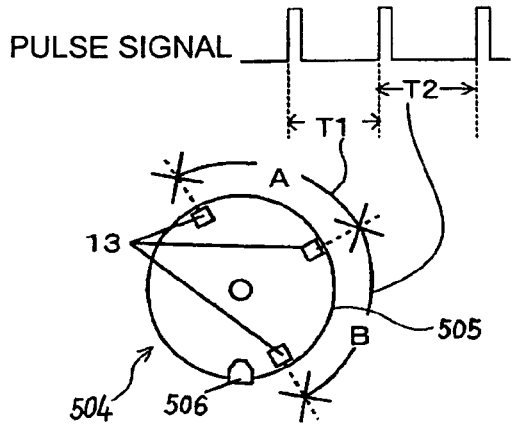
FIG. 7 is a schematic of a second detecting unit in which three slits are provided in an encoder board.

The second detecting unit 506 shown in FIG. 7 includes the slits 13 in the three places of the encoder board 505. However, the slits 13 may be provided in three places of an encoder board of the second detecting unit 504 as shown in FIG. 7. However, the slits 13 may be provided in three places of an encoder board of the second detecting unit 504 as shown in FIG. 7.

Figure 8:
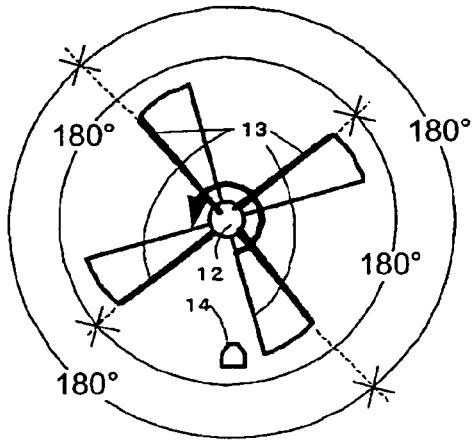
FIG. 8 is a schematic of a second detecting unit including a tabular member having vane sections (or detection marks)

As shown in FIG. 8, four fan-shaped vane members may be attached to the second detecting unit 504 such that the detector 506 detects edges indicated by bold lines in the figure. In addition, as shown in FIG. 8, the first detecting unit 404 may be used as a detecting unit that detects edges.

Figure 9:
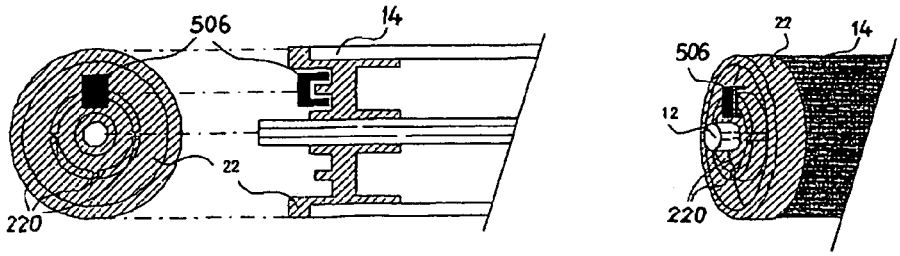
FIG. 9 is a schematic of a second detecting unit including cutouts in a flange section of a second support roller.

Moreover, as shown in FIG. 9, cutouts 220 may be provided as sections to be detected in four places at equal intervals in a flange section 22 of the second support roller to detect rotation information of the second support roller 14 by detecting the cutouts 220 with the detector 506. Similarly, the first detecting unit 404 may have the same constitution.

Sections to be detected such as slits and edges may be formed of a magnetic substance and a detector may be a magnetic sensor. The detector for detecting the slits and the edges may be formed in a reflection type by forming a light-emitting element and a light-receiving element in one fixed portion of a rotation board.

It is necessary to set a home position that is a reference of rotation at least for the second support roller 14. The home position is a reference position in detecting eccentricity of the second support roller and performing feedback control using fluctuation in a rotational speed of the second support roller detected.

Figure 10:
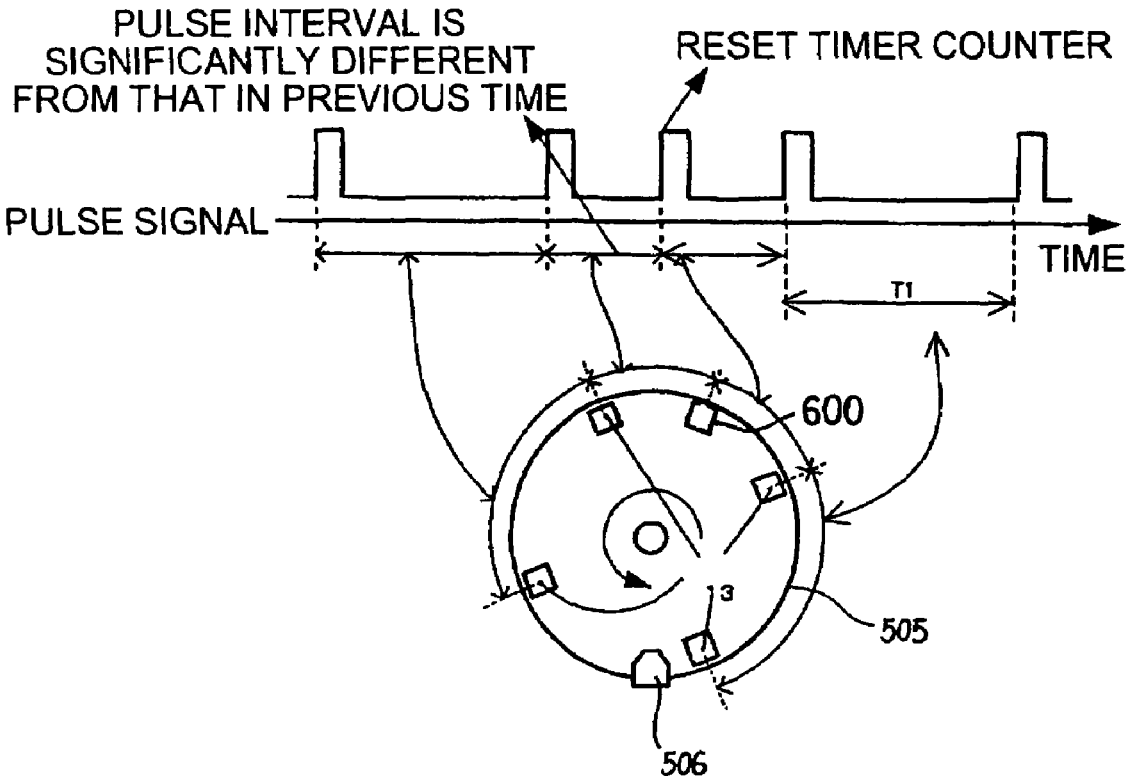
FIG. 10 is a schematic of a second detecting unit in which a slit for home position detection is provided separately from slits for section detection.

In an example shown in FIG. 10, a slit 17 for home position detection is provided in the encoder board 505 separately from the slits 13 for section detection. As shown in FIG. 10, the slits 13 for section detection are provided in four places on the periphery of the encoder board 505 with phases shifted by 90°. Only one slit 17 for home position detection is provided in one of sections among the slits 13.

Detection of a home position is performed as described below. A transmission interval of pulse signals in sections where the slit 17 for home position detection is not provided is substantially fixed time T1. On the other hand, a transmission interval of pulse signals is shorter than the fixed time T in the sections where the slit 17 for home position detection is provided. Thus, it is possible to detect a home position of the second support roller by detecting the transmission interval with the controller 8.

Figure 11:
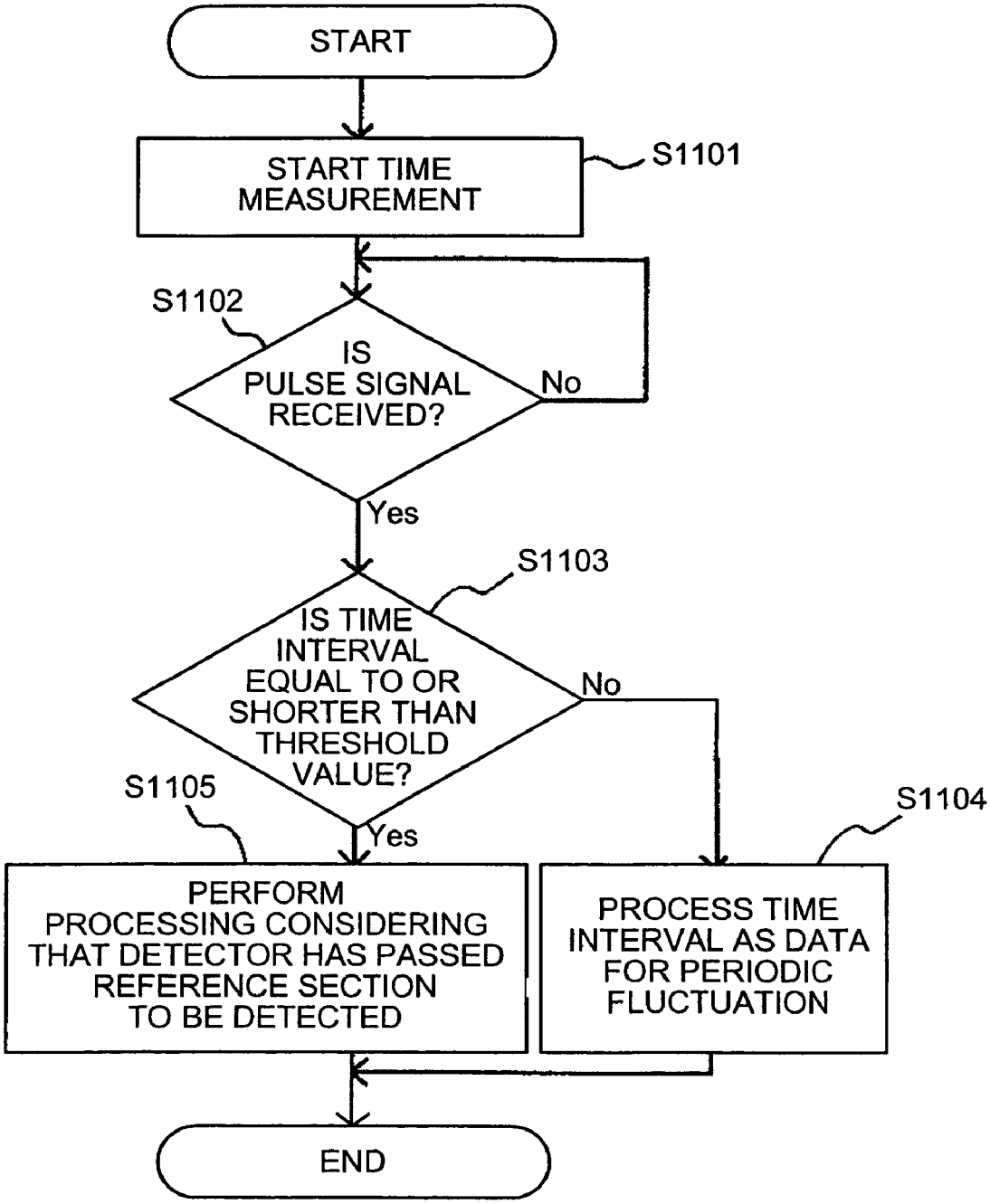
FIG. 11 is a flowchart of home position detection.

FIG. 11 is a flowchart of home position detection. As shown in FIG. 11, when the controller 8 detects a pulse signal, the controller 8 starts time measurement (step S1101). When the controller 8 detects the next pulse signal ("YES" at step S1102), the controller 8 checks whether a time interval at that point is equal to or lower than a threshold value (step S1103). When the time interval is not equal to or shorter than the threshold value, the controller 8 stores the time interval in an internal memory as data for section detection (step S1104). On the other hand, when the time interval is equal to or shorter than the threshold value, considering that a home position is detected, the controller 8 starts predetermined control, for example, feedback control or starts detection of fluctuation in a rotational speed of the second support roller (step S1105).

Figure 12:
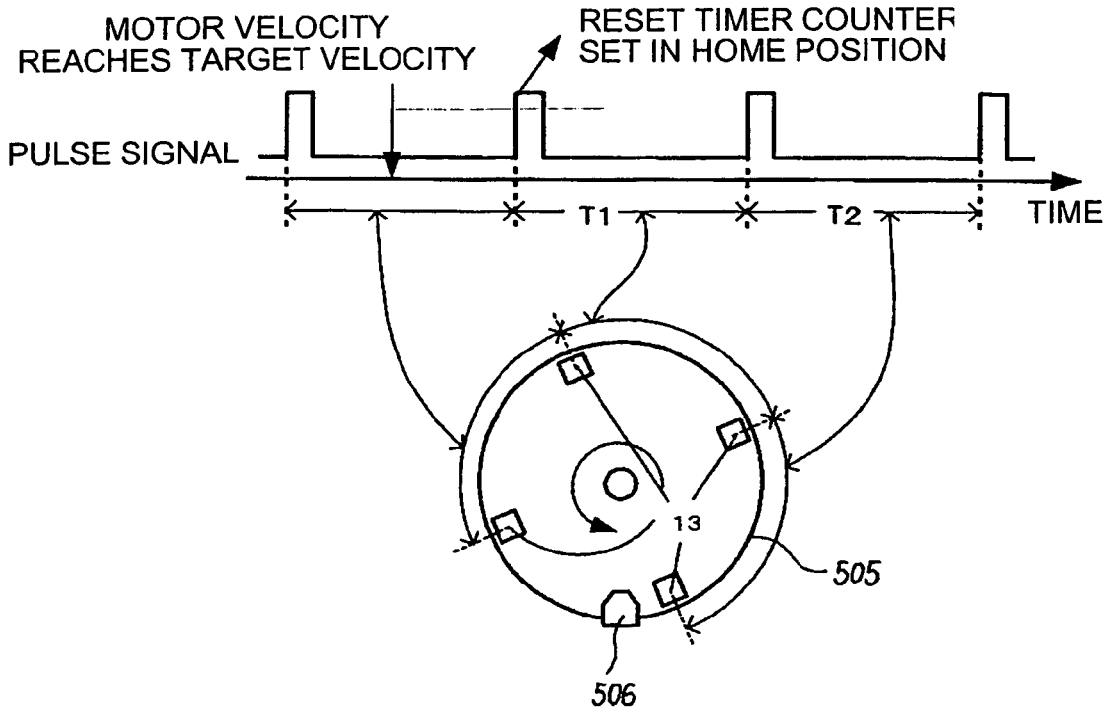
FIG. 12 is a schematic for explaining a method of setting a home position when a slit for home position detection is not provided.

As shown in FIG. 12, a method of setting and detecting a home position at the time when the second detection unit 504 does not specifically include a slit for home position detection is explained. In this case, first, the controller 8 detects a predetermined setting condition at the time of detection of fluctuation in a rotational speed of the second support roller 14 (e.g., the motor rotates at a uniform speed or the first support roller rotates uniform speed). The controller 8 sets the slit 13 detected at appropriate timing as a home position and monitors the slit 13. Specifically, when the motor or the like rotates at a uniform speed, simultaneously with detection of a pulse signal received at the appropriate timing, the controller 8 resets a timer counter. The controller 8 stores the number of the slits 13 that are provided in the encoder board 505 of the second detecting unit 504 in advance. When the number of pulse signals reaches the number of the slits 13, considering that a home position is detected, the controller 8 resets the timer counter. In this case, it is necessary to determine a home position every time when a power supply is turned on and calculate at least a phase of fluctuation in a rotational speed of the second support roller. In this case, the controller 8 always recognizes, using a circuit or firmware, where the home position 600 is set.

In belt drive control in this embodiment, first, as a pre-operation, fluctuation in a rotational speed of the second support roller 14, which is detected by the second detecting unit 504, is recognized using the detecting units set in the first support roller 17 and the second support roller 14. When it is possible to set the home position 600 in a specific place of the encoder board 505 as shown in FIG. 10, it is possible to perform the pre-operation in a manufacturing process before shipping products. When a home position is not provided, it is necessary to set an arbitrary home position at the time when a power supply of the apparatus body is turned on to perform the pre-operation. For example, when a slip or the like occurs in a binding section of the detector 506 and the roller because of aging or an environment, the pre-operation is executed according to a state of use by a user (timing when there is no print request) every time, every number of sheets, or the like defined in advance to detect and update fluctuation in a rotational speed of the second support roller 14. When it is desired to eliminate an influence of eccentricity of another driven roller, since a phase relation such as a slip between the driven roller and the belt changes, fluctuation in a rotational speed of the second support roller 14 is periodically detected and updated.

Methods of detecting fluctuation in a rotational speed of the second support roller are explained below as first to third examples. A method of detecting fluctuation in a rotational speed of the second support roller in the first example is a method of detecting a fluctuation component of the second support roller 14 by rotating a motor at a constant angular speed. A method of detecting fluctuation in a rotational speed of the second support roller in the second example is a method of detecting a fluctuation component of the second support roller 14 by rotating the first support roller 17 at a uniform speed. A method of detecting fluctuation in a rotational speed of the second support roller in the third example is a method of detecting a fluctuation component of the second support roller 14 by rotating the second support roller 14 at a uniform speed.

In the first example, a fluctuation component due to eccentricity of the second support roller 14 is detected by rotating the motor 7 at a fixed angular speed. A suitable combination of detecting units used in the first example is that shown in FIG. 6B. However, those shown in FIGS. 6A and 6C may be used.

In the combination of the detecting units shown in FIG. 6B suitably used in the first example, the first detecting unit 404 attached to the first support roller 17 includes the encoder board 405 that includes the one slit 403 and the detector 406. The second detecting unit 504 attached to the second support roller 14 includes the encoder board 505 that includes the four slits 13, and the detector 506. A roller diameter of the first support roller 17 is set to ¼ of a roller diameter of the second support roller 14. A moving distance between the slits is a moving distance of one rotation of the first support roller 17.

Since the second detecting unit 504 has the four slits 13, it is possible to set a detection section to $\pi$ at which detection sensitivity for fluctuation in a rotational speed is high. In addition, it is possible to set a phase difference between detection sections to $(\pi/2)$.

To improve detection accuracy, rotation phases of the encoder board 405 of the first detecting unit and the encoder board 505 of the second detecting unit are adjusted in a manufacturing process or the like in advance such that timing of the slit 403 passing the detector 406 of the first detecting unit 404 and timing of the slits 13 passing the detector 506 of the second detecting unit 504 are the same.

In the first example, rotation information of the second support roller 14 is detected by measuring time from detection of the slits 13 in the detector 506 until detection of a specific slit.

Figure 13:
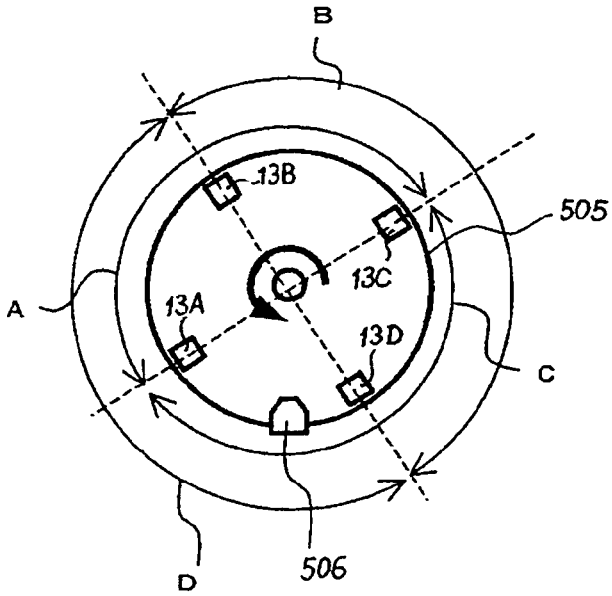
FIG. 13 is a schematic for explaining detection of rotation information by the second detecting unit.

FIG. 13 is a schematic for explaining detection of rotation information of the second detecting unit 504 shown in FIG. 6B. Reference signs A, B, C, and D in the figure denote detection sections. The detection sections are set to be integer times as long as a rotation period of the first support roller 17. Consequently, it is possible to neglect most of an influence of fluctuation in a rotational speed of the first support roller in the detection sections. To detect fluctuation in a rotational speed of the second support roller 14, it is necessary to measure time of at least two sections in one period of the second support roller 14. A combination of sections may be any combination as long as detection sections are set to be integer times as long as the rotation period of the first support roller 17. For example, the section B, that is, time required by the detector until the detector detects the slit 13D after detecting the slit 13B, and the section D, that is, time required by the detector until the detector detects the slit 13B after detecting the slit 13D may be detected. The section A and the section C may be detected or the section A and the section B may be detected. It is unnecessary to set the detection sections to 180°. However, if the detection sections are set to 180°, it is possible to set detection sensitivity for fluctuation in a rotational speed of the second support roller highest. In addition, it is possible to set the detection sensitivity for fluctuation in a rotational speed of the second support roller highest in combinations of the section A and the section B, the section B and the section C, the section C and the section D, and the section D and the section A, in which phases of detection sections are shifted from one another by 90°. In the following explanation, the section A and the section B are detected.

Figure 14:
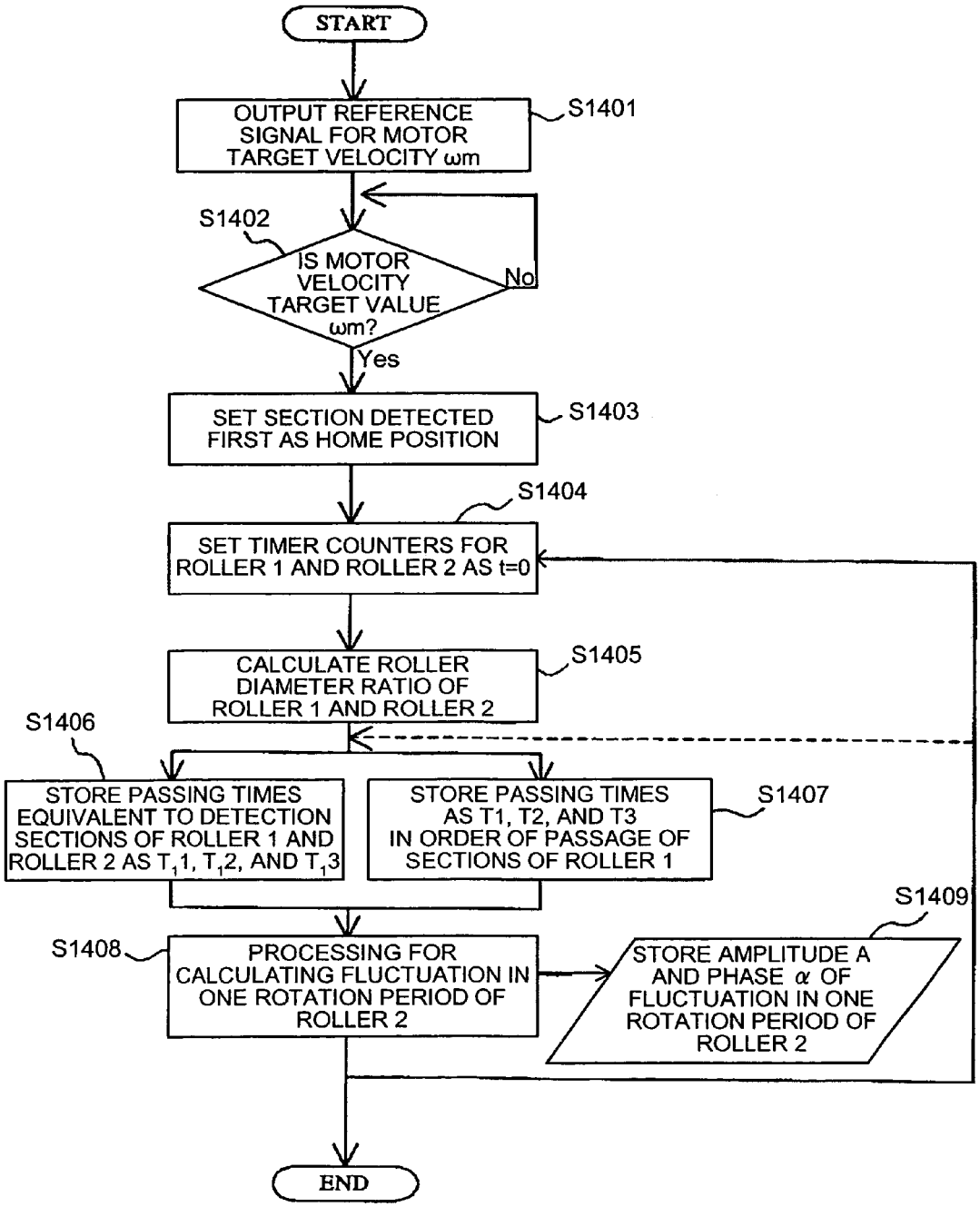
FIG. 14 is a flowchart of fluctuation detection of a second support roller in the first example.

FIG. 14 is a flowchart of fluctuation detection of the second support roller and attachment eccentricity of the second detecting unit in the first example. In FIG. 14, the controller 8 outputs an instruction signal for motor target angular speed ωm appropriate for rotating a DC servomotor stably (step S1401) and drives to rotate the DC servomotor. The controller 8 judges, from a rotary encoder set in the DC servomotor, whether the DC servomotor has reached target rotational speed (step S1402). This is for the purpose of rotating the motor stably at predefined speed to improve detection accuracy.

When it is judged that the DC servomotor has reached the target rotational speed ("YES" at S1402), the controller 8 sets one of slits of the second support roller as a home position at appropriate timing (step S1403). In this case, the controller 8 also sets a counter of a built-in timer unit for the second support roller in the controller 8 to zero and measures time. The controller 8 sets a built-in timer unit for the first support roller in the controller 8 to zero in a slit of the first support roller detected at substantially the same timing to measure time (step S1404). The detector 506 of the second support roller outputs a pulse signal when the slits 13 pass the detector 504 and transmits the pulse signal to the controller 8. The controller 8 records time that is measured by the counter of the built-in timer unit at the time when the pulse signal is received in a data memory. The controller 8 holds a total number of slits of the encoder board 505 of the second detecting unit as data in advance and, when a total number of pulse signals outputted reaches the total number of slits stored in advance, detects one rotation of the second support roller. Then, the controller 8 measures time required for one rotation and calculates an average angular speed ω2a of one rotation of the second support roller. Similarly, the detector 406 set in the first support roller outputs a pulse signal when the slit 403 passes the detector 406 and transmits the pulse signal to the controller 8. The controller 8 stores time that is measured by the counter of the built-in timer unit at the time when the pulse signal is received in a data memory. The controller 8 calculates an average angular speed ω1a of the first support roller from the stored time required for one rotation. The controller 8 calculates a present diameter ratio of the rollers from average angular velocities of the first support roller and the second support roller (step S1405). It is possible to correct a detection error of fluctuation in a rotational speed due to a roller diameter that changes because of a manufacturing error, and an environment, or aging, by accurately calculating the roller diameter ratio. Accuracy of detection may be improved by calculating a roller diameter ratio from data that is averaged by rotating the first support roller and the second support roller a plurality of times.

Figure 15:
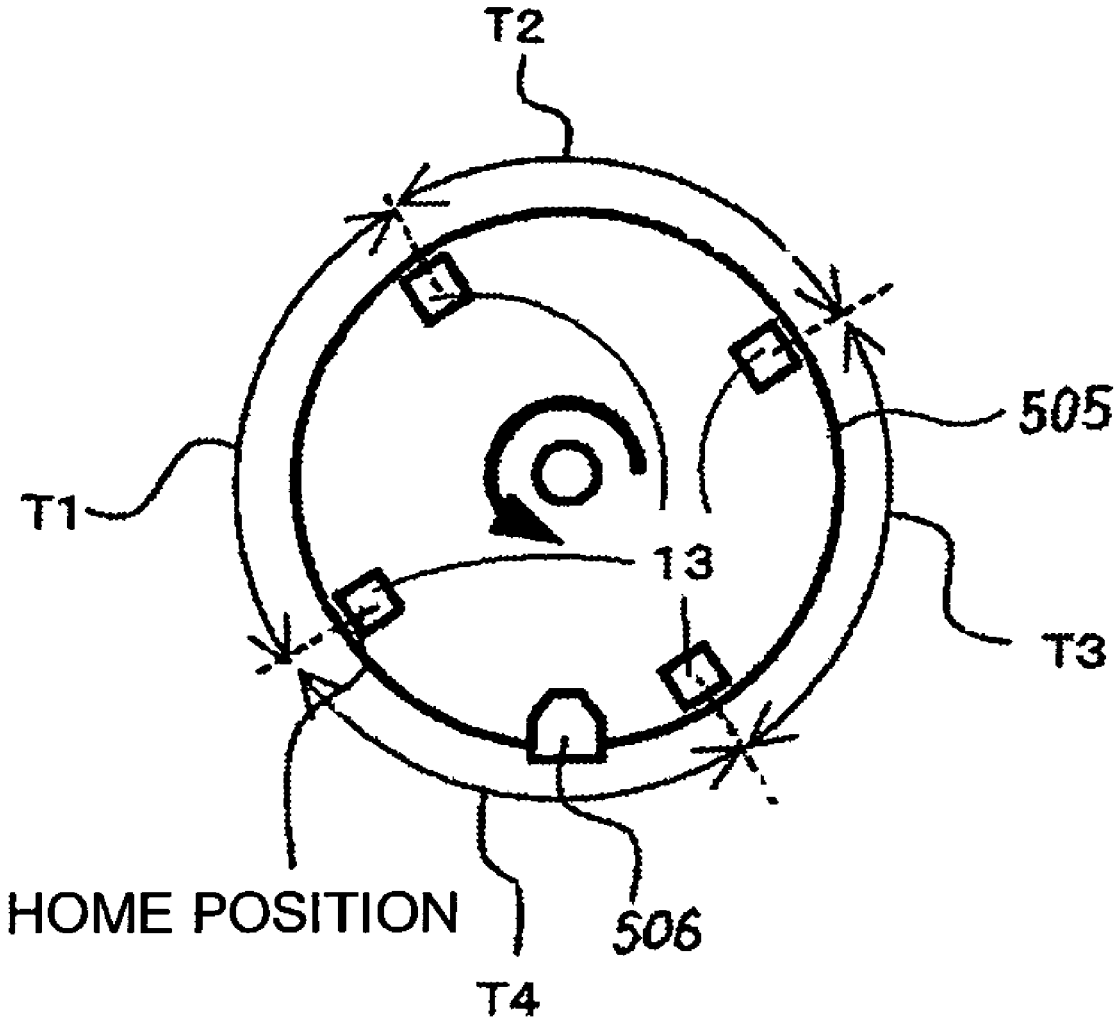
FIG. 15 is a schematic for explaining passing times T1, T2, and T3.

After calculating the roller diameter ratio, as shown in FIG. 15, in the second support roller, the controller 8 stores passing time interval T1, T2, and T3 in a data memory incorporated in the controller 8 in an order of passage of sections to be detected after detecting a home position again (step S1406). In the first support roller, the controller 8 stores passing time intervals of slits that pass at substantially the same time, that is, time of one rotation in the data memory incorporated in the controller 8 as $T_1$1, $T_1$2, and $T_1$3 (step S1407). Then, the controller 8 executes calculation processing for fluctuation in a rotational speed of the second roller using the data of passing time $T_1$1, $T_1$2, $T_1$3, T1, T2, and T3 (step S1408).

In the calculation processing for fluctuation in a rotational speed of the second support roller (S1408), the controller 8 calculates an amplitude and a phase of fluctuation in a rotational speed equivalent to one rotation of the second support roller. Specifically, the controller 8 calculates the amplitude of fluctuation in a rotational speed of one rotation of the second support roller as A and calculates an initial phase based on a home position as α.

A method of calculating an amplitude and a phase of fluctuation in a rotational speed of the second support roller is explained below. An amplitude and a phase of fluctuation in a rotational speed of the second support roller are calculated from rotation time in a first section (the detection section A in FIG. 13) constituted by two slits and rotation time in a second section (the detection section B in FIG. 13) that has a phase different from a phase of the first section constituted by different two slits with a home position (time 0) as a reference. Average angular velocities $\omega_{02_1}$ and $\omega_{02_2}$ in time during which the second support roller rotates the first section and the second section are calculated from rotation information of the first support roller.

Rotation angular speed $\omega_2$ of the second support roller including fluctuation in a rotational speed due to eccentricity of the second support roller is defined as follows.

$$\omega_2=\omega_{02}+A\sin(\omega_{02}t+\alpha) \tag{12}$$

$\omega_{02}$ in equation 12 is an average rotation angular speed of the second support roller that rotates following conveyance of the belt. The average rotation angular speed is equal to a belt moving speed converted into a rotation angular speed of the roller. A fluctuation component in a rotational speed due to eccentricity of the second support roller, which has the amplitude A and the phase α, and attachment eccentricity of the detecting unit is superimposed on the average rotation angle speed.

In the first section, since the second support roller performs half rotation (180-degree rotation), the following relation is established.

$$\pi=\int_0^{T1+T2}\omega_2 dt=\int_0^{T1+T2}[\omega_{02_1}+A\sin(\omega_{02_1}t+\alpha)]dt \tag{13}$$

Note that $\omega_{02_1}$ is the average rotation angular speed of the second support roller in the first section and calculated from the following equation according to detection data of the first support roller.

$$\omega_{02_1}=\frac{R_1}{R_2}\frac{2\pi N}{(T_11+T_12)} \tag{14}$$

As a diameter ratio of the first support roller and the second support roller (R1/R2), a value calculated at step S5 in FIG. 14 is used. N is the number of revolutions of the first support roller at the time of measurement of the first detection section. Since a roller diameter ratio is set to 1:4, the first detection section is a rotation angle π. Thus, N=2. In the second detection section, the following equation is established in the same manner as equation 13 with a different form of an integration range.

$$\pi=\int_{T1}^{T1+T2+T3}\omega_2 dt=\int_{T1}^{T1+T2+T3}[\omega_{02_2}+A\sin(\omega_{02_2}t+\alpha)]dt \tag{15}$$

Note that $\omega_{02_2}$ is an average rotation angular speed of the second support roller in the second section and calculated from the following equation according to detection data of the first support roller.

$$\omega_{02_2} = \frac{R_1}{R_2}\frac{2\pi N}{(T_12 + T_13)} \tag{16}$$

Even if the DC servomotor is driven at a constant rotational speed of a target rotation angular speed, a belt moving speed fluctuates because of a transmission error of the transmission drive system such as a slip. Therefore, in the method of estimating the average rotation angular speed $\omega_{02_2}$ of the second support roller from rotation angular speed of the DC servomotor, since the transmission error of the transmission drive system is not taken into account, it is impossible to estimate an accurate average rotation angular speed $\omega_{02_2}$ of the second support roller. Thus, in the first example, the average rotation angular speed $\omega_{02_2}$ of the second support roller is calculated from measurement time of the first support roller. Since the first support roller is a driven roller, like the second support roller, the first support roller rotates according to a moving speed of the belt. Therefore, it can be said that rotation time of the first support roller is rotation time of a belt moving speed including a component of the transmission error of the transmission drive system.

In the first support roller, fluctuation in a rotational speed due to eccentricity of the first support roller and attachment eccentricity of the first detecting unit occurs. However, the detection section is substantially integer times as long as a rotation period of the first support roller. Therefore, the average rotation angular speed $\omega_{02_2}$ of the second support roller in the detection section of the second support roller is calculated from measurement time at the time when the first support roller rotates just an integer number of times. Thus, it is possible to neglect a fluctuation component of angular speed due to eccentricity of the first support roller. This is because a fluctuation component due to eccentricity of the first support roller can be represented by a trigonometric function of a sine wave, a cosine wave, and the like. Since a half period fluctuates positively and the other half period fluctuates negatively. Thus, the fluctuation component is offset by one period of the first support roller. As a result, measurement time of the first support roller, which is used for calculating the average rotation angle speed $\omega_{02_2}$ of the second support roller, is hardly affected by eccentricity of the first support roller. The measurement time is rotation time of a belt moving speed including a component of the transmission error of the transmission drive system.

In this way, it is possible to calculate the average rotation angle speed $\omega_{02_2}$ of the second support roller in a detection section that takes into account fluctuation in a belt moving speed due to the transmission drive system or the like at the time when rotation angles are measured in the first detection section and the second detection section.

To improve correction accuracy, as described above, it is advisable to adjust rotation phases of the two rollers in advance such that timing of slits provided in the first detecting unit 404 and the second detecting unit 504 passing the detector is substantially the same time.

The amplitude A and the phase $\alpha$ of a fluctuation component in a rotational speed of the second support roller are calculated by solving an equation shown below that is derived by modifying equation 13 and equation 15.

$$\begin{bmatrix} \sin\left(\frac{\omega_{02_1}(T1+T2)}{2}\right) & \cos\left(\frac{\omega_{02_1}(T1+T2)}{2}\right) \\ \sin\left(\frac{\omega_{02_2}(T3+T2+2T1)}{2}\right) & \cos\left(\frac{\omega_{02_2}(T3+T2+2T1)}{2}\right) \end{bmatrix} \begin{bmatrix} A\cos(\alpha) \\ A\sin(\alpha) \end{bmatrix} = \begin{bmatrix} \omega_{02_1}(\pi - \omega_{02_1}(T1+T2))/2\sin\left(\frac{\omega_{02_1}(T1+T2)}{2}\right) \\ \omega_{02_2}(\pi - \omega_{02_2}(T3+T2))/2\sin\left(\frac{\omega_{02_2}(T3+T2)}{2}\right) \end{bmatrix} \tag{17}$$

equation 17 may be solved by calculating an inverse matrix of a matrix in the left part or may be solved by other numerical calculation methods. Consequently, the amplitude A of fluctuation in a rotational speed of the second support roller and the phase $\alpha$ with the home position as references are calculated. In an actual image forming apparatus, only equation 17 is stored in a memory of the controller 8. The controller 8 calculates the amplitude A and the phase $\alpha$ by substituting the measurement times (T1, T2, and T3) and the average angular velocities $\omega_{02_2}$ and $\omega_{02_1}$ in equation 17.

After ending the arithmetic processing for the amplitude A and the phase $\alpha$, the controller 8 stores numerical values in the data memory (step S1409) and sets target rotation angular speed $\omega_{2ref}$ of the second support roller. To improve detection accuracy, the controller 8 may calculate average values of a plurality of amplitudes A and a plurality of phases $\alpha$ by repeating the operations at steps S1404 to S1409 indicated by a solid line or the operations at steps S1406 to S1409 indicated by a dotted line.

The controller 8 generates the angular speed (the target angular speed) $\omega_{2ref}$ of the second support roller at the time when the belt moves at a constant speed from the amplitude A and the phase $\alpha$ calculated by the equation of equation 17. The controller 8 performs feedback control.

$\omega_2$ shown in equation 12 is represented by an average rotation angular speed $\omega_{02}$ (belt moving speed) of the second support roller, which rotates following conveyance of the belt, and fluctuation in a rotational speed due to eccentricity of the second support roller. Therefore, from equation 12, it is possible to represent the angular speed (the target angular speed) $\omega_{2ref}$ of the second support roller at the time when the belt moving speed is constant as follows.

$$\omega_{2ref} = \omega_{02} + A\sin(\omega_{02}t + \alpha) \tag{18}$$

Thus, it is possible to control a belt speed to be constant by performing feedback control such that a rotation angular speed of the second support roller becomes the target rotation angular speed $\omega_{2ref}$ shown in equation 18. Note that, when a target average speed of the roller is changed according to an image output mode, a value of $\omega_{02}$ is changed appropriately.

In this way, according to the method in the first example, it is possible to detect fluctuation in a rotational speed due to eccentricity of the second support roller and attachment eccentricity of the second detecting unit. It is also possible to set the target angular speed $\omega_{2ref}$ of the second support roller from the fluctuation in a rotational speed of the second support roller detected in advance and perform feedback control based on the rotation angular speed information. This makes it possible to perform stable drive control to drive the belt at a desired speed without being affected by eccentricity of the second support roller and the attachment eccentricity of the second detecting unit.

A second example of the present invention is explained below. In the second example, a fluctuation component due to eccentricity of the second support roller is detected by controlling the first support roller to rotate at a uniform speed from a detection result of the first detecting unit. A suitable combination of detecting units used in the second example is the combination shown in FIG. 6A. The first detecting unit 404, which detects rotation information of the first support roller, is a common rotary encoder. The second detecting unit 504, which detects rotation information of the second support roller includes the encoder board 505 that includes the four slits 13 with phases shifted from one another by ($\pi/2$) and the detector 506. A roller diameter of the first support roller is set to ¼ of a roller diameter of the second support roller. A moving distance between the slits is just a moving distance of one rotation of the first support roller.

In the case of the second example, the first support roller is controlled to rotate at a uniform speed using a detection result of the first detecting unit. It is possible to eliminate an influence of fluctuation in a belt speed of the transmission drive system or the like by controlling the first support roller to rotate at a uniform speed in this way. However, when the first support roller is controlled to rotate at a uniform speed, a moving speed of the belt fluctuates periodically because of an influence of fluctuation in a rotational speed due to eccentricity of the first support roller and attachment eccentricity of the first detecting unit. The fluctuation in the belt moving speed affects rotation of the second support roller serving as a driven roller. Thus, a rotational speed detected by the second detecting unit has fluctuation in which fluctuation in a rotational speed of the first support roller and fluctuation in a rotational speed due to eccentricity of the second support roller and attachment eccentricity of the second detecting unit are superimposed. However, since a moving distance between the slits of the second detecting unit is just one period of the first support roller, fluctuation in a rotational speed of the first support roller between the slits is offset. Thus, it is possible to neglect an influence of the fluctuation in a rotational speed. Therefore, in the second example, it is possible to accurately detect fluctuation in a rotational speed of the second support roller due to eccentricity of the second support roller and the attachment eccentricity of the second detecting unit without detecting other fluctuation components by detecting passing time of the detector between the slits. It is possible to shift a phase of a section for measuring time during which the second support roller rotates by $\pi$ radian by ($\pi/2$) radian from the four slits with phases shifted from one another by ($\pi/2$) of the second detecting unit. This makes it possible to detect fluctuation in a rotational speed of the second support roller in two sections at a period of the second support roller and establish simultaneous equations for calculating the amplitude A and the phase $\alpha$ of the fluctuation in a rotational speed of the second support roller. As a result, it is possible to calculate the amplitude A and the phase a of fluctuation in a rotational speed due to eccentricity of the second support roller and detect fluctuation in a rotational speed due to eccentricity of the second support roller and the attachment eccentricity of the second detecting unit.

Figure 16:
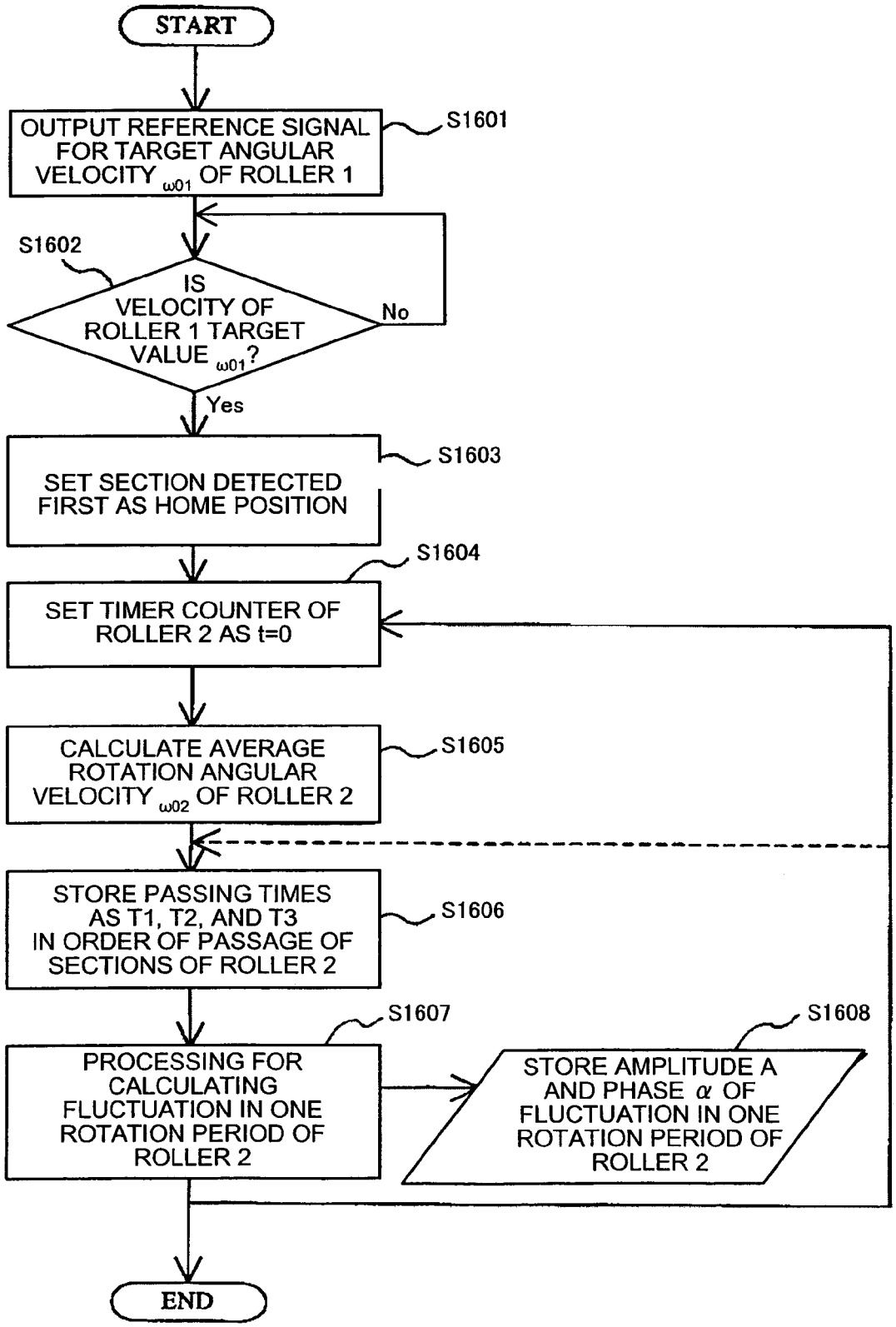
FIG. 16 is a flowchart of fluctuation detection of a second support roller in the second example.

FIG. 16 is a flowchart of fluctuation detection of the second support roller in the second example. As shown in FIG. 16, first, the controller 8 outputs an instruction signal for driving a DC motor at a target rotation angular speed $\omega_{01}$ of the first support roller (step S1601) and drives to rotate the belt. In an example explained here, the DC motor is used. However, a DC servomotor or a stepping motor may be used. The controller 8 checks whether the first support roller has reached the target rotation angular speed $\omega_{01}$ of the first support roller from an output of a rotary encoder set in the first support roller (step S1602). When the first support roller has reached S1602, the controller 8 sets one of the slits 13 of the second detecting unit 14 as a home position at appropriate timing (step S1603). In this case, the controller 8 sets a counter of a built-in timer unit in the controller 8 to zero (step S1604) and measures time. The detector 506 of the second detecting unit outputs a pulse signal when the slits 13 of the encoder board 505 pass the detector 506 and transmits the pulse signal to the controller 8. The controller 8 stores the time that is measured by the counter of the built-in timer unit at the time when the pulse signal is received in the data memory. The controller 8 holds a total number of slits of the encoder board 405 of the second detecting unit as data in advance. When a total number of pulse signals outputted reaches the total number of slits, the controller 8 detects one rotation of the second support roller. Then, the controller 8 measures time required for one rotation from the time stored in the memory and calculates average rotational speed $\omega_{02}$ of one rotation of the second support roller (step S1605). In this way, it is possible to reduce a calculation error of fluctuation in a rotational speed of the second support roller due to a steady error that occurs at the time of control for making a rotation angular speed of the first support roller constant by calculating the average rotational speed $\omega_{02}$ of one rotation of the second support roller.

When the home position is detected again, every time the detector passes the slits as in the first example, the controller 8 stores passing time intervals as T1, T2, and T3 in the data memory of the controller 8 (step S1606). Then, the controller 8 executes calculation processing for fluctuation in a rotational speed for calculating an amplitude and a phase of fluctuation in a rotational speed of the second support roller using the data T1, T2, and T3 of passing time (step S1607).

As in the first example, rotation angular speed $\omega_2$ of the second support roller including the fluctuation in a rotational speed of the second support roller shown in equation 12 is defined with an amplitude of fluctuation in a rotational speed equivalent to one rotation of the second support roller set as A, an initial phase with a home position as a reference set as $\alpha$, and average rotational speed $\omega_{02}$ set as $\omega$). As in the first example, with a home position (time 0) as a reference, an integration formula is established from passing time (T1+T2) of a first section (the detection section A in FIG. 15) constituted by two sections among the slits and passing time (T2+T3) of a second section (the detection section B in FIG. 15) that has a phase different from a phase of the first section by ($\pi/2$) radian constituted by two sections among the slits to derive an equation shown below. It is possible to calculate the amplitude A and the phase $\alpha$ of a fluctuation component in a rotational speed of the second support roller by solving the equation.

$$\begin{bmatrix} \sin\left(\frac{\omega_{02}(T1+T2)}{2}\right) & \cos\left(\frac{\omega_{02}(T1+T2)}{2}\right) \\ \sin\left(\frac{\omega_{02}(T3+T2+2T1)}{2}\right) & \cos\left(\frac{\omega_{02}(T3+T2+2T1)}{2}\right) \end{bmatrix} \begin{bmatrix} A\cos(\alpha) \\ A\sin(\alpha) \end{bmatrix} = \omega_{02} \begin{bmatrix} (\pi-\omega_{02}(T1+T2))/2\sin\left(\frac{\omega_{02}(T1+T2)}{2}\right) \\ (\pi-\omega_{02}(T3+T2))/2\sin\left(\frac{\omega_{02}(T3+T2)}{2}\right) \end{bmatrix} \quad (19)$$

Equation 19 may be solved by calculating an inverse matrix of a matrix in the left part or may be solved by other numerical calculation methods. Consequently, the amplitude A of fluctuation in a rotational speed of the second support roller and the phase α with the home position as references are calculated. As in the first example, detection accuracy is improved by repeating the operations at steps S1604 to S1608 or steps S1606 to S1608.

The controller 8 generates the angular speed (the target angular speed) $\omega_{2ref}$ of the second support roller at the time when the belt moves at a constant speed from the amplitude A and the phase a calculated by the equation of equation 19. The controller 8 performs feedback control.

The amplitude A and the phase α calculated by the method in the second example are calculated after eliminating influences of a fluctuation component due to eccentricity of the first support roller and a fluctuation component of the transmission drive system. It can be said that the amplitude A and the phase a are an amplitude and a phase of a fluctuation component of eccentricity of the second support roller and attachment eccentricity of the second detecting unit. It is possible to calculate the target rotation angular speed $\omega_{2ref}$ shown in equation 18 from the amplitude A and the phase α. It is possible to set the belt speed V to a constant moving speed V0 if a rotation angular speed of the second support roller is subjected to feedback control to be the target rotation angular speed $\omega_{2ref}$ with the home position as a reference.

A third example of the present invention is described below. In the third example, the second detecting unit detects a fluctuation component due to eccentricity of the second support roller and attachment eccentricity of the second detecting unit by controlling the second support roller to rotate at a uniform speed. A combination of detecting units used in the third example is the combination shown in FIG. 6C. The second detecting unit is a publicly-known encoder. The first detecting unit includes an encoder board that includes one slit and a detector. A roller diameter of the first support roller is set to ¼ of a roller diameter of the second support roller as described above. In the third example, the second support roller is controlled to rotate at a uniform speed from a detection result of the second detecting unit to eliminate an influence of a fluctuation component or the like of the drive transmission system. Only an influence of a detection error of the second support roller (fluctuation in a rotational speed of the second support roller) is detected in the first support roller.

It is possible to eliminate an influence of fluctuation in a belt speed due to eccentricity of a driving roller by controlling the second support roller to rotate at a uniform speed from a detection result of the second detecting unit in this way. However, when the second support roller is controlled to rotate at a uniform speed, a moving speed of the belt fluctuates periodically because of an influence of a fluctuation component of the second support roller due to eccentricity of the second support roller and attachment eccentricity of the second detecting unit. The fluctuation in the belt moving speed affects a rotational speed of the first support roller serving as the driven roller. Thus, a rotational speed detected by the first detecting unit has fluctuation in which fluctuation in a rotational speed of the first support roller and fluctuation in a rotational speed of the first support roller due to eccentricity of the first support roller and attachment eccentricity of the first detecting unit are superimposed. Only one slit 403 is provided in the encoder board 405 provided in the first support roller. The first detecting unit 404 detects one period of the first support roller. Therefore, fluctuation in a rotational speed of the first support roller is offset and can be neglected. This is because it is possible to represent fluctuation in a rotational speed due to eccentricity of the first support roller with a trigonometric function. A diameter of the second support roller is set at least twice or more (four times in FIG. 6C) as large as a diameter of the first support roller such that slits of the first support roller can be detected twice or more while the second support roller rotates once (one period). This makes it possible to detect fluctuation in a rotational speed of the second support roller in two places at a period of the second support roller and establish simultaneous equations for calculating the amplitude A and the phase α of fluctuation in a rotational speed of the second support roller. As a result, it is possible to calculate the amplitude A and the phase a of fluctuation in a rotational speed due to eccentricity of the second support roller and detect fluctuation in a rotational speed due to eccentricity of the second support roller and attachment eccentricity of the second detecting unit.

Figure 17:
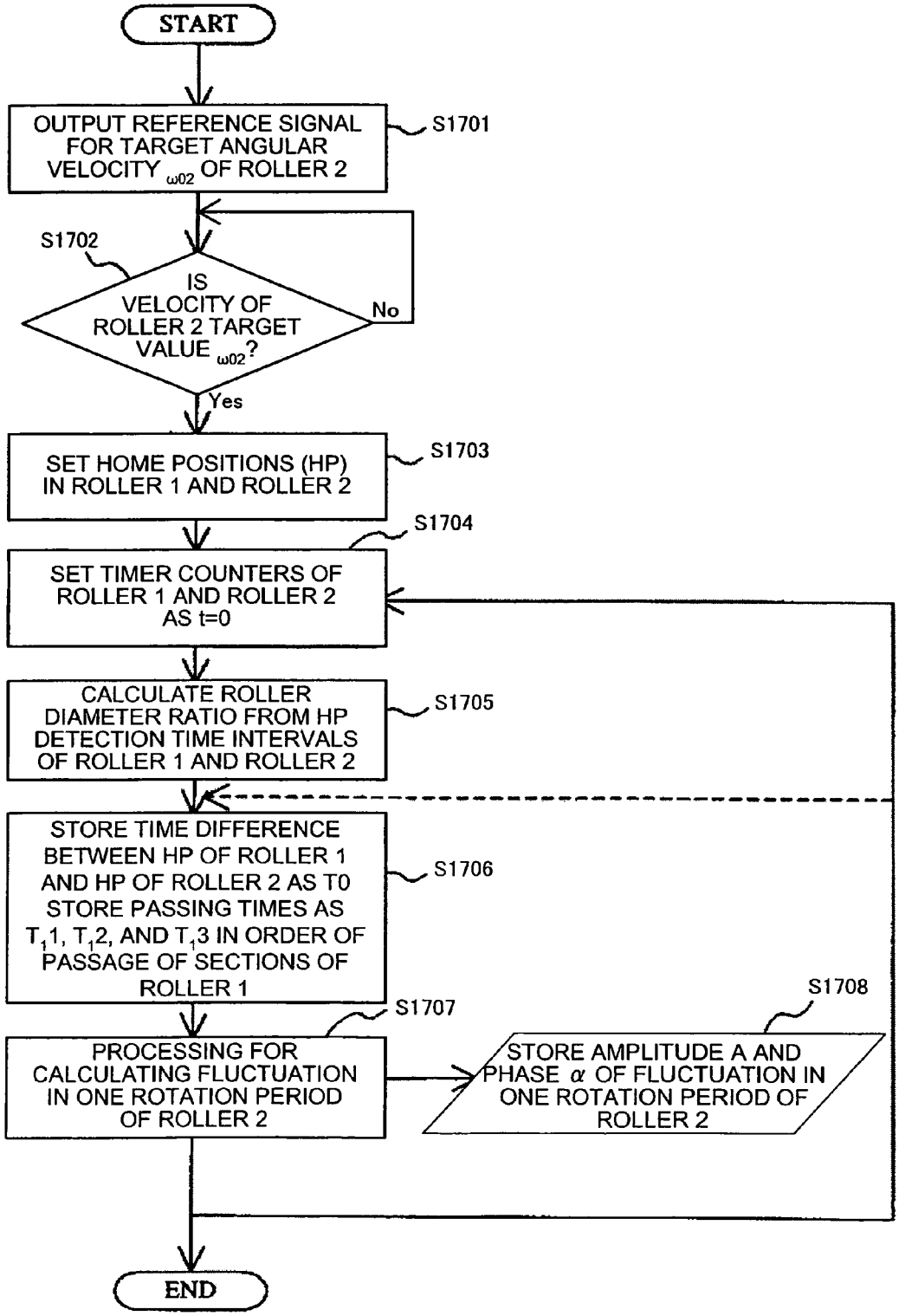
FIG. 17 is a flowchart of fluctuation detection of a second support roller in a third example.

FIG. 17 is a flowchart of fluctuation detection of the second support roller in the third example. First, the controller 8 outputs an instruction signal for driving a DC motor at target rotation angular speed $\omega_{02}$ of the second support roller (step S1701) and drives to rotate the belt. In an example explained here, the DC motor is used. However, a DC servomotor or a stepping motor may be used. The controller 8 judges whether the second support roller has reached the target rotation angular speed $\omega_{02}$ of the second support roller from an output of a rotary encoder set in the second support roller (step S1702). When it is judged that the second support roller has reached the target rotation angular speed $\omega_{02}$, the controller 8 detects one slit of the first support roller at appropriate timing and sets the slit as a home position of the first support roller (a roller 1). At this point, the controller 8 sets a slit detected by the detector of the second support roller (a roller 2) as a home position of the second support roller (step S1703). As the detection of a home position of the second support roller, the controller 8 stores a total number of slits provided in the encoder board of the second detecting unit in advance. The controller 8 starts count of slits from the home position of the second support roller, and, when a count number reaches the total number of slits stored, judges that the detector detects the home position of the second support roller. Detection of a home position of the first support roller is performed as described below. The controller 8 calculates a total number of slits, which is detected by the detector of the first support roller while the second support roller rotates once, from a diameter ratio of the first support roller and the second support roller and the number of slits of the first support roller in advance. The controller 8 starts count of slits from the home position of the first support roller and, when a count number reaches the total number of slits calculated above, judges that a detector 406 of the first detecting unit 404 has detected the home position of the first support roller. For example, when the diameter ratio of the first support roller and the second support roller is 1:4 and the number of slits of the first detecting unit is 1, the controller 8 detects a position, at the time when the first support roller rotates four times and an identical slit is detected for the fourth time, as the home position of the first support roller.

When the home position is set as described above, the controller 8 sets the counter of the built-in timer unit in the controller 8 to zero (step S1704) and measures time. The detector 406 of the first detecting unit 404 outputs a pulse signal when the slit 403 passes the detector 404 and transmits the pulse signal to the controller 8. The detector 506 of the second detecting unit outputs a pulse signal when the slit 13 passes the detector 14 and transmits the pulse signal to the controller 8. The controller 8 stores time that is measured by the counter of the built-in timer unit at the time when the pulse signal of the first detecting unit is received in the data memory. When the controller 8 receives the pulse signal of the second detecting unit, the controller 8 also records time measured by the counter of the built-in timer unit in the data memory. Subsequently, the controller 8 measures a time interval in which the home position of the first support roller equivalent to one rotation of the second support roller is detected (a time interval equivalent to four rotations of the first support roller) and a time interval in which the home position of the second support roller is detected. The controller 8 calculates a diameter ratio of the first support roller (the roller 1) and the second support roller (the roller 2) (step S1705). The controller 8 rotates the first support roller four times and calculates a diameter ratio of the first support roller and the second support roller based on a time interval equivalent to one rotation of the second support roller. A reason for this is as described below. Fluctuation in a rotational speed due to eccentricity of the second support roller is superimposed on rotational speed of the first support roller as described above. Therefore, at the time interval of the first support roller, since an influence of a fluctuation component of the second support roller appears, it is impossible to calculate an accurate diameter ratio of the first support roller and the second support roller. Thus, it is possible to offset fluctuation in a rotational speed of the second support roller and neglect most of the influence by calculating a diameter ratio of the first support roller and the second support roller at a time interval equivalent to the period of the second support roller. The diameter ratio of the first support roller and the second support roller is calculated from an average rotation angular speed $\omega_{01}$ of the first support roller and an average rotation angular speed $\omega_{02}$ of the second support roller as in the first example. It is possible to correct a derivation error of periodic fluctuation due to eccentricity of the second support roller caused by a roller diameter that changes because of a manufacturing error, an environment, or aging by calculating a roller diameter ratio accurately. An average rotation angular speed of the second support roller is calculated as $\omega_{2c}$ from a time interval of detection of the home position of the second support roller and stored in the data memory.

By storing the average rotation angular speed $\omega_{02}$ of one rotation of the second support roller in the memory, it is possible to reduce a calculation error of fluctuation in a rotational speed of the second support roller due to a steady error at the time of control for making rotation angular speed of the second support roller constant.

The controller 8 detects a home position on the second support roller side and a home position on the first support roller side again and calculates a time interval difference at that point, that is, a time difference $T_0$ of the home positions of the first support roller and the second support roller. Subsequently, every time the detector passes the slit from the home position of the first support roller, the controller 8 stores passing time intervals as $T_1$1, $T_1$2, and $T_1$3 in the data memory incorporated in the controller 8 (step S1706). The controller 8 executes calculation processing for fluctuation in a rotational speed for calculating an amplitude and a phase of fluctuation in a rotational speed of the second support roller using the data $T_1$1, $T_1$2, and $T_1$3 of passing time (step S1707).

When an amplitude of fluctuation in a rotational speed equivalent to one rotation of the second support roller is set as A, an initial phase with a home position as a reference is set as $\alpha$, and average rotational speed is set as $\omega_{2c}$, a rotation angular speed $\omega_2'$ of the second support roller including periodic fluctuation due to eccentricity of the second support roller is defined as described below.

$$\omega_2' = \omega_{2c} + A\sin(\omega_{2c}t + \alpha + P) \tag{20}$$

P is the time data $T_0$ detected in step S1706 converted into a rotation phase of the second support roller. Consequently, it is possible to set the home position of the second support roller as a reference of fluctuation in a rotational speed of the second support roller.

With the home position (time 0) on the first support roller side as a reference, from the time interval measured, an integration formula is established with passing time ($T_1$1+$T_1$2) equivalent to the detection section A in FIG. 13 as a first section and passing time ($T_1$2+$T_1$3) equivalent to the detection section B in FIG. 13 as a second section to derive a matrix shown below.

Equation $$\begin{bmatrix} \sin\left(\frac{\omega_{2c}(T_1 1 + T_1 2)}{2}\right) & \cos\left(\frac{\omega_{2c}(T_1 1 + T_1 2)}{2}\right) \\ \sin\left(\frac{\omega_{2c}(T_1 3 + T_1 2 + 2T_1 1)}{2}\right) & \cos\left(\frac{\omega_{2c}(T_1 3 + T_1 2 + 2T_1 1)}{2}\right) \end{bmatrix} \begin{bmatrix} A\cos(\alpha) \\ A\sin(\alpha) \end{bmatrix} = \omega_{2c} \begin{bmatrix} (\pi - \omega_{2c}(T_1 1 + T_1 2))/2\sin\left(\frac{\omega_{2c}(T_1 1 + T_1 2)}{2}\right) \\ (\pi - \omega_{2c}(T_1 3 + T_1 2))/2\sin\left(\frac{\omega_{2c}(T_1 3 + T_1 2)}{2}\right) \end{bmatrix} \tag{21}$$

equation 21 may be solved by calculating an inverse matrix of a matrix in the left part or may be solved by other numerical calculation methods. Consequently, the amplitude A of fluctuation in a rotational speed of the second support roller and the phase $\alpha$ with the home position as references are calculated.

In the equation, a diameter ratio of the first support roller and the second support roller is 1:4. $T_1$1+$T_1$2 and $T_1$2+$T_1$3, which are rotation times equivalent to two rotations of the first support roller, are equivalent to passing time of a detection section angle $\pi$ of the second support roller. When two rotations of the first support roller are not equivalent to the rotation angle $\pi$ of the second support roller because of an error of roller diameters, the controller 8 corrects the detection section angle $\pi$ in the second support roller equivalent to two rotations of the first support roller based on the roller diameter ratio obtained at step S1705 in FIG. 17. Then, a value of $\pi$ shown in equation 21 is changed to a value corrected based on the roller diameter ratio. This makes it possible to detect fluctuation in a rotational speed due to eccentricity of the second support roller more highly accurately. It is also possible to derive the same equation as equation 21 even when the roller diameter ratio is not 1:4.

Accuracy of detection is improved by repeating the operations at steps S1704 to S1708 or steps S1706 to S1708 as in the first example.

The controller 8 generates angular speed (target angular speed) $\omega_{2ref}$ of the second support roller, at the time when the belt moves at a constant speed, from the amplitude A and the phase $\alpha$ calculated by the matrix in equation 21 and performs feedback control.

As described above, the amplitude A and the phase $\alpha$ calculated by the method in the third example are also calculated after eliminating influences of a fluctuation component due to eccentricity of the first support roller and a fluctuation component of the transmission drive system. It can be said that the rotation angular speed $\omega_2'$ shown in equation 20 is an amplitude and a phase of fluctuation in a rotational speed due to eccentricity of the second support roller and attachment eccentricity of the second detecting unit. Thus, it is possible to represent the angular speed (target angular speed) $\omega_{2ref}$ of the second support roller as follows from equation 20 when a belt moving speed is constant.

$$\omega_{ref2}=\omega_{2c}-A\sin(\omega_{2c}t+\alpha+P) \tag{22}$$

As shown in equation 22, a fluctuation component in a rotational speed of the second support roller is different from those in the first and the second examples. A sign of the fluctuation component is minus. This is because, in the third example, the second support roller is rotated at a uniform speed to detect fluctuation in a rotational speed of the second support roller with the first support roller. When the second detecting unit detects a state in which the second support roller is rotating at a uniform speed, the belt is moved according to periodic fluctuation having a sign opposite to that of the fluctuation component in a rotational speed of the second support roller. The first support roller rotates following movement of the belt. As a result, a fluctuation component of the second support roller detected by the first support roller via the belt actually has a sign opposite to that of a fluctuation component detected by the second detecting unit. Thus, in equation 22, the sign is opposite to those in the first and the second examples.

It is possible to control the belt speed V to be the constant moving speed $V_0$ by subjecting rotation angular speed of the second support roller to feedback control to be the target rotation angular speed $\omega_{2ref}$ shown in equation 21. Note that, when a target average speed of the roller is changed according to an image output mode, a value of $\omega_{02}$ is changed appropriately.

Figure 18:
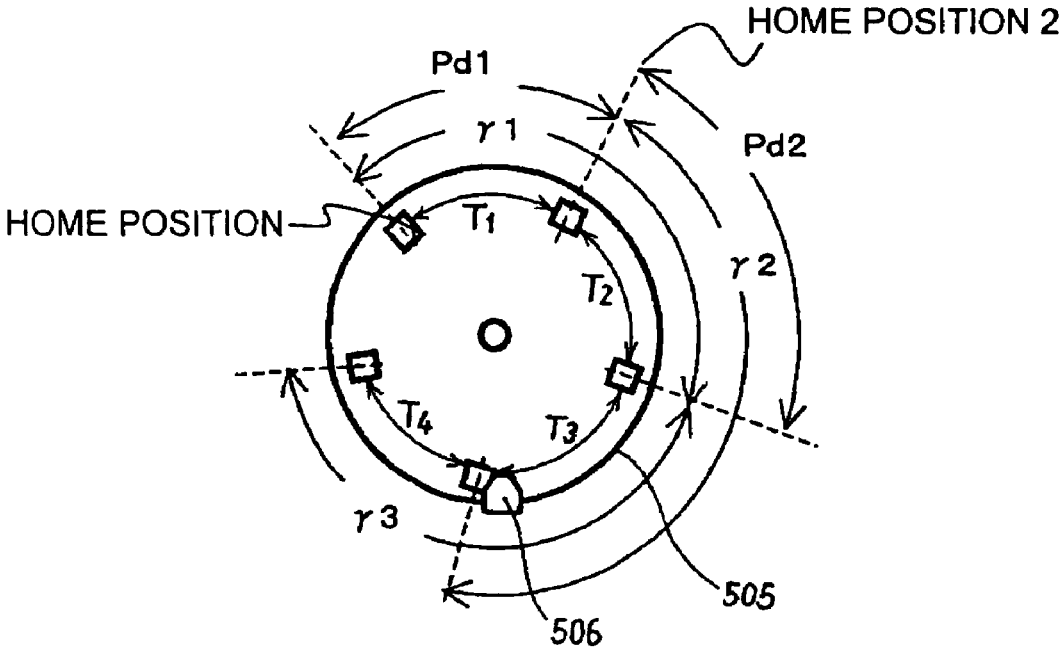
FIG. 18 is a schematic of a second detecting unit in which a detection section is not 180°.

In the first to the third examples, a detection section of the second support roller is set to 180°. However, the detection section is not limited to this. For example, the detection section may be set to arbitrary angles γ1 and γ2 as shown in FIG. 18. In this case, an equation for calculating an amplitude and a phase of the second support roller is as described below.

$$\begin{bmatrix} \sin\left(\frac{\omega_{02_1}(T1+T2)}{2}\right) & \cos\left(\frac{\omega_{02_1}(T1+T2)}{2}\right) \\ \sin\left(\frac{\omega_{02_2}(T3+T2+2T1)}{2}\right) & \cos\left(\frac{\omega_{02_2}(T3+T2+2T1)}{2}\right) \end{bmatrix} \tag{23}$$

$$\begin{bmatrix} A\cos(\alpha) \\ A\sin(\alpha) \end{bmatrix} = \begin{bmatrix} \omega_{02_1}(\gamma 1-\omega_{02_1}(T1+T2))/2\sin\left(\frac{\omega_{02_1}(T1+T2)}{2}\right) \\ \omega_{02_2}(\gamma 2-\omega_{02_2}(T3+T2))/2\sin\left(\frac{\omega_{02_2}(T3+T2)}{2}\right) \end{bmatrix}$$

It is possible to calculate an amplitude and a phase due to eccentricity of the second support roller even if the detection section is an arbitrary angle except 180° by solving the equation in equation 23. In this case, it is also possible to improve detection accuracy by setting the detection section to be integer times as long as a period of the first support roller. It is possible to further improve detection accuracy by setting the detection section to be integer times as long as periodic fluctuation of the drive transmission system or the like. In other words, if it is possible to set the detection section to a least common multiple of a rotation period of the first support roller and the periodic fluctuation of the drive transmission system or the like, it is possible to neglect most of influences of both the fluctuation in a rotational speed of the first support roller and the periodic fluctuation of the drive transmission system or the like.

In the above explanation, a distance between the slits of the second detecting unit is one period of the first support roller. However, even if the distance between the slits of the second detecting unit is not one period of the first support roller, it is possible to detect fluctuation in a rotational speed of the second support roller without being affected by a fluctuation component of the first support roller if a detection section is one period of the first support roller. For example, as shown in FIG. 18, the detection periods γ1 and γ2 are set as one period of the first support roller. However, it is possible to detect fluctuation in a rotational speed of the second support roller accurately even if distances Pd1 and Pd2 between the slits are half a period of the first support roller. As described above, when the detection section γ1 is set as a first detection section and the detection section γ2 is set as a second detection section, a detection section is set as a period of the first support roller, (T1+T2), which is an index indicating a periodic fluctuation in the first detection section γ1, is an index indicating only fluctuation in a rotational speed due to eccentricity of the second support roller. (T2+T3), which is an index indicating periodic fluctuation in the second detection section γ2, is also an index indicating only fluctuation in a rotational speed due to eccentricity of the second support roller. However, in an index T1, which indicates periodic fluctuation in phase of the first detection section γ1 and the second detection section γ2, the detection section is not one period of the first support roller. Thus, the index T1 is an index in which periodic fluctuation due to eccentricity of the second support roller and periodic fluctuation of the first support roller are superimposed. Thus, it is not impossible that the index T1 indicating a phase is only a fluctuation component in a rotational speed of the second support roller.

In this case, a detection section γ3 shown in FIG. 18 is used as a third detection section. Like the detection sections γ1 and γ2, the detection section γ3 is one period of the first support roller. The detection section γ3 starts from an end position of the detection section γ1. First, a time interval (T1+T2) of the first detection section γ1, a time interval (T2+T3) of the second detection section γ2, and a time interval T of phases of the first detection section γ1 and the second detection section γ2 are substituted in equation 24 to calculate an amplitude and a phase of fluctuation in a rotational speed of the second support roller. Subsequently, the time interval (T2+T3) of the second detection section γ2, a time interval (T3+T4) of the third detection section γ3, and a time interval T2 of phases of the second detection section γ2 and the third detection section γ3 are substituted in an equation shown below to calculate an amplitude and a phase of fluctuation in a rotational speed of the second support roller.

$$\begin{bmatrix} \sin\left(\frac{\omega_{02_1}(T2+T3)}{2}\right) & \cos\left(\frac{\omega_{02_1}(T2+T3)}{2}\right) \\ \sin\left(\frac{\omega_{02_2}(T4+T3+2T2)}{2}\right) & \cos\left(\frac{\omega_{02_2}(T4+T3+2T2)}{2}\right) \end{bmatrix} \tag{24}$$

$$\begin{bmatrix} A\cos(\alpha) \\ A\sin(\alpha) \end{bmatrix} = \begin{bmatrix} \omega_{02_1}(\gamma 2-\omega_{02_1}(T2+T3))/2\sin\left(\frac{\omega_{02_1}(T2+T3)}{2}\right) \\ \omega_{02_2}(\gamma 3-\omega_{02_2}(T4+T3))/2\sin\left(\frac{\omega_{02_2}(T4+T3)}{2}\right) \end{bmatrix}$$

An amplitude and a phase calculated from the first detection section γ1 and the second detection section γ2 are affected by periodic fluctuation of 0 to π of the first support roller. On the other hand, an amplitude and a phase calculated from the second detection section γ2 and the third detection section γ3 are affected by periodic fluctuation of π to 2π of the first support roller. Thus, when both the amplitudes and the both the phases are averaged, it is possible to eliminate an influence of a fluctuation component in a period of the first support roller. However, initial phases of fluctuation in a rotational speed of the second support roller, which is calculated from the first detection section γ1 and the second detection section γ2, and fluctuation in a rotational speed of the second support roller, which is calculated from the second detection section γ2 and the third detection section γ3, are different. Thus, it is necessary to adjust the fluctuations in a rotational speed.

When the second support roller in FIG. 7 uses the second detecting unit including a slit for home position and two slits for detection, it is possible to calculate an amplitude and a phase of fluctuation in a rotational speed of the second support roller by solving the following equation.

$$\begin{bmatrix} \sin\left(\frac{\omega_{02_1}(T1)}{2}\right) & \cos\left(\frac{\omega_{02_1}(T1)}{2}\right) \\ \sin\left(\frac{\omega_{02_2}(T2+T1)}{2}\right) & \cos\left(\frac{\omega_{02_2}(T2+T1)}{2}\right) \end{bmatrix} \begin{bmatrix} A\cos(\alpha) \\ A\sin(\alpha) \end{bmatrix} = \begin{bmatrix} \omega_{02_1}\left(\frac{\pi}{2} - \omega_{02_1}(T1)\right) / 2\sin\left(\frac{\omega_{02_1}(T1)}{2}\right) \\ \omega_{02_2}\left(\frac{\pi}{2} - \omega_{02_2}(T2-T1)\right) / 2\sin\left(\frac{\omega_{02_2}(T2-T1)}{2}\right) \end{bmatrix} \tag{25}$$

In the above explanation, periodic fluctuation due to eccentricity of the second support roller and attachment eccentricity of the second detecting unit is detected by providing the two detection sections (A and B) in the second support roller and measuring a time interval in the two detection sections. However, a method of detection of periodic fluctuation is not limited to this. For example, a plurality of (n) slits for detection are provided, a plurality of ways of detection sections for establishing simultaneous equations are set, and amplitudes and phases of fluctuation in a rotational speed of the second support roller are calculated for the respective detection sections. It is possible to improve detection accuracy of fluctuation in a rotational speed of the second support roller by averaging the amplitudes and the phases. For example, if it is possible to set three detection sections, it is possible to set three ways of combinations of detection sections. In the respective combinations, it is possible to calculate and average three ways of phases and amplitudes. If it is possible to set four detection sections, it is possible to set six ways of combinations of detection sections. It is possible to calculate and average six ways of phases and amplitudes.

Fluctuation in a rotational speed of the second support roller may change because of a change of an environment or aging. When fluctuation in a rotational speed of the second support roller changes due to a change of an environment or aging in this way, the fluctuation in a rotational speed is different from fluctuation in a rotational speed of the second support roller detected. Then, even if feedback control is performed using the detected fluctuation in a rotational speed of the second support roller, since an influence of fluctuation of the second support roller appears on a moving speed, it is impossible to convey the belt at a constant speed. Thus, the first support roller may be adapted to detect whether there is fluctuation in a rotational speed of the second support roller. When fluctuation in a rotational speed of the second support roller is the same as a state at the time of detection, since the belt is moving at a constant speed, fluctuation never occurs in an average angular speed of the first support roller. On the other hand, when fluctuation in a rotational speed of the second support roller changes as time passes and becomes different from fluctuation in a rotational speed of the second support roller calculated in an initial period, even if the second support roller is rotating at the target rotational speed ω2ref, the belt is not being conveyed at a constant speed. Then, a change occurs in average rotational speed of the first support roller serving as the driven roller. Thus, aged deterioration of fluctuation in a rotational speed of the second support roller is detected by detecting a change in a rotational speed of the first support roller. Specifically, a timer interval of one period of the first support roller is detected and, when the time interval is shifted by a fixed degree or more, it is considered that fluctuation in a rotational speed of the second support roller changes. Fluctuation in a rotational speed of the second support roller is calculated again.

If the method of calculating fluctuation in a rotational speed of the second support roller in the third example is used, it is also possible to change fluctuation in a rotational speed of the second support roller during feedback control. This makes it possible to sequentially calculate fluctuation in a rotational speed of the second support roller. In this case, first, when the second support roller is rotating at the target rotation angular speed $\omega_{2ref}$, the processing from steps 1706 to S1707 in FIG. 17 is executed to calculate fluctuation in a rotational speed (an amplitude and a phase) of the second support roller. When a fluctuation component of the second support roller at a target rotation angular speed calculated anew is $\Delta\omega_{ref2'}$, it is possible to represent the fluctuation component as follows.

$$\Delta\omega_{ref2}' = -A'\sin(\omega_{2c}'t + \alpha' + P') \tag{26}$$

In equation 26, since there is no fluctuation component when the belt is conveyed at a constant speed, a value of the fluctuation component $\Delta\omega_{ref2'}$ is "0". However, when an error occurs because of a factor such as a change due to an environment or aging or a slip between the roller and the belt at the time of detection, $\Delta\omega_{ref2'}$ is detected as a correction error.

Thus, a new reference rotation angular speed $\Delta\omega_{ref2''}$ of the second support roller, which is calculated using $\Delta\omega_{ref2'}$ detected, is as represented below.

$$\omega_{ref2}'' = \omega_{ref2} + \Delta\omega_{ref2}' + \omega_{2c} - A\sin(\omega_{2c}t + \alpha + P) - A'\sin(\omega_{2c}'t + \alpha' + P) \tag{27}$$

Feedback control is executed using the new reference rotation angular speed $\Delta\omega_{ref2''}$ of the second support roller. It is possible to combine an operation for updating the target rotation angular speed with the method in the first and the second examples. First, target rotation angular speed is calculated by the method in the first and the second examples to execute feedback drive control and, then, the target rotation angular speed is updated using the method of calculating fluctuation in a rotational speed of the second support roller in the third example.

Figure 19:
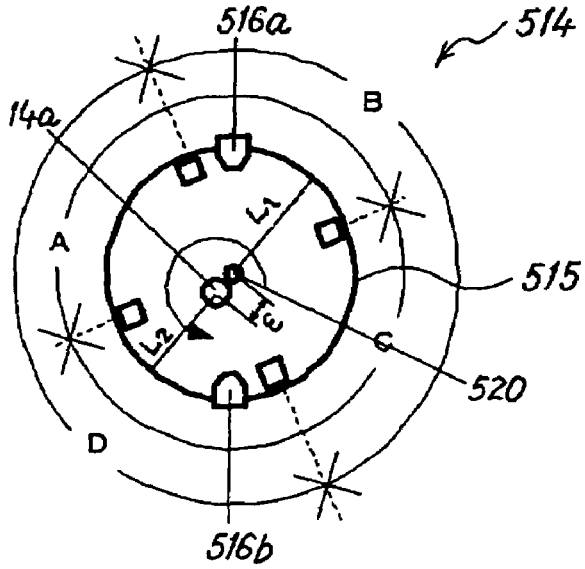
FIG. 19 is a schematic of a second detecting unit in which two detectors are provided.

In the method of detecting fluctuation in a rotational speed of the second support roller explained in the first to the third examples, it is possible to detect periodic fluctuation due to eccentricity of the second support roller and attachment eccentricity of the second detecting unit attached to the second support roller. However, when the attachment eccentricity of the second detecting unit is extremely large compared with the eccentricity of the second support roller, it is difficult to detect fluctuation in a rotational speed of the second support roller accurately. Thus, as shown in FIG. 19, two sensors may be provided to eliminate attachment eccentricity of the second detecting unit in advance. A second detecting unit 514 shown in FIG. 19 includes a first detector 516*a* and a second detector 516*b* that are 180° apart from each other across the axis of the second support roller. Reference numeral 520 in the figure is the center of an encoder board 515. The encoder board 515 is attached eccentrically with respect to a center 14*a* of the second support roller. Therefore, a distance from the core of the second support roller to an outer periphery of the encoder board is different depending on a circumferential direction. It is possible to represent a maximum distance $L_1$ from the core of the second support roller to the outer periphery of the encoder board by adding a radius of the encoder board and a distance (an amount of eccentricity $\epsilon$) between the center of the encoder board and the center of the second support roller. On the other hand, it is possible to represent a minimum distance $L_2$ from the core of the second support roller to the outer periphery of the encoder by subtracting the amount of eccentricity $\epsilon$ from the radius of the encoder board. Four slits are provided in the encoder board 515. The respective slits are provided 90° apart from one another. In the detection section A and the detection section B shown in FIG. 19, the part of the maximum distance $L_1$ from the core of the second support roller to the outer periphery of the encoder board is detected. On the other hand, in the detection section C and the detection section D, the part of the minimum distance $L_2$ from the core of the second support roller to the outer periphery of the encoder board is detected.

Therefore, detection time in the detection section A and the detection section B is shorter than detection time in the detection section C and the detection section D. Since the detection section A and the detection section B have the part of the maximum distance L1 from the core of the second support roller to the outer periphery of the encoder board, detection speed is high. On the other hand, since the detection section C and the detection section D have the part of the minimum distance L2 from the core of the second support roller to the outer periphery of the encoder board, detection speed is low.

Attachment eccentricity of the detecting unit is eliminated as described below. First, when one detector 516*a* detects, for example, the detection section B, the other detector 516*b* detects the detection section D phase-shifted by 180°. It is possible to eliminate attachment eccentricity of the detecting unit by averaging time detected by the first detector 516*a* and the second detector 516*b*.

Specifically, as shown in FIG. 19, the first detector 516*a* detects the detection section A and the detection section B and the second detector 516*b* detects the detection section C and the detection section D. When a time interval detected in the detection section A is set as T1*a*+T2*a*, a time interval detected in the detection section B is set as T2*a*+T3*a*, a time interval detected in the detection section C is set as T1*b*+T2*b*, and a time interval detected in the detection section D is set as T2*b*+T3*b*, it is possible to represent corrected passing times T1+T2, T2+T3, and T2 as follows.

$$T1+T2=(T1a+T2a+T1b+T2b)/2$$

$$T2+T3=(T2a+T3a+T2b+T3b)/2$$

$$T2=(T2a+T2b)/2 \tag{28}$$

The corrected passing times T1, T2, and T3 are substituted in the equation (e.g., equation 16) for calculating a phase and an amplitude explained above. In this way, it is possible to eliminate periodic fluctuation due to attachment eccentricity of the second detecting unit and detect fluctuation in a rotational speed of the second support roller highly accurately.

It is also possible to calculate fluctuation in a rotational speed of the second support roller, from which periodic fluctuation due to attachment eccentricity of the second detecting unit is eliminated, by calculating fluctuation in a rotational speed of the second support roller according to the passing times T1*a*, T2*a*, and T3*a* further calculated by the detector 516*a*, calculating fluctuation in a rotational speed of the second support roller according to the passing times T1*b*, T2*b*, and T3*b* calculated by the detector 516*b*, and combining the two fluctuations in a period calculated. In this case, it is assumed that fluctuation in a rotational speed is detected by the detector 516*a* and the detector 516*b*, respectively.

$$\text{First detector: } Aa\cdot\sin(\omega d\cdot t+\alpha a)$$

$$\text{Second detector: } Ab\cdot\sin(\omega d\cdot t+\alpha b) \tag{29}$$

In this case, fluctuations in a rotational speed of the second support roller, from which attachment eccentricity of the second detecting unit, are represented as follows.

$$\{Aa\cdot\sin(\omega d\cdot t+\alpha a)+Ab\cdot\sin(\omega d\cdot t+\alpha b)\}/2 \tag{30}$$

When feedback control is performed using the target rotation angular speed $\omega_{2ref}$ of the second support roller as a reference signal, a control error due to attachment eccentricity of the second detecting unit also occurs. It is possible to reduce an influence of the attachment eccentricity of the second detecting unit by comparing speed data, which are generated according to outputs of the two detectors 516*a* and 516*b* in FIG. 19, respectively, and controlling a motor according to a sum of differential data of the speed data. It is also possible that a rotation angular speed reference $\omega_{2ref}$ of the second support roller and an average value of speed data, which are generated according to outputs of the detectors 516*a* and 516*b*, respectively, are compared to control the motor. Alternatively, it is also possible that rotation angular speed references $\omega_{2ref\text{-}1}$ and $\omega_{2ref\text{-}2}$ are generated according to the two detectors 516*a* and 516*b*, respectively, the rotation angular speed references $\omega_{2ref\text{-}1}$ and $\omega_{2ref\text{-}2}$ are compared with the outputs of the two detectors 516*a* and 516*b*, respectively, and the motor is controlled according to a sum of differential data of the rotation angular speed references $\omega_{2ref\text{-}1}$ and $\omega_{2ref\text{-}2}$ and the outputs.

In the example shown in FIG. 19, the first detector 516*a* and the second detector 516*b* are provided in positions 180° apart from each other. However, it is also possible to eliminate attachment eccentricity of the detecting unit by providing a detector in an arbitrary position. The number of the slits of the encoder board is not limited to four. Even if there are two slits, it is also possible to eliminate attachment eccentricity of the detecting unit. However, it is necessary to provide the respective slits in positions shifted from one another by 180°. Detection sections are not necessarily 180°. It is possible to set the detection sections arbitrarily. However, it is necessary to shift middle points of the detection sections from one another by 180°. In addition, it is necessary to set angles of the detection sections to be the same. However, it is possible to have highest detection sensitivity by setting the detection sections to 180°.

Figure 26:
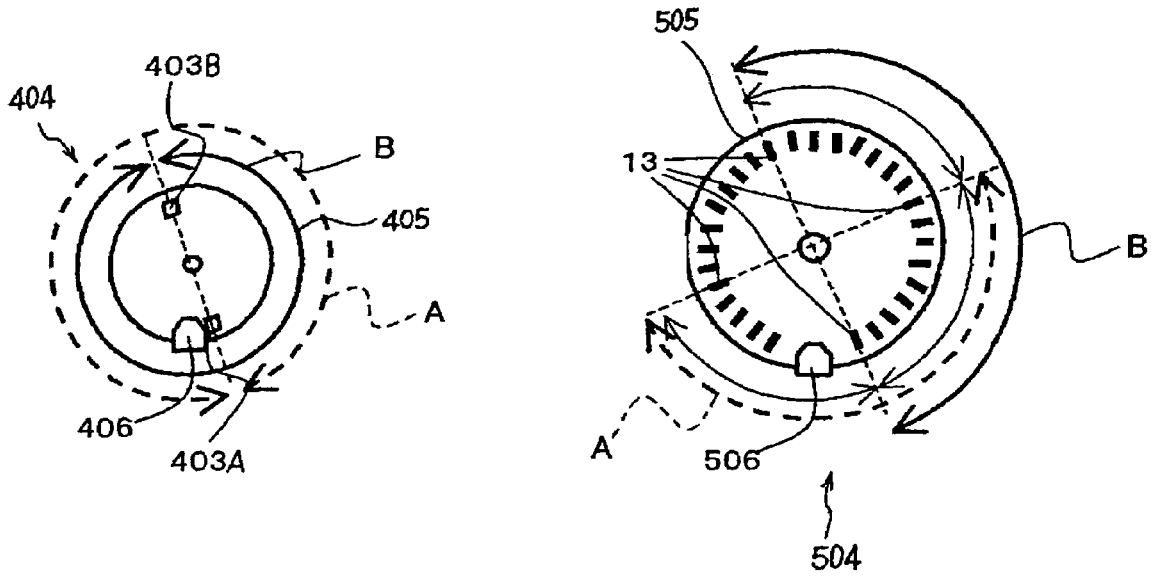
FIG. 26 is a schematic of another first detecting unit and another second detecting unit.

In this embodiment, a ratio of a diameter of the first support roller 17 and a diameter of the second support roller 14 is set to 1:4. However, the ratio maybe set to 1:2. In an example shown in FIG. 26, the ratio of a diameter of the first support roller 17 and a diameter of the second support roller 14 is set to 1:2. In this case, as shown in FIG. 26, slits 403A and 403B are provided at equal intervals in two places on the circumference of the encoder board 405 of the first detecting unit 404 provided in the first support roller 17. As in FIG. 6C, the slits 13 are provided at equal intervals over an entire periphery of the encoder board 505 of the second detecting unit 504 provided in the second support roller 14. With such a constitution, it is possible to suitably use the methods of detecting a rotational speed described in the first and the third examples. In particular, it is possible to suitably use the method of detecting a rotational speed described in the third example. Note that the encoder board 505 of the second detecting unit 504 provided in the second support roller 14 may be an encoder board in which the slits 13 are provided at equal intervals in four sections on a circumference thereof as shown in FIGS. 6A and 6B. It is possible to suitably use the encoder board 505 of the second detecting unit 504 that has a constitution in which the slits 13 are provided at equal intervals in four sections on a circumference thereof as shown in FIGS. 6A and 6B for the method of detecting a rotational speed described in the first example.

In the example shown in FIG. 26, rotation time in a first detection section (the detection section A in FIG. 26) of the second support roller 14 is time from the time when the detector 406 of the first detecting unit 404 detects the slit 304A of the encoder board until the time when the detector 406 detects the slit 403*a* again. Rotation time in a second detection section (the detection section B in FIG. 26) of the second support roller 14 is time from the time when the detector 406 of the first detecting unit 404 detects the slit 403B of the encoder board 405 until the time when the detector 406 detects the slit 403B again. This makes it possible to set both the first detection section and the second detection section to be integer times (one time) as long as those of the first support roller 17 and neglect most of fluctuation in a rotational speed due to eccentricity of the first support roller 17. As a result, it is possible to satisfactorily calculate fluctuation due to eccentricity of the second support roller 14 and attachment eccentricity of the second detecting unit 504.

It is possible to set detection sections to $\pi$ and set a phase difference between the detection sections to $(\pi/2)$ by, as shown in FIG. 26, providing the slits 403*a* and 403*b* at equal intervals in two sections on the circumference of the encoder board 405 of the first detecting unit 404.

In the above description, both the first support roller and the second support roller are driven rollers. However, one of the first support roller and the second support roller may be a driving roller to which a rotation drive force is transmitted from a motor. However, in this case, it is necessary to control occurrence of a slip between the driving roller and the belt. If a slip occurs between the driving roller and the belt, rotation information of the first support roller and rotation information of the second support roller do not link. As a result, it is impossible to accurately detect a fluctuation component of the second support roller.

Figure 20:
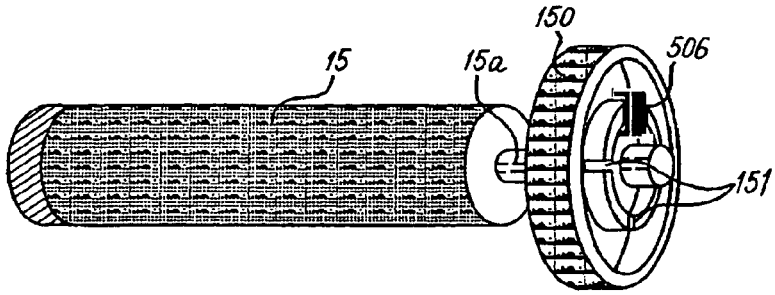
FIG. 20 is a schematic of a second detecting unit in which a second support roller is a driving roller.

When the second support roller is a driving roller, it is also possible that a cutout 151 is provided in a flange of the driven gear 150 shown in FIG. 20 and rotation information of the second support roller is detected by detecting the cutout 151 with the detector 506. When a driving source is a DC servomotor or a stepping motor, it is possible to estimate a rotation angular speed of the driving roller using an output signal of a rotation detector of a motor shaft provided in the DC servomotor or a drive instruction value given to the stepping motor. In other words, it is possible to calculate a rotation angular speed in detection sections from a driving signal of the motor or an output of the rotation detector of the motor shaft instead of using the detector set in the second support roller.

In an example in which the second support roller is a driving roller, the driving roller is connected to the DC servomotor (or the stepping motor) of the driving source via a drive transmission mechanism constituted by a gear or the like. Therefore, when a rotation angular speed of the DC servomotor (or the stepping motor) is controlled, a transmission error of the drive transmission mechanism occurs. However, it is possible to control a rotation angular speed of the driving roller (the second support roller) directly. Therefore, it is possible to calculate periodic fluctuation of the driving roller (the second support roller) by rotating the driving roller at a constant angular speed based on a detection signal of the second detecting unit (the method in the third example). When the first support roller is a driving roller, it is possible to use a method of rotating the first support roller at a constant angular speed and calculating fluctuation in a rotational speed of the second support roller based on a detection signal of the detecting unit provided in the second support roller (the method in the second example). It goes without saying that it is possible to calculate periodic fluctuation of the driving roller (the second support roller) even if the method in the first example is used.

Figure 27:
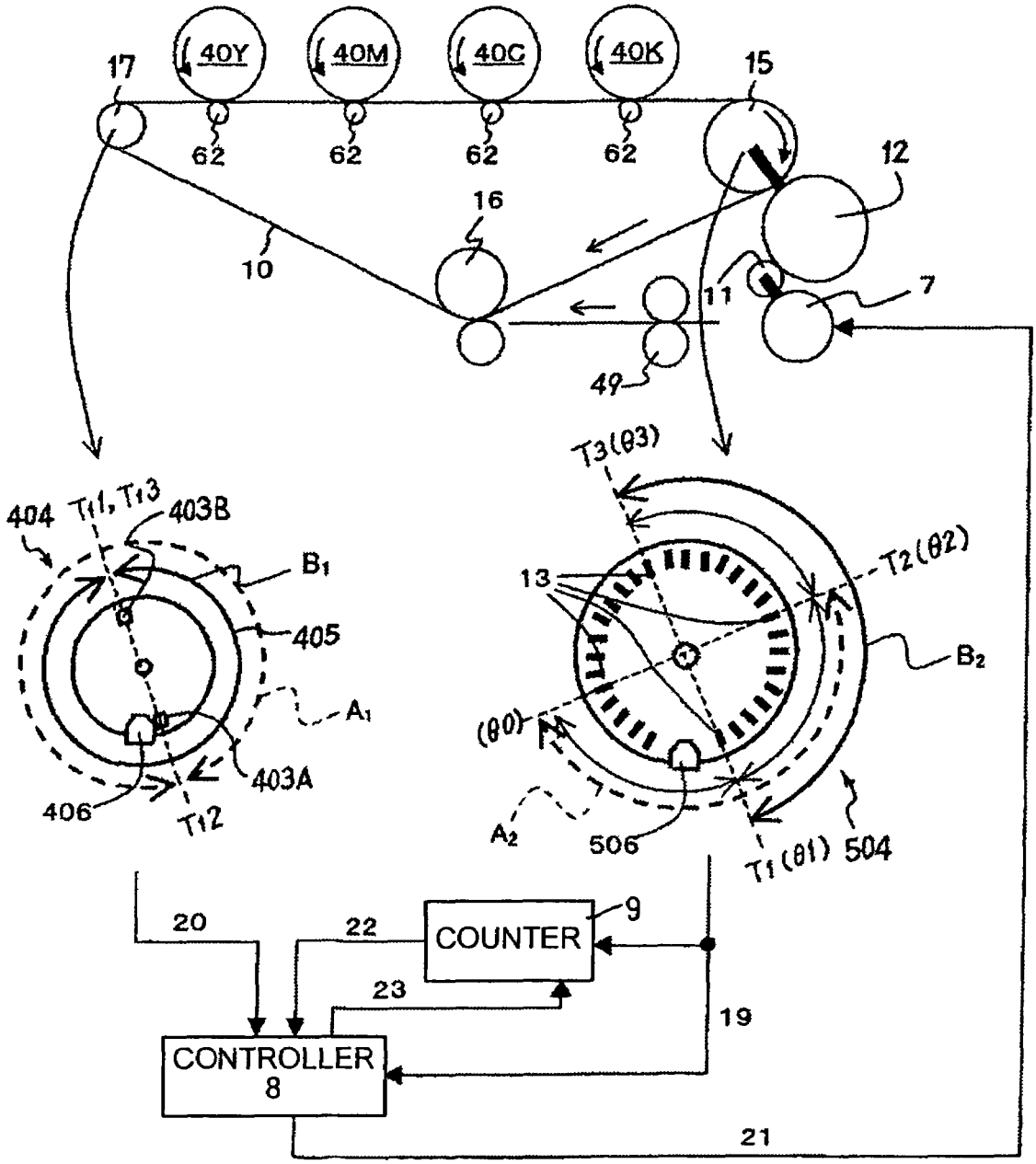
FIG. 27 is a schematic of an image forming apparatus in which a belt driving device is used to drive an intermediate transfer belt.

FIG. 27 is a schematic of an image forming apparatus in which a belt driving device using a DC servomotor is used for drive of an intermediate transfer belt. As shown in FIG. 27, the driving roller 15 includes a rotary encoder with high resolution that outputs 512 pulses in one turn serving as the second detecting unit 504. It is possible to detect fluctuation in rotation periods of the motor 7 and the gears 11 and 12 sufficiently by using the rotary encoder with high resolution. To detect fluctuation in speed due to eccentricity of the driving roller 15 and the rotary encoder 504, the detecting unit (the first detecting unit) 404 is attached to the first support roller 17. As in FIG. 26, the detecting unit 404 includes the encoder board 405 that includes the slits 403*a* and 403*b* in two sections at equal intervals on the circumference, and the detector 406. A ratio of a diameter of the encoder board 405 and a diameter of the rotary encoder 504 is 1:2.

In the belt driving device used in the intermediate transfer belt 10, a belt conveying area that is desired to be controlled most accurately is a primary transfer surface that transfers images formed on the photosensitive drums 40 onto the intermediate transfer belt 10. Therefore, it is preferable to set the driving roller 15 serving as the second support roller, in which the second rotation detecting unit 504 for controlling speed of the belt, at an end of the primary transfer surface. This is because, in the belt-drive control device shown in FIG. 27, since a driving signal of the motor is generated based on a difference between rotation information of the driving roller 15 serving as the second support roller and target rotation information, it is possible to control speed of the belt most accurately in the belt wound around the driving roller 15. Detection accuracy falls when the driving roller 15 serving as the second support roller is set in a portion different from the end of the primary transfer surface (e.g., the support roller 16 in FIG. 27). This phenomenon is described in detail later. It is preferable to set the first support roller 17 at the other end of the primary transfer surface. This is because, in obtaining rotation information for recognizing a fluctuation component due to eccentricity of the driving roller 15 serving as the second support roller and attachment eccentricity of the rotary encoder serving as the second detecting unit 504, detection accuracy is higher when a support roller wound with a belt is not provided between the first support roller 17 and the driving roller 15. This point is described later in detail.

As shown in FIG. 27, the belt driving device includes the controller 8 and a counter 9 to which a pulse signal of the rotary encoder 504 is inputted. Since a constitution of the controller 8 is the same as that of the controller 8 shown in FIG. 5, an explanation of the constitution of the controller 8 is omitted. The counter 9 is constituted by a synchronous 8-bit counter and is set to output one pulse to the controller 8 every time 128 pulses are inputted. A signal 22 of four pulses is transmitted from the counter 9 to the controller 8 when the second support roller rotates once. By providing such a counter 9, it is possible to output the same output pulse as the second detecting unit, which includes the encoder board 505 including the slits 13 provided at equal intervals in four places on the circumference shown in FIG. 6B. Four pulse signals are transmitted to the controller 8 by the counter 9 and the rotary encoder 504. This makes it easy to adjust detector passing timing of the slit of the first detecting unit 404 and detector passing timing of the slits 13 of the second detecting unit compared with the second detecting unit shown in FIG. 6B that is the encoder board 505 including the slits 13 provided at equal intervals in four places on the circumference. A synchronizing signal is sent from the controller 8 to the counter 9 at timing when the detector 406 of the first detecting unit 404 transmits a pulse signal. The counter 9, which has received the synchronizing signal, resets a present count value and starts count-up from zero again. This makes it possible to set detector passing timing of an arbitrary slit of the rotary encoder 504 the same as detector passing timing of the slit of the first detecting unit 404.

In the method of rotating the driving motor 7 in the first example, a fluctuation component in speed due to attachment eccentricity of a rotary encoder is detected by the rotary encoder 504 serving as the second detecting unit and a fluctuation component in speed due to eccentricity of the driving roller 15 is detected by the first detecting unit 404. As a result, the fluctuation component due to eccentricity of the driving roller 15 appears as time ($T_1$1+$T_1$2) in a first section (an $A_1$ section in the figure) and time ($T_1$2+$T_1$3) in a second section (a $B_1$ section in the figure) obtained from detection data of the first detecting unit 404. On the other hand, the fluctuation component in speed due to attachment eccentricity of the rotary encoder 504 appears as time (T1+T2) in a first section (an $A_2$ section in the figure) and time (T2+T3) in a second section (a $B_2$ section in the figure) obtained from detection data of the rotary encoder 504. Thus, it is possible to calculate an amplitude A and a phase $\alpha$ of the fluctuation component in speed due to eccentricity of the driving roller 15 and attachment eccentricity of the rotary encoder 504 from time intervals of the respective sections obtained from the detection data of the first detecting unit 404 and time intervals of the respective sections obtained from the detection data of the first detecting unit 404.

Since the belt driving device shown in FIG. 27 uses the rotary encoder 504 and the counter 9, it is possible to calculate the amplitude A and the phase $\alpha$ by performing the same processing as the first example except that synchronization processing for the counter 9 is performed. The synchronization processing is performed after a roller diameter ratio is calculated. First, the controller 8 outputs a synchronization pulse signal 23 to the counter 9 simultaneously with reception of the pulse signal 20 indicting detection of the slit outputted from the first detecting unit 404. When the counter 9 receives the synchronization pulse signal 23, the counter 9 resets a present pulse count value and starts count-up from the next pulse signal. The controller 8 outputs a synchronization pulse signal at timing when the slit 403B of the first support roller 17 is detected. Then, a count value of the counter 9 is reset and the first slit 13 of the driving roller 15, which is re-counted, is set as a home position of the driving roller 15. After setting the slit 13, four pulses are outputted from the counter 9 in one turn with the slit 13 as a reference. The pulses outputted synchronize with passage detection timing of the slit 403 of the first support roller. After such synchronization processing, the counter 9 starts measurement of a passing time interval. Note that such synchronization processing may be performed after the driving roller reaches target rotational speed.

The controller 9 measures time intervals T1, T2, and T3 based on a pulse signal outputted from the counter 9 and stores the time intervals T1, T2, and T3 in the memory. In addition, the controller 8 measures time intervals $T_1$1, $T_1$2, and $T_1$3 based on a pulse signal outputted from the detector 406 of the first detecting unit 404 and stores the time intervals $T_1$1, $T_1$2, and $T_1$3 in the memory. The controller 8 calculates an average angular speed $\omega_{02\text{-}1}$ based on a time interval ($T_1$1+$T_1$2) in the section $A_1$ in the figure of the first support roller 17 and calculates an average angular speed $\omega_{02\text{-}2}$ based on a time interval ($T_1$2+$T_1$3) in the section B1 in the figure of the first support roller 17. It is possible to calculate the amplitude A and the phase $\alpha$ by substituting the time intervals T1, T2, and T3 measured based on the pulse signal outputted from the counter 9 and the average angular velocities $\omega_{02\text{-}1}$ and $\omega_{02\text{-}2}$ calculated in equation 17.

When a belt moving speed obtained from the amplitude A and the phase $\alpha$ obtained in this way is constant, the target rotation angular speed $\omega_{2ref}$ of the second support roller (the driving roller) is as shown in equation 18.

In performing the feedback control for the driving motor indicated by equation 18, when the second support roller is the driving roller 15, the controller 8 performs the feedback control for the driving motor 7 based on an output result of the second detecting unit 504 and the target rotation angular speed $\omega_{2ref}$. Specifically, the controller 8 calculates a difference between the output result of the second detecting unit 504 and the target rotation angular speed $\omega_{2ref}$ using a comparator or the like. A fluctuation component due to attachment eccentricity of the second detecting unit 504 is eliminated from the detection result of the second detecting unit 504 by calculating the difference. As a result, a fluctuation component due to eccentricity of the driving roller 15 calculated and a fluctuation component of the gears 11 and 12, the motor 7, and the like obtained as the detection result of the second detecting unit 504 are extracted. If the controller 8 controls the driving motor 7 to cancel the fluctuation components extracted, it is possible to rotate the belt at a uniform speed.

As shown in FIG. 27, a signal 19 for feedback control is generated from a signal of the second detecting unit and, at the same time, a signal 22 for detecting fluctuation in a rotational speed due to eccentricity of the driving roller 15 and attachment eccentricity of the second detecting unit 504 is generated using the counter 9. The signal 19 and the signal 22 are transmitted to the controller 8. This makes it possible to sequentially calculate and update fluctuation in a rotational speed of the driving roller 15 during feedback control.

As a result, it is possible to realize highly-accurate feedback control that copes with an environment and aging deterioration.

A method of detecting fluctuation in speed due to eccentricity of the driving roller 15 and the rotary encoder 504 using the third example is explained below. In this case, the driving roller 15 is controlled to rotate at a uniform speed from a detection result of the rotary encoder 504 serving as the second detecting unit. This makes it possible to eliminate fluctuation components of the gears 11 and 12, the motor 7, and the like. However, since the driving roller 15 is controlled to rotate at a uniform speed from a detection result of the rotary encoder 504, a moving speed of the belt fluctuates periodically because of influences of eccentricity in the driving roller 15 and attachment eccentricity of the rotary encoder 504. The periodic fluctuation of the belt is detected by the first support roller 17. As in the third example, rotation time in a first section (the detection section A in FIG. 27) of the driving roller 15 is from the time when the detector 406 of the first detecting unit 404 detects the slit 403A of the encoder board 405 until the time when the detector 406 detects the slit 403A again. Rotation time in a second section (the detection section B in FIG. 27) of the driving roller 15 is from the time when the detector 406 of the first detecting unit 404 detects the slit 403B of the encoder board 405 until the time when the detector 406 detects the slit 403B again. Simultaneous equations are established using the rotation times. Then, it is possible to derive a matrix as in equation 21. It is possible to calculate an amplitude A and a phase a of a fluctuation component in speed due to eccentricity of the driving roller 15 and attachment eccentricity of the rotary encoder 504. This makes it possible to obtain a rotation angular speed (a target angular speed $\omega_{ref}$) of the driving roller 15, which makes a moving speed of the belt constant, shown in equation 22. As described above, it is possible to subject the belt to rotation drive control at a desired speed by performing feedback control for the driving motor 7 based on a difference between an output result of the second detecting unit 504 and the target rotation angular speed $\omega_{ref2}$.

When the second detecting unit 504 is a high-performance encoder such as a rotary encoder, it is also possible to calculate a fluctuation component due to eccentricity of the second support roller and attachment eccentricity of the rotary encoder from rotation angle information θ of the second support roller. A method of calculating a fluctuation component due to eccentricity of the second support roller and attachment eccentricity of the rotary encoder from the rotation angle information θ of the second support roller is explained below.

It is also possible to use the belt driving device in FIG. 27 for calculation of a fluctuation component due to eccentricity of the second support roller and attachment eccentricity of the rotary encoder according to a rotation angle. A basic flow is the same as that of the calculation method according to rotation time. Differences from the calculation method according to rotation time are explained.

When the calculation of a fluctuation component is performed using the belt driving device shown in FIG. 27, the counter 9 is constituted by a synchronous 8-bit counter. A digital value (count data) of a present count number is outputted to the controller 8. The controller 8 performs an arithmetic operation for periodic fluctuation of the second support roller based on the count data outputted. In other words, accumulated rotation angle information of the second support roller is sent to a second roller-period-fluctuation-arithmetic-processing unit.

Detection processing for fluctuation due to eccentricity of the second support roller and attachment eccentricity of the second detecting unit according to a rotation angle is explained below.

First, the controller 8 rotates the DC servomotor to drive the belt. A rotation state of the motor is a state in which rotational speed is stable such that a slip between the roller and the belt at the time of rotation angle detection is minimized. Subsequently, the controller 8 performs synchronization processing and setting for a home position that is a rotation phase reference of the second support roller. The synchronization processing and the setting for a home position of the second support roller are the same as above, explanations thereof are omitted.

When a home position is set, the controller 8 calculates a roller diameter ratio based on the home position. When a home position of the second detecting unit 504 synchronizing with a pulse signal of the first detecting unit 404 is set, the controller 8 counts a pulse signal outputted from the second detecting unit 504 using the counter 9. When a pulse signal of the first detecting unit 404 is outputted, the controller 8 stores a count number at that point as count data C1. When the next pulse signal of the first detecting unit 404 is outputted, the controller 8 stores a count number at that point as count data C2. In the same manner, the controller 8 stores count data C3. The controller 8 stores three count data in one rotation of the second support roller. Then, the controller 8 calculates a rotation angle θ from a home position of the second support roller, at the time when the pulse signal of the first detecting unit 404 is outputted, based on the count data. Specifically, a home position is set as θ0, a rotation angle calculated from the count data C1 is set as θ1, a rotation angle calculated from the count data C2 is set as θ2, and a rotation angle calculated from the count data C3 is set as θ3. The rotation angles θ1, θ2, and θ3 are rotation angles of the second support roller 15 at the time when the first support roller 17 rotates by half. Thus, it is possible to represent rotation angles of the second support roller 15 at the time when the first support roller 17 rotates once as θ2 and (θ3-θ1). The controller 8 calculates a diameter ratio (R1/R2) of a diameter R1 of the first support roller 17 and a diameter R2 of the second support roller from the rotation angle θ2 or (θ3-θ1) calculated.

Subsequently, the controller 8 executes calculation processing for a fluctuation component due to eccentricity of the second support roller 15 and attachment eccentricity of the second detecting unit 504 using the rotation angles θ1, θ2, and θ3 with the home position θ0 of the second support roller set as a reference and the diameter ratio (R1/R2) of the first support roller and the second support roller. Specifically, the controller 8 calculates an amplitude A' of fluctuation in a rotation angle due to eccentricity of the second support roller 15 and attachment eccentricity of the second detecting unit 504 and a phase α' with the home position θ0 as a reference. The controller 8 calculates the amplitude A' and the phase α' from a rotation angle, at which the second support roller 15 rotates while the first support roller 17 rotates by the first section (the detection section $A_1$ in FIG. 27), and a rotation angle, at which the second support roller rotates while the first support roller rotates by the second section (the detection section $B_1$ in FIG. 27). The first section $A_1$ of the first support roller 17 substantially coincides with the first detection section $A_2$ of the second support roller 15 shown in FIG. 27. The second section $B_1$ of the first support roller 17 substantially coincides with the second detection section $B_2$ of the second support roller shown in FIG. 27. A rotation angle, at which the second support roller rotates while the first support roller 17 rotates by the first section A1, is (θ2-θ0). A rotation angle, at which the second support roller rotates while the first support roller 17 rotates by the second section B1, is (θ3-θ1). In this way, the amplitude A' and the phase α' are calculated based on the rotation angles (θ2-θ0) and (θ3-θ1), at which the second support roller 15 rotates while the first support roller 17 rotates once. This makes it possible to neglect influences of eccentricity of the first support roller 17 and attachment eccentricity of the first detecting unit 404 as described above.

A method of calculating the amplitude A' and the phase α' of fluctuation in a rotation angle due to eccentricity of the second support roller 15 and attachment eccentricity of the second detecting unit 504 is explained below.

A rotation angle $\theta_2$ of the second support roller 15 including fluctuation in a rotation angle due to eccentricity of the second support roller 15 and the like is defined as follows.

$$\theta_2=\theta_{02}+A'\sin(\theta_2+\alpha') \tag{31}$$

$\theta_{02}$ in equation 31 is an ideal rotation angle of the second support roller 15 that rotates following conveyance of the belt. This is equal to an amount of belt movement converted into a rotation angle of the roller. In other words, if there is no eccentricity of the second support roller 15 and the like and an ideal roller and an ideal encoder are used, $\theta_{02}=\theta_{02}$. A fluctuation component in a rotation angle due to eccentricity of the second support roller 15 and attachment eccentricity of the second detecting unit 504 of the amplitude A' and the phase α' are superimposed on the rotation angle.

It is possible to represent the ideal rotation angle $\theta_{02}$, at which the second support roller 15 rotates while the first support roller 17 rotates by the first section $A_1$ (an integer number of rotations), as follows.

$$\theta_{02}=\frac{R_1}{R_2}\theta_{01}=\frac{R_1}{R_2}2N\pi \tag{32}$$

Since the first support roller 17 rotates once in the first section $A_1$, N=1. The value calculated according to the detection data described above is used as a diameter ratio (R1/R2) of the first support roller 17 and the second support roller 15.

It is possible to represent equation 31 as follows from the rotation angle (θ2-θ0), at which the second support roller 15 rotates while the first support roller 17 rotates by the first section $A_1$, and equation 32.

$$\theta 2-\theta 0=\frac{R_1}{R_2}2N\pi+A'\sin(\theta 2-\theta 0+\alpha') \tag{33}$$

A rotation angle, at which the second support roller rotates while the first support roller 17 rotates by the second section B1, is (θ3-θ1). The first support roller 17 also rotates by an integer number of times in the second section B1. Since it is also possible to represent θ02 by equation 32, it is possible to represent equation 31 as follows.

$$\theta 3-\theta 1=\frac{R_1}{R_2}2N\pi+A'\sin(\theta 3-\theta 1+\alpha') \tag{34}$$

It is possible to calculate the amplitude A' and the phase α' of fluctuation in a rotation angle due to eccentricity of the second support roller 15 and attachment eccentricity of the second detecting unit 504 by solving simultaneous equations shown below that is derived by transforming equation 33 and equation 34.

$$\begin{bmatrix}\sin(\theta 2-\theta 0) & \cos(\theta 2-\theta 0)\\ \sin(\theta 3-\theta 1) & \cos(\theta 3-\theta 1)\end{bmatrix}\begin{bmatrix}A'\cos(\alpha')\\ A'\sin(\alpha')\end{bmatrix}=\begin{bmatrix}\theta 2-\theta 0-\frac{R_1}{R_2}2N\pi\\ \theta 3-\theta 1-\frac{R_1}{R_2}2N\pi\end{bmatrix} \tag{35}$$

The controller 8 stores values of the amplitude A' of fluctuation in a rotation angle of the second support roller 15 and the phase α' with the home position as a reference, which are calculated based on equation 35, in the data memory and sets a target rotation angle $\theta_{2ref}$ of the second support roller 15. To improve detection accuracy, the controller 8 may repeat these operations to calculate average values of a plurality of amplitudes A' and a plurality of phases α'.

The controller 8 generates a rotation angle (a target angle) $\theta_{2ref}$ of the second support roller 15 at the time when the belt moves by a fixed amount from the amplitude A' and the phase α' calculated according to the equation of equation 35 and performs feedback control based on the data.

As shown in FIG. 27, it is possible to represent the rotation angle (the target rotation angle) $\theta_{2ref}$ of the second support roller 15 at the time when an amount of belt movement is fixed as follows. Note that $\theta_{02}'$ is a rotation angle of the second support roller.

$$\theta_{2ref}=\theta_{02}'+A'\sin(\theta_{02}'+\alpha') \tag{36}$$

When the second support roller is a driving roller, the controller 8 calculates a difference between a detection result of the second detecting unit and the target rotation angle $\theta_{2ref}$ and eliminates an attachment eccentricity component of the second detecting unit. The controller 8 extracts a fluctuation component in a rotation angle due to eccentricity of the driving roller calculated and a fluctuation component of a rotation angle of a motor or a gear detected by the second detecting unit. The controller 8 performs feedback control for the driving motor 7 such that the fluctuation component in a rotation angle due to eccentricity of the driving roller and the fluctuation component in a rotation angle of a motor or a gear are cancelled.

When the second support roller is a driven roller, the controller 8 performs feedback control for the driving motor 7 such that a detection result of the second detecting unit is the target rotation angle $\theta_{2ref}$. $\theta_{02}'$ is a rotation angle of the second support roller. The rotation angle $\theta_{02}'$ of the second support roller is obtained by dividing an amount of belt conveyance by a radius of the second support roller. The belt conveyance amount is obtained by multiplying the number of revolutions of the driving motor by a radius of the driving roller.

When a high-performance rotary encoder is used as the second detecting unit 504, it is possible to perform feedback control to convey the belt at a constant speed based on rotation angle information as well.

Rotation angular speed of the second support roller is displaced regardless of the fact that conveyance speed of the belt is constant. As causes of the displacement, there is fluctuation in thickness in the circumferential direction of the belt other than the periodic fluctuation due to eccentricity of the second support roller and attachment eccentricity of the encoder. When there is fluctuation in thickness in the circumferential direction, fluctuation occurs in a rotational speed of the second support roller. A mechanism for occurrence of the fluctuation is explained below. When there is fluctuation in thickness of the belt, rotational speed of the roller decreases when a thick portion of the belt is wound around a driving roller for driving the belt. Conversely, rotational speed of the roller increases when a thin portion of the belt is wound around the driving roller. Therefore, even if a belt moving speed is constant, fluctuation occurs in a rotational speed of the roller. This is because, as shown in equation 1, a relation between a belt speed V and a rotation angular speed of a roller is $V=R\times\omega$ when eccentricity of the roller is not taken into account.

When the belt is wound around the roller and conveyed, contraction occurs on an inner side (a side in contact with the roller) of the belt and expansion occurs on an outer side of the belt when the belt is wound around the roller. According to such deformation of the belt, R determining a relation between belt speed and rotation angular speed of the roller changes to a distance from the center of the roller to the central part of a belt thickness rather than a distance from the center of the roller to the surface of the roller. This means that $V=(R+1/2\times B)\omega$. B is thickness of the belt. Consequently, when the belt is conveyed at a constant speed, $R+1/2\times B$ (an effective radius of the roller) changes when the thickness B of the belt changes. As a result, rotation of the roller fluctuates.

Thus, fluctuation in a rotational speed of the second support roller due to fluctuation in thickness of the belt may be detected from rotation information (rotation velocities) of the first support roller and the second support roller to correct a detection error of the second support roller from a result of the detection.

First, the controller 8 performs detection of fluctuation in thickness in one turn of the belt. In the detection of fluctuation in thickness of the belt, the controller 8 drives the belt to rotate once or more to obtain rotation velocities from the first support roller and the second support roller, respectively. In this case, periodic fluctuation due to eccentricity of the roller is also detected. Thus, when the controller 8 performs detection of fluctuation in a rotational speed due to thickness of the belt, the controller 8 obtains rotation velocities of the first support roller and the second support roller using a filter for blocking a band of a rotation period of the roller. Fluctuation in a rotational speed due to fluctuation in thickness of the belt is included in the respective rotation velocities. Fluctuation in a rotational speed due to fluctuation in thickness of the belt with different phases and amplitudes is detected in the two rotation velocities according to a diameter or a positional relation of the roller. However, it is possible to calculate fluctuation in a rotational speed due to fluctuation in thickness of the belt by using parameters such as a positional relation of two rollers and roller diameters that are predefined at the time of design in advance. The controller 8 corrects fluctuation in a rotational speed due to fluctuation in thickness of the belt of the second support roller using data of fluctuation in a rotational speed due to the fluctuation in thickness of the belt calculated.

After calculating fluctuation in a rotational speed due to fluctuation in thickness of the belt and correcting fluctuation in a rotational speed due to fluctuation in thickness of the belt of the second support roller, the controller 8 removes the filter and calculates fluctuation in rotation velocities due to eccentricity of the second support roller based on the method described above. In this case, rotation information of the first support roller and the second support roller is rotation information in which fluctuation in a rotational speed due to fluctuation in thickness of the belt is corrected. Thus, it is possible to calculate more accurate fluctuation in a rotational speed of the second support roller. The controller 8 calculates fluctuation in a rotational speed of the second support roller based on the information corrected. Then, the controller 8 removes the band blocking filter and detects fluctuation in a rotational speed due to fluctuation in thickness of the belt. In this case, in rotation information of the second support roller, fluctuation in a rotational speed due to eccentricity of the second support roller and the like is eliminated. Thus, even if the band blocking filter is removed, an error never occurs in fluctuation in a rotational speed due to fluctuation in thickness of the belt calculated from fluctuation in a rotational speed of the second support roller. In detection of fluctuation in a rotational speed due to fluctuation in thickness of the belt in the second time, it is possible to detect fluctuation in a rotational speed due to fluctuation in thickness of the belt with a wider band (more complicated fluctuation). Thus, it is possible to calculate more accurate fluctuation in a rotational speed due to fluctuation in thickness of the belt.

The controller 8 performs feedback control by calculating target rotational speed of the second support roller, which is a target in performing feedback control, using the fluctuation in a rotational speed due to fluctuation in thickness of the belt and the fluctuation in a rotational speed due to eccentricity of the second support roller and attachment eccentricity of the second detecting unit calculated in this way. The rotational speed of the second support roller is calculated taking into account fluctuation in a rotational speed due to fluctuation in thickness of the belt and fluctuation in a rotational speed due to eccentricity of the second support roller and attachment eccentricity of the second detecting unit. Thus, it is possible to control conveyance of the belt more accurately.

In this embodiment, it is preferable to provide the first support roller between the second support roller and the driving roller and not to provide a roller except the first support roller between the second support roller and the driving roller. When the driven roller such as the first support roller or the second support roller has eccentricity, a path length of the belt changes because of the eccentricity. An influence of the change in the path length of the belt affects a roller provided in a path connecting a tension roller from the eccentric roller without the intervention of the driving roller.

Figure 21:
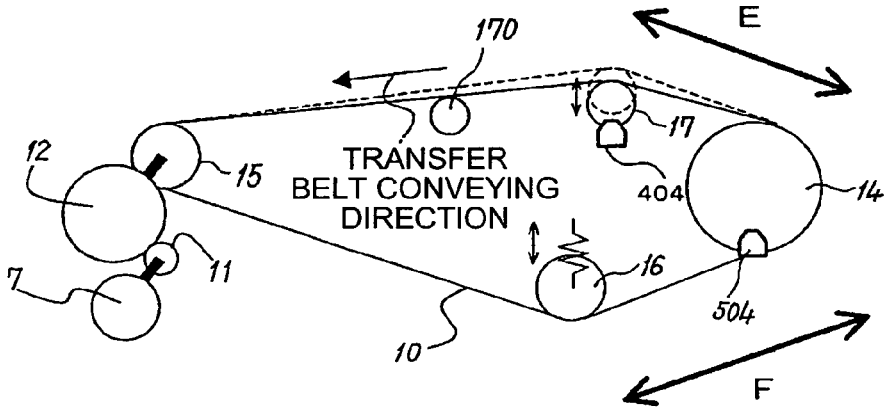
FIG. 21 is a schematic for explaining an arrangement of a first support roller, a second support roller, and an image forming unit.

A belt driving device in FIG. 21 includes the driving roller 15 and the tension roller 16. The belt driving device also includes the first support roller 17 and the second support roller 14 as driven rollers. For example, as shown in FIG. 21, when the first support roller 17 is eccentric, the belt 10 fluctuates between a dotted line and a solid line in the figure because of eccentricity of the first support roller 17. Such fluctuation is a fluctuation component having a rotation period of the first support roller 17 as one period. For example, when the belt 10 moves from the solid line to the dotted line, the tension roller 16 moves to an upper side in the figure. On the other hand, when the belt 10 moves from the dotted line to the solid line, the tension roller 16 moves to a lower side in the figure to prevent the belt 10 from bending. The belt 10 is wound around the driving roller 15 to prevent a slip or the like from occurring between the driving roller 15 and the belt 10. Therefore, the bend at the time when the belt 10 moves from the dotted line to the solid line is absorbed by the tension roller 16 via the second support roller 14 without intervention of the driving roller 15. In other words, when the first support roller 17 moves from the dotted line to the solid line, the belt 10 is pulled in a direction opposite to a conveying direction by the tension roller 16. Thus, a moving speed of the belt in a conveying path extending from the tension roller 16 to the first support roller 17 via the second support roller 14 is lower than moving velocities of the belt in other positions. When the first support roller 17 moves from the solid line to the dotted line, the belt 10 is pulled in the conveying direction. Thus, a moving speed of the belt in a conveying path extending from the tension roller 16 to the first support roller 17 via the second support roller 14 is higher than moving velocities of the belt in other positions. As a result, rotational speed of the second support roller 14 fluctuates because of eccentricity of the first support roller 17.

On the other hand, when the second support roller 14 fluctuates because of eccentricity, fluctuation in speed of the belt occurs in the belt conveying path between the tension roller 16 and the second support roller 14. The first support roller 17 is not affected by the fluctuation in speed of the belt due to eccentricity of the second support roller 14.

As described earlier, the detection sections of the first support roller 17 are integer times as many as those of the second support roller 14 and are the same as the intervals of the respective slits 13 of the second detecting unit 504. Therefore, even if fluctuation in speed of the belt due to eccentricity of the first support roller 17 described above occurs in the second support roller 14, it is possible to neglect most of an influence of the fluctuation in speed of the belt in deriving fluctuation in a rotational speed of the second support roller due to eccentricity of the second support roller and attachment eccentricity of the second detecting unit.

When a third roller 170 other than the first support roller 17 is provided between the second support roller 14 and the driving roller 15, fluctuation in speed of the belt due to eccentricity of the third roller 10 affects the first support roller 17 and the second support roller 14. A rotation angular speed of the first support roller 17 and a rotation angular speed of the second support roller 14 fluctuate. It is impossible to calculate fluctuation in a rotational speed of the second support roller 14 accurately. However, a roller wound around the belt less and affected by eccentricity less may be provided.

On the other hand, when the second support roller 14 is provided between the first support roller 17 and the driving roller 15, it is impossible to detect rotation information of the first support roller 17 correctly because of an influence of fluctuation in speed of the belt due to eccentricity of the second support roller 14.

It is preferable to provide an image forming unit like a photosensitive member further on a downstream side in the belt conveying direction than the second support roller 14. It is preferable to provide the image forming unit in a section E shown in FIG. 21, that is, between the second support roller 14 and the first support roller 17. This is because the controller 8 performs feedback control based on rotation angular speed of the second support roller such that the belt is conveyed at a constant speed. In other words, the controller 8 performs feedback control such that the second support roller 14 rotates at a target rotation angular speed while correcting periodic fluctuation of the drive transmission system or the like with the second support roller 14. Thus, it can be said that, in a portion where the belt moves out from the winding around the second support roller, the belt is least affected by other fluctuation components and moves at most constant speed. Thus, it is possible to reduce an influence of a banding image by providing the image forming unit further on a downstream side in the belt conveying direction than the second support roller 14. It is possible to provide the image forming unit in a section closest to the second support roller and reduce the influence of a banding image more surely by providing the image forming unit in the section E between the second support roller 14 and the first support roller 17.

When the first support roller 17 has eccentricity, the second support roller 14 cannot detect a fluctuation component in the belt of the first support roller 17. Thus, speed fluctuates in the section E in FIG. 21. When the first support roller 17 has eccentricity, it is preferable to provide a photosensitive member between the first support roller 17 and the driving roller 15.

When the image forming unit is provided in a section F between the tension roller 16 and the second support roller 14 shown in FIG. 21, fluctuation may occur in a belt moving speed in the section F because of eccentricity of the second support roller 14. Thus, it is not preferable to set the image forming unit in the section F. However, it is possible to make a belt conveying speed in the section F constant according to a method described below. It is possible to form an image satisfactorily even if the image forming unit is arranged in the section F.

In the method of making a belt conveying speed in the section F constant, first, the second detecting unit having two detectors shown in FIG. 19 is used to eliminate attachment eccentricity of an encoder board according to the method described earlier. In other words, an arithmetic operation for calculating an amplitude and a phase in corrected passing times T1, T2, and T3 is executed. The amplitude and the phase calculated by the arithmetic operation are calculated using passing times with attachment eccentricity of the encoder board eliminated. Thus, it can be said that the amplitude and the phase are a fluctuation component in a rotational speed due to eccentricity of the second support roller 14. It is possible to calculate an amount of movement (an amount of fluctuation) $\Delta L_{BC}$ of the belt due to eccentricity of the second support roller by substituting the phase and the amplitude of the fluctuation component in a rotational speed due to eccentricity of the second support roller in equation 31.

$$\begin{aligned}\Delta L_{BC} &= \Delta L_{AB} + \Delta L_{AC} \\ &= (L_{AB} - L'_{AB}) + (L_{AC} - L'_{AC}) \\ &= L_{0_{AB}} \sin\phi_{AB} + R_A\phi_{AB} + L_{0_{AC}} \sin\phi_{AC} + R_A\phi_{AC} - \\ &\quad L'_{AB} - L'_{AC}\end{aligned} \tag{37}$$

where $$L_{0_{AB}} = \sqrt{L_{0_{AB}}^2 + \varepsilon_2^2 + 2L'_{0_{AB}}\varepsilon_2\cos\theta_A}$$

$$\phi_{AB} = \arccos\left(\frac{R_A - R_B}{L_{0_{AB}}}\right)$$

$$L_{0_{AC}} = \sqrt{L_{0_{AC}}^2 + \varepsilon_2^2 + 2L'_{0_{AC}}\varepsilon_2\cos\theta_B}$$

$$\phi_{AC} = \arccos\left(\frac{R_A - R_C}{L_{0_{AC}}}\right)$$

$$\theta_A = \omega_A t + \alpha + \eta_A$$

$$\theta_B = \omega_A t + \alpha + \eta_B$$

Figure 25:
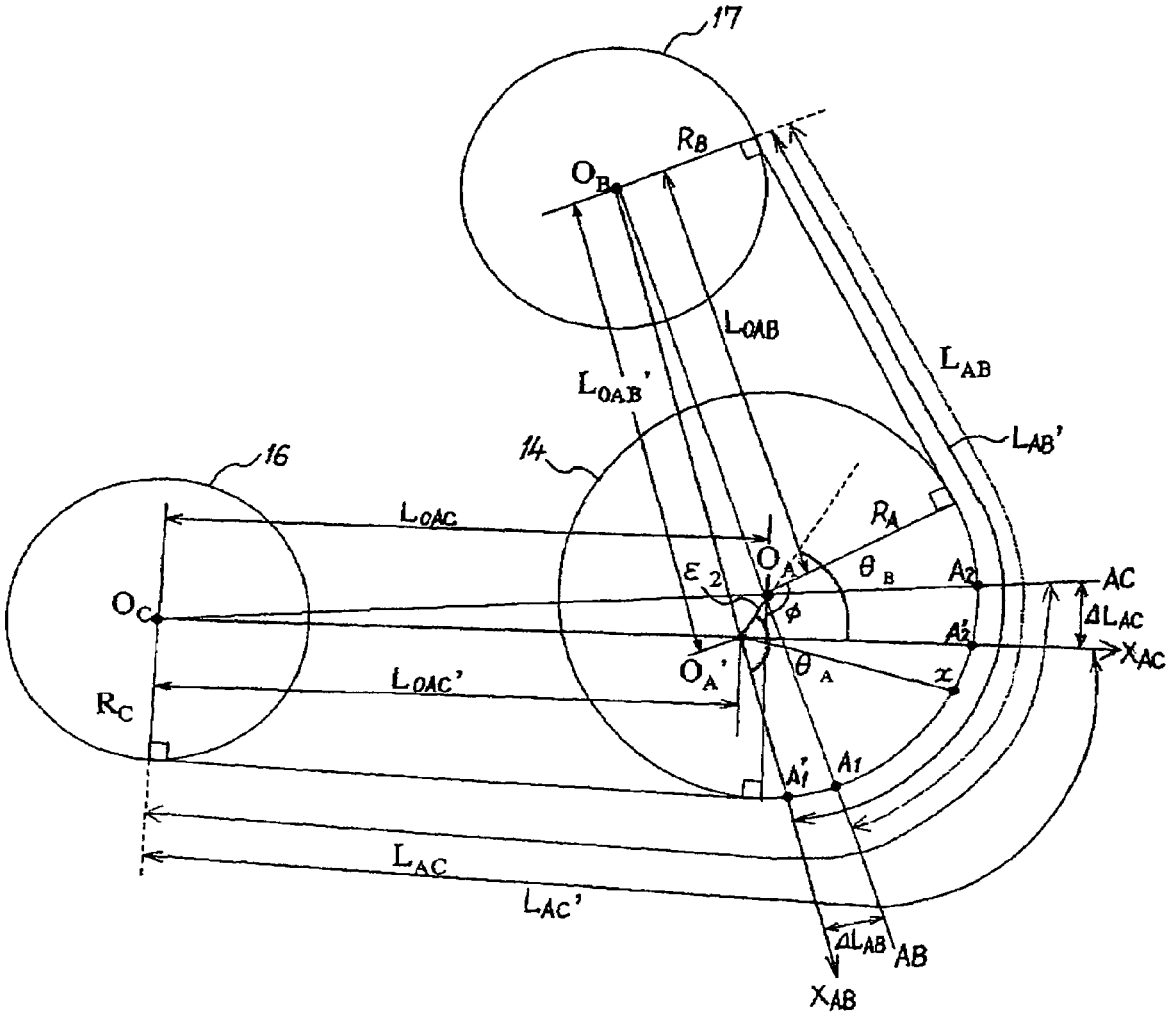
FIG. 25 is a schematic for explaining calculation of an amount of belt movement due to eccentricity of a second support roller.

Equation 37 is explained below with reference to FIG. 25. FIG. 25 illustrates the second support roller 14 in which a center $O_A$ is eccentric from a rotation center $O_{A'}$ by $\epsilon_2$. An amount of movement (an amount of fluctuation) of the belt $\Delta L_{BC}$ is calculated with a segment $X_{AC}$ connecting a center $O_C$ of the tension roller 16 and the rotation center $O_{A'}$ of the second support roller 14 and a segment $X_{AB}$ connecting a center $O_B$ of the first support roller 17 and the rotation center $O_{A'}$ of the second support roller 14 shown in FIG. 25 as references. In other words, the amount of movement (the amount of fluctuation) $\Delta L_{BC}$ due to eccentricity of the second support roller 14 is calculated from an amount of fluctuation $\Delta L_{AC}$ of a segment AC connecting the center $O_C$ of the tension roller 16 and the center $O_A$ of the second support roller 14 with respect to the segment $X_{AC}$ and an amount of fluctuation $\Delta L_{AB}$ of a segment AB connecting the center $O_B$ of the first support roller 17 and the center $O_A$ of the second support roller with respect to the segment $X_{AB}$.

As shown in equation 31, it is possible to represent $\Delta L_{AC}$ as a difference between $L_{AC}$ and $L_{AC}'$. $L_{AC}$ is a belt path length from a point A2 of the second support roller 14 on a line connecting the center $O_C$ of the tension roller 16 and the center $O_A$ of the second support roller 14 to a belt winding start point C of the tension roller 16. $L_{AC}'$ is a belt path length to the tension roller 16 at the time when the amount of eccentricity $\epsilon_2$ is zero, that is, when the center $O_A$ of the second support roller 14 is the rotation center $O_{A'}$. Specifically, $L_{AC}'$ is a distance from a point A2' on the second support roller 14 on a line connecting the center $O_C$ of the tension roller 16 and the rotation center $O_{A'}$ of the second support roller 14 to the belt winding start point C of the tension roller 16.

Similarly, as shown in equation 31, it is possible to represent $\Delta L_{AB}$ as a difference between $L_{AB}$ and $L_{AB}'$. $L_{AB}$ is a belt path length from a point A1 of the second support roller 14 on a line connecting the center $O_B$ of the first support roller 17 and the center $O_A$ of the second support roller 14 to a belt winding start point B of the first support roller 1. $L_{AB}'$ is a belt path length to the first support roller 17 at the time when the amount of eccentricity $\epsilon_2$ is zero, that is, when the center $O_A$ of the second support roller 14 is the rotation center $O_{A'}$. Specifically, $L_{AB}'$ is a distance from a point A1' on the second support roller 14 on a line connecting the center $O_B$ of the first support roller 17 and the rotation center $O_{A'}$ of the second support roller 14 to the belt winding start point B of the first support roller 17.

Values of $\Delta L_{AC}$ and $\Delta L_{AB}$ fluctuate because the center $O_A$ of the second support roller 14 rotates with the rotation center $O_{A'}$ of the second support roller 14 as a reference. On the other hand, values of $\Delta L_A B'$ and $\Delta L_{AC}'$ are values calculated from the rotation enter $O_{A'}$ and a radius $R_A$ of the second support roller 14, the center $O_C$ and a radius $R_C$ of the tension roller 16, and the center $O_B$ and a radius $R_B$ of the first support roller 17, which are known in advance at the time of designing.

It is possible to represent LAC as $(L_{OAC}\ \mathrm{Sin}_{\phi AC}+R_{A\phi AC})$ and it is possible to represent $L_{AB}$ as $(L_{OAB}\ \mathrm{Sin}_{\phi AB}+R_{A\phi AB})$ $L_{OAC}$ shown equation 1 indicates a distance between the center $O_A$ of the second support roller 14 and the center $O_C$ of the tension roller 16. $L_{OAB}$ indicates a distance between the center $O_A$ of the second support roller 14 and the center $O_B$ of the first support roller 17.

$_{\phi AB}$ represents a belt winding angle of the second support roller 14 as a relation between the first support roller 17 and the second support roller 14. $_{\phi AC}$ represents a belt winding angle of the second support roller 14 as a relation between the tension roller 16 and the second support roller 14.

$L_{OAB}'$ shown in equation 31 is a distance between the rotation center $O_{A'}$ of the second support roller 14 and the center $O_B$ of the first support roller 17. $L_{OAC}'$ is a distance between the rotation center $O_{A'}$ of the second support roller 14 and the center $O_C$ of the tension roller 16. These are also values calculated in advance.

$\theta_A$ is a rotation angle at the time when the center $O_A$ of the second support roller 14 rotates to the segment $X_{AB}$ around the rotation center $O_{A'}$ of the second support roller 14. On the other hand, $\theta_B$ is a rotation angle at the time when the center $O_A$ of the second support roller 14 rotates to the segment $X_{AC}$ around the rotation center $O_{A'}$ of the second support roller 14.

$\eta_A$ is $\theta_A$ at the time when the center $O_A$ of the second support roller 14 is located on a segment connecting the rotation center $O_{A'}$ of the second support roller 14 and a point X of a central part (one half of a winding angle) of a belt winding portion of the second support roller 14. $\eta_B$ is $\theta_B$ at the time when the center $O_A$ of the second support roller 14 is located on a segment connecting the rotation center $O_{A'}$ of the second support roller 14 and the point X of the central part (one half of a winding angle) of the belt winding portion of the second support roller 14.

It is possible to calculate $\eta_A$ and $\eta_B$ from the segment AC, the segment AB, and the winding angle that are known at the time of designing.

The amount of eccentricity $\epsilon_2$ is equivalent to an amplitude A of a fluctuation component in a rotational speed due to eccentricity of the second support roller 14 calculated above. The phase $\alpha$ is a phase $\alpha$ of a fluctuation component in a rotational speed due to eccentricity of the second support roller 14. A rotation angular speed $\omega_A$ is an average rotation angular speed of a period of the second support roller 14. It is possible to calculate the rotation angular speed $\omega_A$ based on data at the time of detection of the fluctuation component in a rotational speed due to eccentricity of the second support roller 14.

The amount of movement (the amount of fluctuation) $\Delta L_{BC}$ is calculated from $L_{AB}'$, $L_{AC}'$, $L_{OAB}'$, $L_{OAC}'$, $\eta_A$, $\eta_B$, and $\omega_A$, which are calculated in advance at the time of designing, and the amount of eccentricity $\epsilon_2$ (the amplitude A) and the phase $\alpha$, which are calculated by the arithmetic operation.

Feedback control is performed based on an amount of fluctuation due to eccentricity of the second support roller and a phase and an amplitude of a fluctuation component in a rotational speed due to eccentricity of the second support roller calculated from equation 31. As a result, feedback control taking into account an amount of fluctuation in the belt due to eccentricity of the second support roller is performed. Thus, fluctuation in a belt speed in the F section is controlled. It is possible to form a satisfactory image.

Figure 22:
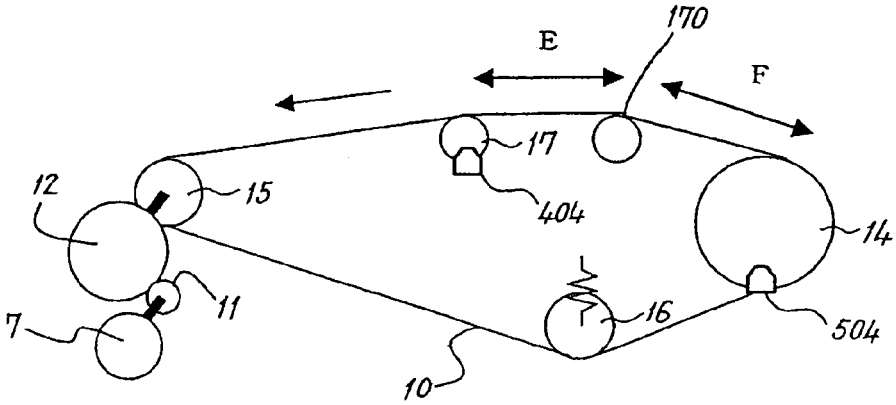
FIG. 22 is a schematic for explaining an arrangement in which the third roller is provided between the first support roller and the second support roller.
Figure 23:
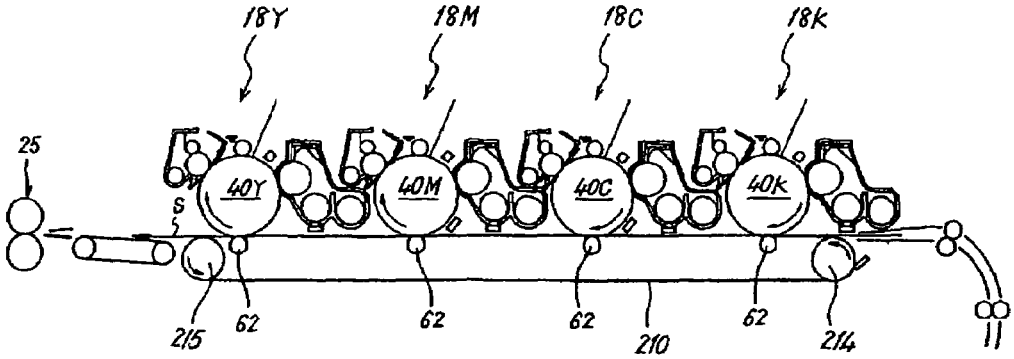
FIG. 23 is a schematic of a tandem image forming apparatus of a direct transfer system.
Figure 24:
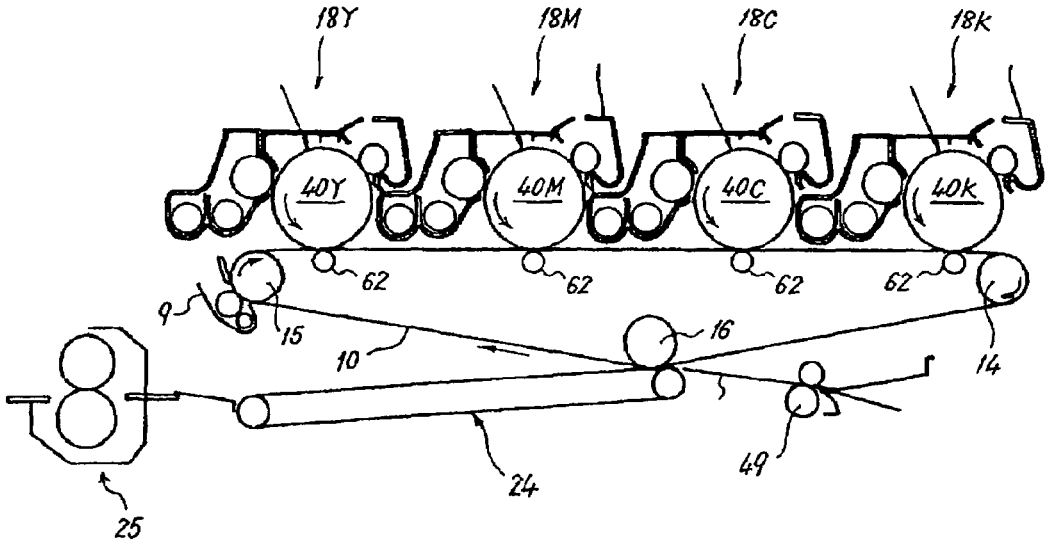
FIG. 24 is a schematic of a tandem image forming apparatus of an intermediate transfer system.

For example, for convenience of design or the like of an image forming apparatus, as shown in FIG. 22, the third roller 170 may be provided between the second support roller 14 and the first support roller 17. In such a case, the second support roller 14 is affected by fluctuation in belt movement due to eccentricity of the third roller 170 and rotates. Therefore, when fluctuation in a rotational speed of the second support roller 14 is corrected and belt speed is controlled using a rotation angular speed of the second support roller 14, feedback control taking into account fluctuation in a belt speed caused by eccentricity of the third roller 170 is performed. In this case, if it is possible to provide an image forming unit such as a photosensitive member in an image forming section F between the third roller 170 and the second support roller 14, in this area, it is possible to form a satisfactory image without causing fluctuation in a belt speed. However, for convenience of design or the like of an image forming apparatus, an image forming unit has to be provided in an image forming section E between the third roller 170 and the first support roller 17 in some cases. Since the image forming section E is not affected by eccentricity of the third roller 170, when the feedback control is performed, fluctuation in a belt speed due to eccentricity of the third roller 170 occurs. In such a case, it is advisable to set a diameter of the third roller 170 to be the same as a diameter of the second support roller 14. Consequently, the second support roller 14 and the third roller 170 have the same period. Thus, when fluctuation in a rotational speed of the second support roller 14 is detected by the method described above, in a result of the detection, fluctuation in a rotational speed caused by belt fluctuation due to eccentricity of the third roller 170 and fluctuation in a rotational speed due to eccentricity of the second support roller and attachment eccentricity of the second detecting unit are combined. Thus, if a target rotation angular speed of the second support roller 14 is calculated based on the result of the detection and feedback control is performed with the target rotation angular speed calculated, fluctuation in a belt speed due to eccentricity of the third roller 170 is not fed back to the driving motor. Therefore, although fluctuation in a belt speed due to eccentricity of the third roller 170 occurs in the image forming section F, fluctuation in a belt speed due to eccentricity of the third roller 170 does not appear in the image forming section E. As a result, it is possible to form an image satisfactorily.

According to the belt drive control method in this embodiment, fluctuation in a rotational speed of one rotation period of the second support roller due to eccentricity of the second support roller serving as a target roller and the like is defined as a sine wave formula using simple parameters shown in equation 12. Rotation time at the time when the second support roller rotates by a predefined rotation angle while the second support roller rotates once is measured in different phases. It is possible to derive an amplitude and a phase by establishing simultaneous equations using the rotation time measured and equation 12 and solving the simultaneous equations. In calculating the formula, an average angular speed $\omega_{02}$ at the time when the second support roller rotates by a predefined rotation angle is calculated using rotation time at the time when the first support roller serving as a first support rotating member rotates once. This makes it possible to calculate the average angular speed $\omega_{02}$ more accurately than calculating the average angular speed $\omega_{02}$ of the second support roller due to a belt moving speed using rotation time at the time when the second support roller rotates by the predefined rotation angle. This is because, although a fluctuation component due to eccentricity of the second support roller is included in the rotation time at the time when the second support roller rotates by the predefined rotation angle, a fluctuation component due to eccentricity of the first support roller is eliminated and only a component of a belt moving speed is included in the rotation time of one rotation of the first support roller.

As described above, in this embodiment, it is possible to accurately derive fluctuation in a rotational speed of one rotation period of the second support roller simply by substituting a value in the simultaneous equations. Thus, it is possible to reduce an amount of calculation compared with the conventional method of extracting a fluctuation component using frequency resolution and a filter. As a result, it is unnecessary to use expensive arithmetic processing software. In addition, it is possible to derive fluctuation in a rotational speed due to eccentricity of the second support roller and the like simply by measuring time when the second support roller rotates by the predefined rotation angle. Thus, it is unnecessary to use an expensive rotary encoder or the like.

According to the belt drive control method in this embodiment, the first support roller is rotated at a uniform speed. If the driving source is controlled to rotate the first support roller at a uniform speed in this way, a fluctuation component of periodic fluctuation due to eccentricity of the driving roller is eliminated by the first support roller. Consequently, rotation time at the time when the second support roller rotates by the predefined rotation angle is not affected by a fluctuation component of periodic fluctuation or the like due to eccentricity of the driving roller. Simultaneous equations are established using the rotation time and the equation of equation 12 to calculate an amplitude and a phase of fluctuation in a rotational speed due to eccentricity of the second support roller and the like. Since the rotation time used in this case is not affected by a fluctuation component of periodic fluctuation or the like due to eccentricity of the driving roller, it is possible to calculate an amplitude and a phase accurately. In the belt drive control method in this embodiment, it is also possible to derive fluctuation in a rotational speed due to eccentricity of the second support roller and the like simply by measuring time when the second support roller rotates by the predefined rotation angle. Thus, it is unnecessary to use an expensive rotary encoder or the like.

If a diameter of the first support roller is set such that the first support roller rotates once when the second support roller rotates by the predefined rotation angle, even if the first support roller has eccentricity, an influence of fluctuation in a rotational speed of the second support roller due to eccentricity of the first support roller does not appear in rotation time at the time when the second support roller rotates by the predefined rotation angle. This is because, since it is possible to represent fluctuation in a rotational speed of the second support roller due to eccentricity of the first support roller as a cosine wave, a sine wave, or the like having one rotation of the first support roller as one period, a fluctuation component is offset in one rotation period. This makes it possible to accurately calculate an amplitude and a phase of fluctuation in a rotational speed of the second support roller due to eccentricity of the second support roller and the like from rotation time at the time when the second support roller rotates by the predefined rotation angle even if the first support roller has eccentricity.

According to the belt drive control method in this embodiment, the second support roller is rotated at a uniform speed. Rotation time of one rotation of the first support roller is measured at least twice while the second support roller rotates once. A fluctuation component of the drive transmission system due to eccentricity of the driving roller and the like is eliminated by rotating the second support roller. However, fluctuation in a rotational speed due to eccentricity of the second support roller and the like appears as a fluctuation component of a moving speed of the belt. Then, rotational speed of the first support roller fluctuates according to fluctuation in a rotational speed of the second support roller. Thus, it is possible to establish simultaneous equations based on equation 12 by measuring time of one rotation of the first support roller twice while the second support roller rotates once. Since rotation time of one rotation of the first support roller is measured, even if the first support roller is eccentric and fluctuation in a rotational speed of the first support roller occurs, it is possible to neglect an influence of the fluctuation. This is because, since it is possible to represent periodic fluctuation that occurs in one rotation period of the first support roller as a sine wave or a cosine wave, the fluctuation is offset in one rotation period of the first support roller. Thus, it is possible to accurately calculate a phase and an amplitude of fluctuation in a rotational speed of the second support roller using rotation time of one rotation of the first support roller. In addition, it is possible to derive fluctuation in a rotational speed of the second support roller due to eccentricity of the second support roller simply by measuring time of one rotation of the first support roller. Thus, it is unnecessary to use an expensive rotary encoder.

According to the belt drive control method in this embodiment, it is possible to improve detection sensitivity for a fluctuation component of the second support roller by setting the predefined rotation angle to $\pi$ radian.

According to the belt drive control method in this embodiment, rotation time at the time when the second support roller rotates by the predefined rotation angle while the second support roller rotates once is measured in phases different by ($\pi/2$). This makes it possible to improve detection sensitivity for a fluctuation component of the second support roller surely.

According to the belt-drive control device in this embodiment, rotation information of the second support roller substituted in the simultaneous equations is obtained by the second detecting unit. The rotation information includes a fluctuation component of the second support roller due to eccentricity of the second support roller and the like and a fluctuation component of the drive transmission system due to eccentricity of the driving roller and the like. To eliminate the fluctuation component of the drive transmission system, rotation information of the first support roller detected by the first detecting unit is used. The rotation information of the first support roller also includes a fluctuation component of the drive transmission system. The control information of the second support roller is corrected by an arithmetic unit using the rotation information of the first support roller to eliminate the fluctuation component of the drive transmission system from the rotation information of the second support roller. The rotation information of the second support roller, from which the fluctuation component of the drive transmission system is eliminated, is divided into two in one period of the second support roller to establish and solve simultaneous equations. This makes it possible to accurately derive an amplitude and a phase of fluctuation in a rotational speed of the second support roller due to eccentricity of the second support roller even if a detecting unit with low resolution is used.

According to the belt-drive control device in this embodiment, a rotational speed of the first support roller is detected by the first detecting unit with high resolution. The driving roller is controlled based on a result of the detection to rotate the first support roller at a uniform speed. Since the first support roller is rotated at a uniform speed in this way, fluctuation of the drive transmission system due to eccentricity of the driving roller and the like does not affect rotational speed of the second support roller. As a result, an influence of fluctuation of the drive transmission system due to eccentricity of the driving roller and the like is not detected in rotation information of the second support roller detected by the second detecting unit with low resolution when the first support rotating roller is rotating at a uniform speed. It is possible to accurately calculate an amplitude and a phase of fluctuation in a rotational speed of the second support roller even if a detecting unit with low resolution is used as the second detecting unit by establishing and solving simultaneous equations based on the rotation information of the second support roller.

According to the belt-drive control device in this embodiment, a rotational speed of the second support roller is detected by the second detecting unit with high resolution. The driving source is controlled based on a result of the detection to rotate the second support roller at a uniform speed. Since the second support roller is rotated at a uniform speed in this way, fluctuation of the drive transmission system due to eccentricity of the driving roller and the like does not affect rotational speed of the first support roller. However, a moving speed of the belt fluctuates because of fluctuation in a rotational speed of the second support roller. A rotational speed of the first support roller fluctuates because of the fluctuation in a rotational speed of the second support roller that occurs in the belt. Since the fluctuation component is detected by the first detecting unit, it is possible to accurately calculate an amplitude and a phase of rotational speed of the second support roller by using rotation information detected by the first detecting unit.

According to the belt-drive control device in this embodiment, it is also possible to use the driving roller as the second support roller.

According to the belt-drive control device in this embodiment, the arithmetic unit derives a phase and an amplitude based on rotation information including rotation time at the time when the second support roller rotates by the predefined rotation angle from a first position of the second support roller and rotation time at the time when the second support roller rotates by the predefined rotation angle from a second position of the second support roller. Specifically, the arithmetic unit derives an amplitude and a phase of fluctuation in a rotational speed of the second support roller by establishing simultaneous equations using the rotation times measured and a sine wave function that includes the amplitude and the phase shown in equation 12 defining fluctuating in a rotational speed of the second support roller as unknown parameters, and solving the simultaneous equations. It is possible to calculate an amplitude and a phase of fluctuation in a rotational speed of the second support roller simply by solving the simultaneous equations. Therefore, it is possible to reduce an amount of calculation compared with the conventional method of subjecting a detection result including fluctuation in a rotational speed of the second support roller to frequency resolution. It is possible to derive a phase and an amplitude of fluctuation in a rotational speed of the second support roller from time when the second support roller rotates by the predefined rotation angle. Thus, it is possible to accurately derive fluctuation in a rotational speed of the second support roller even if an encoder with low resolution is used.

In the case of the first and the second examples, the rotation information (the rotation time at the time when the second support roller rotates by the predefined rotation angle) is acquired by the second detecting unit. In the case of the third example, the rotation information (the rotation time at the time when the second support roller rotates by the predefined rotation angle) is acquired by the first detecting unit.

According to the belt-drive control device in this embodiment, the predefined rotation angle is set to $\pi$ radian. This makes it possible to improve detection sensitivity for fluctuation in a rotational speed of the second support roller.

According to the belt-drive control device in this embodiment, a phase difference angle of the first position and the second position is set to ($\pi/2$) radian. This makes it possible to improve detection sensitivity of a fluctuation component of the second support roller surely.

According to the belt-drive control device in this embodiment, the second detecting unit measures time from the time when the detector detects the first section to be detected until the time when the second detecting unit detects a section to be detected in a position rotated by the predefined rotation angle and time from the time when the detector detects the second section to be detected until the time when the detector detects a section to be detected in a position rotated by the predefined rotation angle. This makes it possible to easily measure time at the time when the second support roller rotates by the predefined rotation angle by detecting a section to be detected and measuring time.

According to the belt-drive control device in this embodiment, a peripheral length of one rotation of the first support roller is set to be integer times as long as a peripheral length between units to be detected. This allows the first support roller to rotate the number of times about integer times as many as the number of rotations of the second support roller when the second support roller rotates by the predefined rotation angle. Thus, fluctuation due to eccentricity of the first support roller is prevented from affecting time at the time when the second support roller rotates by the predefined rotation angle. This is because it is possible to represent a fluctuation component due to eccentricity of the first support roller and the like as a sine wave or a cosine wave with the first support roller as one rotation and the fluctuation is offset when the first support roller rotates once.

The first support roller also rotates the number of times substantially integer times as many as the number of rotations of the second support roller between the first section to be detected and the second section to be detected. Thus, it is possible to prevent an influence of the first support roller from affecting phases of the first section to be detected and the second section to be detected.

According to the belt-drive control device in this embodiment, a diameter of the second support roller is set to be 4n (n is a natural number) times as larger as a diameter of the first support roller. Consequently, when the second support roller rotates by $\pi$ radian and rotates by $(\pi/2)$ radian, the first support roller rotates the number of times integer times as many as the number of rotations of the second support roller. This makes it possible to control, in the second support roller with a predefined rotation angle set to $\pi$ radian and a phase difference angle of the first position and the second position set to $(\pi/2)$ radian, an influence of a fluctuation component due to eccentricity of the first support roller and the like at the time of measurement of rotation time when the second support roller rotates by the predefined rotation angle.

If at least a ratio of a diameter of the second support roller and a diameter of the first support roller is set to 2:1, as shown in FIG. 26, it is possible to set, in the second support roller with a predefined rotation angle set to $\pi$ radian and a phase difference angle of the first position and the second position set to $(\pi/2)$ radian, the first support roller to rotate once when the predefined rotation angle rotates by $\pi$ radian.

According to the belt-drive control device in this embodiment, the second detecting unit sets one of sections to be detected as a home position to be a reference at the time when the arithmetic unit derives an amplitude and a phase of fluctuation in a rotational speed of one rotation period of the second support roller. Thus, it is unnecessary to provide a home position and a detecting unit for detecting the home position separately from the second detecting unit in the second support roller.

According to the belt-drive control device in this embodiment, the home position is set as a reference position in controlling a driving source based on the phase and the amplitude derived. This makes it possible to match, when the driving source is controlled, fluctuation in a rotational speed of the second support roller calculated from the phase and the amplitude derived and fluctuation in a rotational speed of the second support roller and accurately perform belt drive control.

According to the belt-drive control device in this embodiment, the detecting unit includes at least three sections to be detected. This makes it possible to set two sections to be detected as references for measuring rotation time at the time when the second support roller is rotated by the predefined rotation angle and use the remaining one section to be detected for a home position.

According to the belt-drive control device in this embodiment, the second detecting unit includes the first detector and the second detector. The second detector detects a section to be detected in a position with a phase shifted by 180° from a section to be detected that is detected by the first detector. This makes it possible to set rotation information detected by the second detector as rotation information with a phase shifted by 180° from rotation information detected by the first detector. One period of periodic fluctuation due to attachment eccentricity of the second detecting unit is one rotation of the second support roller. Thus, if the rotation information detected by the first detector and rotation information detected by the second detector are averaged, the periodic fluctuation due to attachment eccentricity of the second detecting unit is offset. As a result, it is possible to reduce fluctuation in a rotational speed included in the rotation information detected by the detecting unit to fluctuation in a rotational speed due to eccentricity of the second support roller. As a result, it is possible to derive fluctuation in a rotational speed of the second support roller highly accurately if the rotation information of the second detecting unit is used.

According to the belt-drive control device in this embodiment, any one of the second detecting unit and the first detecting unit or both include a rotation board including a plurality of sections to be detected that are arranged in a ring shape around a rotation axis of a rotating member to be detected. The rotation board is fixed to the rotating member to be detected. It is possible to provide a detecting unit in an arbitrary position of the rotating member to be detected by providing the sections to be detected in the rotation board.

According to the belt-drive control device in this embodiment, the sections to be detected are provided in the rotating member to be detected. This makes it possible to remove the rotation board and realize a reduction in cost because the number of component is reduced.

According to the belt-drive control device in this embodiment, an amplitude and a phase of fluctuation in a rotational speed of the second support roller are derived when a power supply of the device is turned on. This makes it possible to cope with a change in an environment and aging deterioration. Even when a home position is not fixed in a specific position, it is possible to set an arbitrary position as a home position again when the power supply is turned on and derive fluctuation in a rotational speed of the second support roller in the home position. Thus, even when a home position is not fixed in a specific position, the home position and the home position of fluctuation in a rotational speed of the second support roller derived never deviate from each other.

According to the belt-drive control device in this embodiment, an amplitude and a phase of fluctuation in a rotational speed in one rotation period of the second support roller are derived every time fixed time elapses. Consequently, even if a change in an environment and aging deterioration of the second support roller occur, fluctuation in a rotational speed of the second support roller is automatically corrected. Thus, it is possible to prevent a belt conveying speed from fluctuating during operation.

According to the belt-drive control device in this embodiment, an amplitude and a phase of fluctuation in a rotational speed in one rotation period of the second support roller are derived sequentially. Consequently, even if fluctuation in a rotational speed of the second support roller changes because of a change in an environment and aging deterioration, a moving speed of the belt never fluctuates.

According to the belt-drive control device in this embodiment, the first support roller is arranged in a belt conveying path different from a belt conveying path, on which the tension roller is arranged, of two belt conveying paths formed between the second support roller and the driving roller. Consequently, the first support roller is never affected by fluctuation in a belt speed that occurs between the tension roller and the second support roller, due to eccentricity of the second support roller.

According to the belt-drive control device in this embodiment, fluctuation in a rotational speed of the second support roller corresponding to periodic fluctuation in thickness in the circumferential direction of the belt is detected by a belt-thickness-fluctuation detecting unit. It is possible to convey the belt at a constant speed by performing feedback control based on fluctuation in a rotational speed due to eccentricity of the second support roller and attachment eccentricity of the second detecting unit and fluctuation in a rotational speed due to the fluctuation in belt thickness.

According to the image forming apparatus in this embodiment, it is possible to perform control for the belt highly accurately and inexpensively and control unevenness of concentration and banding by controlling a photosensitive belt with the belt-drive control device described above.

According to the image forming apparatus in this embodiment, it is possible to perform control for the belt highly accurately and inexpensively and control unevenness of concentration and banding by controlling an intermediate transfer belt with the belt-drive control device described above.

According to the image forming apparatus in this embodiment, it is possible to perform control for the belt highly accurately and inexpensively and control unevenness of concentration and banding of an image transferred onto a sheet by controlling a sheet conveyor belt with the belt-drive control device described above.

According to the image forming apparatus in this embodiment, a position where an image is transferred onto the belt or image formation is performed is provided further on a downstream side in a belt conveying direction than the second support roller. A belt moving speed is made constant by detecting a rotational speed of the second support roller and controlling the driving source from the rotational speed. Thus, the belt is conveyed at more constant speed further on the downstream side in the belt conveying direction than the second support roller compared with an upstream side. Thus, it is possible to obtain an image, with unevenness of concentration and banding of an image controlled, by providing the position where transfer of an image or image formation is performed further on the downstream side in the belt conveying direction than the second support roller.

According to the image forming apparatus in this embodiment, a diameter of the support rotating member, which is arranged in the belt conveying path from the second support roller to the position where transfer of an image or image formation is performed, is set identical with a diameter of the second support roller. If the support rotating member is provided further on a downstream side in a belt conveying direction than the second support roller, fluctuation in a belt speed occurs between the support rotating member and the tension roller because of eccentricity of the support rotating member. A rotational speed of the second support roller fluctuates because of an influence of the fluctuation in a belt speed. To eliminate the fluctuation in a rotational speed of the second support roller, the driving source is controlled. As a result, in the conveying path from the tension roller to the support rotating member, since a fluctuation component in a belt speed due to the support rotating member is eliminated, the belt is conveyed stably. However, further on the downstream side in the belt conveying direction than the support rotating member, since fluctuation in a belt speed due to eccentricity of the support rotating member does not occur, conversely, fluctuation in a belt speed due to eccentricity of the support rotating member appears. As a result, if the position where transfer of an image or image formation is performed is provided further on the downstream side in the belt conveying direction than the support rotating member, unevenness of concentration and banding of an image occur. Thus, in such a case, a diameter of the support rotating member is made identical with a diameter of the second support roller. When the diameters are made identical, a period of fluctuation in a rotational speed due to eccentricity of the second support roller and the like and a period of fluctuation in a rotational speed caused by fluctuation in belt movement due to eccentricity of the support rotating member are made the same. Thus, when fluctuation in a rotational speed of the second support roller is calculated, a phase and an amplitude of a waveform, which is obtained by combining fluctuation in a rotational speed due to eccentricity of the second support roller and the like and fluctuation in a rotational speed due to eccentricity of the support rotating member, are derived. If control for the driving source is performed using the phase and the amplitude derived, fluctuation in a rotational speed due to eccentricity of the support rotating member detected by the detecting unit is corrected and is not fed back to the driving source. Thus, fluctuation in a belt speed due to eccentricity of the support rotating member does not occur further on the downstream side than the support rotating member. As a result, even if the position where transfer of an image or image formation is performed is provided further on the downstream side in the belt conveying direction than the support rotating member, since occurrence of unevenness of concentration and banding of an image is controlled, it is possible to form a satisfactory image.

When there is the position, where an image is transferred onto the belt or image formation is performed, is in the belt conveying path from the tension roller to the second support roller, a moving speed of the belt fluctuates between the tension roller and the second support roller because of eccentricity of the second support roller. Then, unevenness of concentration and banding of an image are caused. Thus, in such a case, an amount of fluctuation in a moving speed of the belt between the tension roller and the second support roller, which is caused by eccentricity of the second support roller, is derived from an amplitude and a phase of fluctuation in a rotational speed of the second support roller derived by the arithmetic unit. Specifically, using the detecting unit having two detectors as the second detecting unit, fluctuation in a rotational speed of the second support roller due to attachment eccentricity of the second detecting unit is eliminated from rotation information detected by the second detecting unit. A fluctuation component in a rotational speed included in the rotation information may be only a fluctuation component in a rotational speed due to eccentricity of the second support roller. A phase and an amplitude derived based on the rotation information are fluctuation in a rotational speed due to eccentricity of the second support roller. It is possible to derive fluctuation in the belt caused by eccentricity of the second support roller by substituting the phase and the amplitude derived in equation 31. If control for the driving source is performed using the amount of belt fluctuation and fluctuation in a rotational speed of the second support roller, the fluctuation in the belt caused by eccentricity of the second support roller is fed back. As a result, fluctuation in belt movement caused between the tension roller and the second support roller is eliminated. Therefore, even in the position, where an image is transferred onto the belt or image formation is performed, between the tension roller and the second support roller, it is possible to form a satisfactory image with banding and unevenness of concentration controlled.

According to the embodiments described above, it is possible to control fluctuation in a moving speed of the belt due to eccentricity or the like of the rotating member.

Moreover, according to the embodiments described above, a highly accurate rotary encoder that increases manufacturing cost is not necessary.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of controlling drive of an endless belt that is wound around a plurality of rollers including a first roller, a second roller configured to make one rotation while the first roller is rotated by a predetermined angle, and a third roller to which rotation drive force is transmitted from a driving source, the method comprising:

detecting a rotational speed of the first roller;

measuring first rotation time required for the first roller to be rotated by the predetermined angle, in different phases within one rotation of the first roller;

measuring a second rotation time required for the second roller to make one rotation;

calculating an amplitude and a phase of fluctuation in a rotational speed in one rotation period of the first roller based on the first rotation time and the second rotation time;

correcting detected rotational speed based on the amplitude and the phase; and controlling rotation of the third roller based on a corrected rotational speed.

2. The method according to claim 1, wherein the predetermined angle is $\pi$ radian.

3. The method according to claim 2, the different phases are shifted from each other by $\pi/2$ radian.

4. A method of controlling drive of an endless belt that is wound around a plurality of rollers including a first roller, a second roller having a diameter different from that of the first roller, and a third roller to which rotation drive force is transmitted from a driving source, the method comprising:

detecting a rotational speed of the first roller;

rotating the first roller at a uniform speed;

measuring, for at least twice within one rotation of the first roller, rotation time required for the second roller to make one rotation, the second roller having a diameter different from that of the first roller;

acquiring an amplitude and a phase of fluctuation in a rotational speed in one rotation period of the first roller based on the rotation time;

correcting detected rotational speed based on the amplitude and the phase; and controlling rotation of the third roller based on a corrected rotational speed.

5. A device for controlling drive of an endless belt that is wound around a plurality of rollers including a first roller being a target roller for speed detection, a second roller having a diameter different from that of the first roller, and a third roller to which rotation drive force is transmitted from a driving source, the device comprising:

a first detecting unit with low resolution configured to detect first information on rotation of the first roller and to output a signal of at least two pulses when the first roller has made one rotation;

a second detecting unit with low resolution configured to detect second information on rotation of the second roller and to output a signal of at least one pulse when the second roller has made one rotation, the second roller having a diameter different from that of the first roller;

a calculating unit configured to calculate an amplitude and a phase of fluctuation in a rotational speed in one rotation period of the first roller based on the first information and the second information; and a control unit configured to control rotation of the third roller based on the amplitude and the phase.

6. The device according to claim 5, wherein the first information includes first time required for the first roller to be rotate by the predetermined angle from a first position, and second time required for the first roller to rotate by the predetermined angle from a second position.

7. The device according to claim 6, wherein the predetermined angle is $\pi$ radian.

8. The device according to claim 7, wherein a phase difference angle of the first position and the second position is $\pi/2$ radian.

9. The device according to claim 6, wherein the first detecting unit includes a plurality of sections to be detected that are arranged in an annular shape around a rotation axis of the first roller; and a detector configured to output a pulse signal when the sections are detected, the first time and the second time is obtained by detecting the sections.

10. The device according to claim 9, wherein a circumference of the second roller is an integral multiple of a peripheral length between adjacent sections among the plurality of sections.

11. The device according to claim 9, wherein a diameter of the first roller is 4n times as large as a diameter of the second roller, where n is a positive integer.

12. The device according to claim 9, wherein a ratio of a diameter of the first roller and a diameter of the second roller is 2:1.

13. The device according to claim 5, wherein the first detecting unit includes a plurality of sections to be detected that are arranged in an annular shape around a rotation axis of the first roller; and a detector configured to detect the sections and to output a pulse signal when the sections are detected, and one of the sections is set as a home position to be a reference for the calculating unit in calculating the amplitude and the phase.

14. The device according to claim 13, wherein the control unit further controls the driving source, and the home position is a reference for the control unit in controlling the driving source.

15. The device according to claim 13, wherein the first detecting unit includes at least three sections to be detected.

16. The device according to claim 5, wherein the first detecting unit includes a plurality of sections to be detected that are arranged in an annular shape around a rotation axis of the first roller; and a detector configured to detect the sections and to output a pulse signal when the sections are detected, the detector including a first detector; and a second detector configured to detect a section at a position at which a phase is shifted by 180° from a section detected by the first detector.

17. The device according to claim 5, wherein at least one of the first detecting unit and the second detecting unit includes a rotating board including a plurality of sections to be detected that are arranged in an annular shape around a rotation axis of the first roller, and configured to be fixed to the first roller; and a detector configured to detect the sections and to output a pulse signal when the sections are detected.

18. The device according to claim 5, wherein at least one of the first detecting unit and the second detecting unit includes a plurality of sections to be detected that are arranged in the first roller in an annular shape around a rotation axis of the first roller; and a detector configured to detect the sections and to output a pulse signal when the sections are detected.

19. The device according to claim 5, wherein the calculating unit calculates the amplitude and the phase when the device is powered on.

20. The device according to claim 5, wherein the calculating unit calculates the amplitude and the phase every time a predetermined time elapses.

21. The device according to claim 5, wherein the calculating unit sequentially calculates the amplitude and the phase.

22. The device according to claim 5, wherein the rollers further includes a tension roller arranged on one of two belt conveying paths formed between the first roller and the third roller, and the second roller is arranged on another of the two belt conveying paths.

23. The device according to claim 5, further comprising a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase.

24. A device for controlling drive of an endless belt that is wound around a plurality of rollers including a first roller being a target roller for speed detection, a second roller having a diameter different from that of the first roller, and a third roller to which rotation drive force is transmitted from a driving source, the device comprising:

a first detecting unit with low resolution configured to detect first information on rotation of the first roller and to output a signal of at least two pulses when the first roller has made one rotation;

a second detecting unit with high resolution configured to detect second information on rotation of the second roller;

a calculating unit configured to calculate an amplitude and a phase of fluctuation in a rotational speed in one rotation period of the first roller based on the first information; and a control unit configured to control rotation of the third roller based on the amplitude and the phase.

25. The device according to claim 24, wherein the first information includes first time required for the first roller to be rotate by the predetermined angle from a first position, and second time required for the first roller to rotate by the predetermined angle from a second position.

26. The device according to claim 25, wherein the predetermined angle is $\pi$ radian.

27. The device according to claim 26, wherein a phase difference angle of the first position and the second position is $\pi/2$ radian.

28. The device according to claim 25, wherein the first detecting unit includes a plurality of sections to be detected that are arranged in an annular shape around a rotation axis of the first roller; and a detector configured to output a pulse signal when the sections are detected, the first time and the second time is obtained by detecting the sections.

29. The device according to claim 28, wherein a circumference of the second roller is an integral multiple of a peripheral length between adjacent sections among the sections.

30. The device according to claim 28, wherein a diameter of the first roller is 4n times as large as a diameter of the second roller, where n is a positive integer.

31. The device according to claim 28, wherein a ratio of a diameter of the first roller and a diameter of the second roller is 2:1.

32. The device according to claim 24, wherein the first detecting unit includes a plurality of sections to be detected that are arranged in an annular shape around a rotation axis of the first roller; and a detector configured to detect the sections and to output a pulse signal when the sections are detected, and one of the sections is set as a home position to be a reference for the calculating unit in calculating the amplitude and the phase.

33. The device according to claim 32, wherein the control unit further controls the driving source, and the home position is a reference for the control unit in controlling the driving source.

34. The device according to claim 32, wherein the first detecting unit includes at least three sections to be detected.

35. The device according to claim 24, wherein the first detecting unit includes a plurality of sections to be detected that are arranged in an annular shape around a rotation axis of the first roller; and a detector configured to detect the sections and to output a pulse signal when the sections are detected, the detector including a first detector; and a second detector configured to detect a section at a position at which a phase is shifted by 180° from a section detected by the first detector.

36. The device according to claim 24, wherein at least one of the first detecting unit and the second detecting unit includes a rotating board including a plurality of sections to be detected that are arranged in an annular shape around a rotation axis of the first roller, and configured to be fixed to the first roller; and a detector configured to detect the sections and to output a pulse signal when the sections are detected.

37. The device according to claim 24, wherein at least one of the first detecting unit and the second detecting unit includes a plurality of sections to be detected that are arranged in the first roller in an annular shape around a rotation axis of the first roller; and a detector configured to detect the sections and to output a pulse signal when the sections are detected.

38. The device according to claim 24, wherein the calculating unit calculates the amplitude and the phase when the device is powered on.

39. The device according to claim 24, wherein the calculating unit calculates the amplitude and the phase every time a predetermined time elapses.

40. The device according to claim 24, wherein the calculating unit sequentially calculates the amplitude and the phase.

41. The device according to claim 24, wherein the rollers further includes a tension roller arranged on one of two belt conveying paths formed between the first roller and the third roller, and the second roller is arranged on another of the two belt conveying paths.

42. The device according to claim 24, further comprising a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase.

43. A device for controlling drive of an endless belt that is wound around a plurality of rollers including a first roller being a target roller for speed detection, a second roller having a diameter different from that of the first roller, and a third roller to which rotation drive force is transmitted from a driving source, the device comprising:

a first detecting unit with high resolution configured to detect first information on rotation of the first roller;

a second detecting unit with low resolution configured to detect second information on rotation of the second roller and to output a signal of at least one pulse when the second roller has made one rotation;

a calculating unit configured to calculate an amplitude and a phase of fluctuation in a rotational speed in one rotation period of the first roller based on the second information; and a control unit configured to control the third roller based on the amplitude and the phase.

44. The device according to claim 43, wherein the first information includes first time required for the first roller to be rotate by the predetermined angle from a first position, and second time required for the first roller to rotate by the predetermined angle from a second position.

45. The device according to claim 44, wherein the predetermined angle is $\pi$ radian.

46. The device according to claim 45, wherein a phase difference angle of the first position and the second position is $\pi/2$ radian.

47. The device according to claim 44, wherein the first detecting unit includes a plurality of sections to be detected that are arranged in an annular shape around a rotation axis of the first roller; and a detector configured to output a pulse signal when the sections are detected, the first time and the second time is obtained by detecting the sections.

48. The device according to claim 47, wherein a circumference of the second roller is an integral multiple of a peripheral length between adjacent sections among the sections.

49. The device according to claim 47, wherein a diameter of the first roller is 4n times as large as a diameter of the second roller, where n is a positive integer.

50. The device according to claim 47, wherein a ratio of a diameter of the first roller and a diameter of the second roller is 2:1.

51. The device according to claim 43, wherein the first detecting unit includes a plurality of sections to be detected that are arranged in an annular shape around a rotation axis of the first roller; and a detector configured to detect the sections and to output a pulse signal when the sections are detected, and one of the sections is set as a home position to be a reference for the calculating unit in calculating the amplitude and the phase.

52. The device according to claim 51, wherein the control unit further controls the driving source, and the home position is a reference for the control unit in controlling the driving source.

53. The device according to claim 51, wherein the first detecting unit includes at least three sections to be detected.

54. The device according to claim 43, wherein the first detecting unit includes a plurality of sections to be detected that are arranged in an annular shape around a rotation axis of the first roller; and a detector configured to detect the sections and to output a pulse signal when the sections are detected, the detector including a first detector; and a second detector configured to detect a section at a position at which a phase is shifted by 180° from a section detected by the first detector.

55. The device according to claim 43, wherein at least one of the first detecting unit and the second detecting unit includes a rotating board including a plurality of sections to be detected that are arranged in an annular shape around a rotation axis of the first roller, and configured to be fixed to the first roller; and a detector configured to detect the sections and to output a pulse signal when the sections are detected.

56. The device according to claim 43, wherein at least one of the first detecting unit and the second detecting unit includes a plurality of sections to be detected that are arranged in the first roller in an annular shape around a rotation axis of the first roller; and a detector configured to detect the sections and to output a pulse signal when the sections are detected.

57. The device according to claim 43, wherein the calculating unit calculates the amplitude and the phase when the device is powered on.

58. The device according to claim 43, wherein the calculating unit calculates the amplitude and the phase every time a predetermined time elapses.

59. The device according to claim 43, wherein the calculating unit sequentially calculates the amplitude and the phase.

60. The device according to claim 43, wherein the rollers further includes a tension roller arranged on one of two belt conveying paths formed between the first roller and the third roller, and the second roller is arranged on another of the two belt conveying paths.

61. The device according to claim 43, further comprising a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase.

62. An image forming apparatus comprising:

a latent image carrier including an endless belt wound around a plurality of rollers;

a latent-image forming unit configured to form a latent image on the latent image carrier;

a developing unit configured to develop the latent image on the latent image carrier;

a transfer unit configured to transfer a visual image formed on the latent image carrier onto a recording material; and a device for controlling driving of the endless belt wound around a plurality of rollers including a first roller being a target roller for speed detection, a second roller having a diameter different from that of the first roller, and a third roller to which rotation drive force is transmitted from a driving source, and including a first detecting unit with low resolution configured to detect first information on rotation of the first roller and to output a signal of at least two pulses when the first roller has made one rotation;

a second detecting unit with low resolution configured to detect second information on rotation of the second roller and to output a signal of at least one pulse when the second roller has made one rotation, the second roller having a diameter different from that of the first roller;

a calculating unit configured to calculate an amplitude and a phase of fluctuation in a rotational speed in one rotation period of the first roller based on the first information and the second information; and a control unit configured to control rotation of the third roller based on the amplitude and the phase.

63. The image forming apparatus according to claim 62, wherein an image transfer position at which an image is formed and transferred onto the endless belt is downstream from the first roller in a direction of rotation of the endless belt.

64. The image forming apparatus according to claim 63, wherein a diameter of one of the rollers that is arranged at a portion between a position of the first roller and the image transfer position on a belt conveying path is identical to a diameter of the first roller.

65. The image forming apparatus according to claim 62, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

66. An image forming apparatus comprising:

a latent image carrier including an endless belt wound around a plurality of rollers;

a latent-image forming unit configured to form a latent image on the latent image carrier;

a developing unit configured to develop the latent image on the latent image carrier;

a transfer unit configured to transfer a visual image formed on the latent image carrier onto a recording material; and a device for controlling driving of the endless belt wound around a plurality of rollers including a first roller being a target roller for speed detection, a second roller having a diameter different from that of the first roller, and a third roller to which rotation drive force is transmitted from a driving source, and including a first detecting unit with low resolution configured to detect first information on rotation of the first roller and to output a signal of at least two pulses when the first roller has made one rotation;

a second detecting unit with high resolution configured to detect second information on rotation of the second roller;

a calculating unit configured to calculate an amplitude and a phase of fluctuation in a rotational speed in one rotation period of the first roller based on the first information; and a control unit configured to control rotation of the third roller based on the amplitude and the phase.

67. The image forming apparatus according to claim 66, wherein an image transfer position at which an image is formed and transferred onto the endless belt is downstream from the first roller in a direction of rotation of the endless belt.

68. The image forming apparatus according to claim 67, wherein a diameter of one of the rollers that is arranged at a portion between a position of the first roller and the image transfer position on a belt conveying path is identical to a diameter of the first roller.

69. The image forming apparatus according to claim 66, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

70. An image forming apparatus comprising:

a latent image carrier including an endless belt wound around a plurality of rollers;

a latent-image forming unit configured to form a latent image on the latent image carrier;

a developing unit configured to develop the latent image on the latent image carrier;

a transfer unit configured to transfer a visual image formed on the latent image carrier onto a recording material; and a device for controlling driving of the endless belt wound around a plurality of rollers including a first roller being a target roller for speed detection, a second roller having a diameter different from that of the first roller, and a third roller to which rotation drive force is transmitted from a driving source, and including a first detecting unit with high resolution configured to detect first information on rotation of the first roller;

a second detecting unit with low resolution configured to detect second information on rotation of the second roller and to output a signal of at least one pulse when the second roller has made one rotation;

a calculating unit configured to calculate an amplitude and a phase of fluctuation in a rotational speed in one rotation period of the first roller based on the second information; and a control unit configured to control the third roller based on the amplitude and the phase.

71. The image forming apparatus according to claim 70, wherein an image transfer position at which an image is formed and transferred onto the endless belt is downstream from the first roller in a direction of rotation of the endless belt.

72. The image forming apparatus according to claim 71, wherein a diameter of one of the rollers that is arranged at a portion between a position of the first roller and the image transfer position on a belt conveying path is identical to a diameter of the first roller.

73. The image forming apparatus according to claim 70, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

74. An image forming apparatus comprising:

a latent image carrier;

a latent-image forming unit configured to form a latent image on the latent image carrier;

a developing unit configured to develop a latent image on the latent image carrier;

an intermediate transfer member including an endless belt wound around a plurality of rollers;

a first transfer unit configured to transfer a visual image formed on the latent image carrier onto the intermediate transfer member;

a second transfer unit configured to transfer transferred visual image on the intermediate transfer member onto a recording material; and a device for controlling drive of the endless belt wound around a plurality of rollers including a first roller being a target roller for speed detection, a second roller having a diameter different from that of the first roller, and a third roller to which rotation drive force is transmitted from a driving source, the device including a first detecting unit with low resolution configured to detect first information on rotation of the first roller and to output a signal of at least two pulses when the first roller has made one rotation;

a second detecting unit with low resolution configured to detect second information on rotation of the second roller and to output a signal of at least one pulse when the second roller has made one rotation, the second roller having a diameter different from that of the first roller;

a calculating unit configured to calculate an amplitude and a phase of fluctuation in a rotational speed in one rotation period of the first roller based on the first information and the second information; and a control unit configured to control rotation of the third roller based on the amplitude and the phase.

75. The image forming apparatus according to claim 74, wherein an image transfer position at which an image is formed and transferred onto the endless belt is downstream from the first roller in a direction of rotation of the endless belt.

76. The image forming apparatus according to claim 75, wherein a diameter of one of the rollers that is arranged at a portion between a position of the first roller and the image transfer position on a belt conveying path is identical to a diameter of the first roller.

77. The image forming apparatus according to claim 74, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

78. An image forming apparatus comprising:

a latent image carrier;

a latent-image forming unit configured to form a latent image on the latent image carrier;

a developing unit configured to develop a latent image on the latent image carrier;

an intermediate transfer member including an endless belt wound around a plurality of rollers;

a first transfer unit configured to transfer a visual image formed on the latent image carrier onto the intermediate transfer member;

a second transfer unit configured to transfer transferred visual image on the intermediate transfer member onto a recording material; and a device for controlling drive of the endless belt wound around a plurality of rollers including a first roller being a target roller for speed detection, a second roller having a diameter different from that of the first roller, and a third roller to which rotation drive force is transmitted from a driving source, the device including a first detecting unit with low resolution configured to detect first information on rotation of the first roller and to output a signal of at least two pulses when the first roller has made one rotation;

a second detecting unit with high resolution configured to detect second information on rotation of the second roller;

a calculating unit configured to calculate an amplitude and a phase of fluctuation in a rotational speed in one rotation period of the first roller based on the first information; and a control unit configured to control rotation of the third roller based on the amplitude and the phase.

79. The image forming apparatus according to claim 78, wherein an image transfer position at which an image is formed and transferred onto the endless belt is downstream from the first roller in a direction of rotation of the endless belt.

80. The image forming apparatus according to claim 79, wherein a diameter of one of the rollers that is arranged at a portion between a position of the first roller and the image transfer position on a belt conveying path is identical to a diameter of the first roller.

81. The image forming apparatus according to claim 78, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

82. An image forming apparatus comprising:

a latent image carrier;

a latent-image forming unit configured to form a latent image on the latent image carrier;

a developing unit configured to develop a latent image on the latent image carrier;

an intermediate transfer member including an endless belt wound around a plurality of rollers;

a first transfer unit configured to transfer a visual image formed on the latent image carrier onto the intermediate transfer member;

a second transfer unit configured to transfer transferred visual image on the intermediate transfer member onto a recording material; and a device for controlling drive of the endless belt wound around a plurality of rollers including a first roller being a target roller for speed detection, a second roller having a diameter different from that of the first roller, and a third roller to which rotation drive force is transmitted from a driving source, the device including a first detecting unit with high resolution configured to detect first information on rotation of the first roller;

a second detecting unit with low resolution configured to detect second information on rotation of the second roller and to output a signal of at least one pulse when the second roller has made one rotation;

a calculating unit configured to calculate an amplitude and a phase of fluctuation in a rotational speed in one rotation period of the first roller based on the second information; and a control unit configured to control the third roller based on the amplitude and the phase.

83. The image forming apparatus according to claim 82, wherein an image transfer position at which an image is formed and transferred onto the endless belt is downstream from the first roller in a direction of rotation of the endless belt.

84. The image forming apparatus according to claim 83, wherein a diameter of one of the rollers that is arranged at a portion between a position of the first roller and the image transfer position on a belt conveying path is identical to a diameter of the first roller.

85. The image forming apparatus according to claim 82, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

86. An image forming apparatus comprising:

a latent image carrier;

a latent-image forming unit configured to form a latent image on the latent image carrier;

a developing unit configured to develop a latent image on the latent image carrier;

a recording-material conveying member including an endless belt wound around a plurality of rollers and configured to convey a recording material;

a transfer unit configured to transfer a visual image formed on the latent image carrier onto the recording material; and a device for controlling driving of the endless belt wound around a plurality of rollers including a first roller being a target roller for speed detection, a second roller having a diameter different from that of the first roller, and a third roller to which rotation drive force is transmitted from a driving source, the device including a first detecting unit with low resolution configured to detect first information on rotation of the first roller and to output a signal of at least two pulses when the first roller has made one rotation;

a second detecting unit with low resolution configured to detect second information on rotation of the second roller and to output a signal of at least one pulse when the second roller has made one rotation, the second roller having a diameter different from that of the first roller;

a calculating unit configured to calculate an amplitude and a phase of fluctuation in a rotational speed in one rotation period of the first roller based on the first information and the second information; and a control unit configured to control rotation of the third roller based on the amplitude and the phase.

87. The image forming apparatus according to claim 86, wherein an image transfer position at which an image is formed and transferred onto the endless belt is downstream from the first roller in a direction of rotation of the endless belt.

88. The image forming apparatus according to claim 87, wherein a diameter of one of the rollers that is arranged at a portion between a position of the first roller and the image transfer position on a belt conveying path is identical to a diameter of the first roller.

89. The image forming apparatus according to claim 86, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

90. An image forming apparatus comprising:

a latent image carrier;

a latent-image forming unit configured to form a latent image on the latent image carrier;

a developing unit configured to develop a latent image on the latent image carrier;

a recording-material conveying member including an endless belt wound around a plurality of rollers and configured to convey a recording material;

a transfer unit configured to transfer a visual image formed on the latent image carrier onto the recording material; and a device for controlling driving of the endless belt wound around a plurality of rollers including a first roller being a target roller for speed detection, a second roller having a diameter different from that of the first roller, and a third roller to which rotation drive force is transmitted from a driving source, the device including a first detecting unit with low resolution configured to detect first information on rotation of the first roller and to output a signal of at least two pulses when the first roller has made one rotation;

a second detecting unit with high resolution configured to detect second information on rotation of the second roller;

a calculating unit configured to calculate an amplitude and a phase of fluctuation in a rotational speed in one rotation period of the first roller based on the first information; and a control unit configured to control rotation of the third roller based on the amplitude and the phase.

91. The image forming apparatus according to claim 90, wherein an image transfer position at which an image is formed and transferred onto the endless belt is downstream from the first roller in a direction of rotation of the endless belt.

92. The image forming apparatus according to claim 91, wherein a diameter of one of the rollers that is arranged at a portion between a position of the first roller and the image transfer position on a belt conveying path is identical to a diameter of the first roller.

93. The image forming apparatus according to claim 90, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

94. An image forming apparatus comprising:

a latent image carrier;

a latent-image forming unit configured to form a latent image on the latent image carrier;

a developing unit configured to develop a latent image on the latent image carrier;

a recording-material conveying member including an endless belt wound around a plurality of rollers and configured to convey a recording material;

a transfer unit configured to transfer a visual image formed on the latent image carrier onto the recording material; and a device for controlling driving of the endless belt wound around a plurality of rollers including a first roller being a target roller for speed detection, a second roller having a diameter different from that of the first roller, and a third roller to which rotation drive force is transmitted from a driving source, the device including a first detecting unit with high resolution configured to detect first information on rotation of the first roller;

a second detecting unit with low resolution configured to detect second information on rotation of the second roller and to output a signal of at least one pulse when the second roller has made one rotation;

a calculating unit configured to calculate an amplitude and a phase of fluctuation in a rotational speed in one rotation period of the first roller based on the second information; and a control unit configured to control the third roller based on the amplitude and the phase.

95. The image forming apparatus according to claim 94, wherein an image transfer position at which an image is formed and transferred onto the endless belt is downstream from the first roller in a direction of rotation of the endless belt.

96. The image forming apparatus according to claim 95, wherein a diameter of one of the rollers that is arranged at a portion between a position of the first roller and the image transfer position on a belt conveying path is identical to a diameter of the first roller.

97. The image forming apparatus according to claim 94, the device further includes a thickness-fluctuation detecting unit configured to detect fluctuation in a rotational speed of the first roller due to fluctuation in thickness of the endless belt, wherein the control unit further controls the driving source based on the fluctuation detected by the thickness-fluctuation detecting unit, the amplitude, and the phase, when a position at which an image is formed and transferred onto the endless belt is located between a tension roller and the first roller on a belt conveying path, fluctuation in a moving speed of the endless belt within a portion of a belt conveying path from the tension roller to the first roller is calculated based on the amplitude and the phase, the fluctuation in the moving speed due to eccentricity of the first roller, and the control unit further controls the driving source based on the fluctuation in the moving speed and the amplitude and the phase.

* * * * *